US005512926A

United States Patent [19]

Uchikata et al.

[11] Patent Number: 5,512,926

[45] Date of Patent: Apr. 30, 1996

[54] INK JET RECORDING APPARATUS AND METHOD FOR RELEASABLY MOUNTING INK JET RECORDING HEAD AND SEPARABLE INK TANK

[75] Inventors: Yoshio Uchikata, Yokohama; Yoshifumi Hattori, Yamato; Yoji Ara, Yokohama; Masashi Kitani, Yokohama; Etsurou Suzuki, Yokohama; Toshihide Wada, Yokohama; Hiromitsu Hirabayashi, Yokohama; Hideo Saikawa, Kawasaki; Masami Kojima, Tokyo; Tadashi Hanabusa, Yokohama; Kenji Kawano, Tokyo; Koichi Tanno, Kawasaki; Tetsuyo Ohashi, Yokohama; Toshihiko Bekki; Kenji Aono, both of Kawasaki; Masaharu Ikado, Yokohama, all of Japan

[73] Assignee: Canon Kabushiki Kaisha, Tokyo, Japan

[21] Appl. No.: 478,827

[22] Filed: Jun. 7, 1995

Related U.S. Application Data

[63] Continuation of Ser. No. 988,442, Dec. 9, 1992, abandoned.

[30] Foreign Application Priority Data

| | | | |
|---|---|---|---|
| Dec. 11, 1991 | [JP] | Japan | 3-327558 |
| Dec. 11, 1991 | [JP] | Japan | 3-327709 |
| Dec. 11, 1991 | [JP] | Japan | 3-327710 |
| Dec. 11, 1991 | [JP] | Japan | 3-327711 |
| Dec. 11, 1991 | [JP] | Japan | 3-327714 |
| Dec. 11, 1991 | [JP] | Japan | 3-327715 |
| Dec. 11, 1991 | [JP] | Japan | 3-327717 |
| Dec. 11, 1991 | [JP] | Japan | 3-327719 |
| Dec. 11, 1991 | [JP] | Japan | 3-350807 |
| Dec. 11, 1991 | [JP] | Japan | 3-351047 |
| Dec. 19, 1991 | [JP] | Japan | 3-336790 |

[51] Int. Cl.[6] ..... B41J 2/175

[52] U.S. Cl. ..... 347/86

[58] Field of Search ..... 347/49, 86

[56] References Cited

U.S. PATENT DOCUMENTS

| | | | |
|---|---|---|---|
| 4,313,124 | 1/1982 | Hara | 346/140 R |
| 4,345,262 | 8/1982 | Shirato et al. | 346/140 R |
| 4,459,600 | 7/1984 | Sato et al. | 346/140 R |
| 4,463,359 | 7/1984 | Ayata et al. | 346/1.1 |
| 4,551,734 | 11/1985 | Causley et al. | 347/86 |
| 4,558,333 | 12/1985 | Sugitani et al. | 346/140 R |
| 4,635,080 | 1/1987 | Watanabe | 346/140 R |
| 4,684,962 | 8/1987 | Hirosawa et al. | 346/140 R |
| 4,698,650 | 10/1987 | Watanabe et al. | 347/86 |
| 4,723,129 | 2/1988 | Endo et al. | 346/1.1 |
| 4,740,796 | 4/1988 | Endo et al. | 346/1.1 |
| 4,970,533 | 11/1990 | Saito et al. | 346/140 R |
| 4,990,938 | 2/1991 | Brandon et al. | 346/140 R |
| 5,008,688 | 4/1991 | Ebinuma et al. | 346/140 R |
| 5,023,629 | 6/1991 | Kiyohara | 347/86 |
| 5,162,818 | 11/1992 | Karita et al. | 346/140 R |

FOREIGN PATENT DOCUMENTS

| | | |
|---|---|---|
| 0378240 | 7/1990 | European Pat. Off. . |
| 0381392 | 8/1990 | European Pat. Off. . |
| 0412459 | 2/1991 | European Pat. Off. . |
| 0424133 | 4/1991 | European Pat. Off. . |

(List continued on next page.)

*Primary Examiner*—N. Le

*Attorney, Agent, or Firm*—Fitzpatrick, Cella, Harper & Scinto

[57] ABSTRACT

An ink jet recording apparatus comprises an ink tank containing ink; a recording head for performing recording by selectively ejecting ink; a mounting portion for mounting the ink tank and the recording head; a liquid passage coupling portion provided on either or both of the ink tank and the recording head for separating or connecting the ink passages in the ink tank and the recording head; a holding portion provided on either or both of the ink tank and recording head for guiding the ink tank to the recording head in order to hold them separably; and an electrically or mechanically connecting portion provided on either or both of the recording head and mounting portion for electrically or mechanically connecting the recording head to or separating it from the mounting portion.

11 Claims, 62 Drawing Sheets

FOREIGN PATENT DOCUMENTS

| | | | |
|---|---|---|---|
| 54-056847 | 5/1979 | Japan . | |
| 59-123670 | 7/1984 | Japan . | |
| 59-138461 | 8/1984 | Japan . | |
| 60-071260 | 4/1985 | Japan . | |
| 60-204331 | 10/1985 | Japan . | |
| 0192643 | 10/1985 | Japan | 347/86 |
| 219059 | 11/1985 | Japan | 347/49 |
| 158050 | 7/1987 | Japan | 347/86 |
| 0004953 | 1/1988 | Japan | 346/140 R |
| 0039945 | 2/1990 | Japan | 346/140 R |
| 292048 | 12/1990 | Japan | 347/86 |
| 2087800 | 6/1982 | United Kingdom . | |

INK JET RECORDING APPARATUS AND METHOD FOR RELEASABLY MOUNTING INK JET RECORDING HEAD AND SEPARABLE INK TANK

This application is a continuation of application Ser. No. 07/988,442 filed Dec. 9, 1992, now abandoned.

BACKGROUND OF THE INVENTION

1. Field of the Invention

The present invention relates to an ink jet recording apparatus using the ink jet recording method to perform recording by ejecting ink, and a method for installing an ink jet recording head.

2. Related Background Art

A number of printers, facsimile apparatuses, word processors, and other information apparatuses are being developed today. As these apparatuses, the ink jet recording method is widely used because it is capable of providing a high resolution, a high speed recording as well as a compact fabrication and a low cost. Among many other advantages, its capability of being fabricated compactly and operated at a low running cost are particularly significant.

As shown in FIG. 20, there has hitherto been a method wherein a head cartridge 1801 integrally structured with a recording head 1801*a* and an ink tank 1801*b* filled with ink is exchangeably mounted on a mounting unit 1802 of an apparatus. However, this method has a drawback that its running cost is high because the recording head in this case is an article of consumption. Also, the recording head 1801*a* has yet to reach its life when ink has been consumed completely. This is a waste because a recording head 1801*a* which is still usable for recording is discarded.

There is also a method wherein a recording head 1901 and an ink tank 1902 are structured separately and are exchangeably mounted on the mounting unit 1903 of a recording apparatus individually as shown in FIG. 21, for example. However, with this method, it is necessary to provide the ink supply passage 1904 on the recording apparatus in order to supply ink in the ink tank to the recording head. As a result, the cost is inevitably increased and this also hinders making the apparatus compact. Moreover, when ink tank containing ink materials of different colors are utilized, ink mixture takes place in the ink passages in a recording apparatus even if the recording heads 1901 and ink tanks 1902 are replaced. In order to avoid this mixture, it is necessary that the recording heads 1901, ink tanks 1902 and ink supply passages 1904 are mounted on the mounting units 1903 separately for each color.

Also, as shown in FIG. 22, for example, there is a method wherein a recording head 1701 is connected and fixed to the mounting unit 1702 of a recording apparatus while an ink tank 1703 is exchangeably connected to the foregoing recording head 1701. This method, however, makes it difficult to replace the recording heads with ease when the recording head is damaged. Also, when ink tanks contain ink materials of different colors, there will take place a mixture of ink in the recording head. Accordingly, recording heads 1701 must be provided in the mounting unit 1702 separately for each color of ink.

SUMMARY OF THE INVENTION

The present invention is designed in consideration of the above-mentioned problems. It is an object of the invention to provide an ink jet recording apparatus capable of reducing the running cost, replacing ink tanks and recording heads with ease, preventing ink from being scattered when the recording heads are replaced, and replacing ink colors simply without any mixtures.

It is another object of the present invention to provide an ink jet recording apparatus capable of coupling the recording head and carriage reliably when the recording head is mounted on the carriage, at the same time keeping the easiness with which to replace the ink tanks and recording heads.

It is still another object of the present invention to provide an ink jet recording apparatus wherein the positioning precisions of the ink tank and recording head do not affect each other when the ink tank and recording head are mounted and fixed to a carriage while keeping the easiness with which to replace the ink tanks and recording heads.

An embodiment of the present invention is characterized by having ink passage means enabling the ink tank and recording head to be coupled to each other and detached from each other, and coupling means enabling the recording head and the recording apparatus to be connected with each other and detached from each other.

According to such an embodiment, it is possible to reduce the running cost because the recording heads and ink tanks can thus be replaced selectively, leading to an improvement of operational economy.

Also, the recording heads and ink tanks can be replaced integrally; hence enabling the maintenance of the recording heads and ink tanks having different ink colors. In this way, it is possible to change ink colors simply with the replacement of these heads and ink tanks thus maintained.

Furthermore, since the recording heads and ink tanks can be replaced on a carriage, the operativity is improved while preventing ink from being scattered.

Moreover, there is less opportunity to touch the recording head by hand directly. Therefore, it is possible to prevent dust particles and air to be mixed with ink; thus enabling the recording reliability to be enhanced.

According to another embodiment of an ink jet recording apparatus of the present invention, there are provided an ink passage coupling unit to allow the ink tank and recording head to be connected with each other and detached from each other as well as a coupling unit to allow the recording head and the mounting unit to be connected with each other and detached from each other, the ink passage coupling unit being structured to make it possible to couple the ink tank and recording head at least in two directions or more.

According to such an embodiment, the recording head can be mounted irrespective of the mounting directions of the ink tank; hence enabling the selections of the ink ejection direction with the result that the installation direction of the apparatus is not restricted. This will provide a flexibility for the purpose.

Also, since the ink tank is mounted on the carrier, there is no need for the provision of any ink supply tubes and others. This will enable a compact fabrication of the apparatus. In addition, when ink is completely consumed, it will suffice only if ink tanks are replaced, not the cartridge where the head is fabricated integrally therewith. Thus, the running cost can be reduced.

Also, when either one of the recording head and the ink tank should be replaced, it is good enough to replace only the one of them which requires the replacement. This will improve the operational economy.

Also, when recording heads are replaced, it is easy to separate the carrier and head. This will make the replacement easier.

Moreover, it is possible to use one kind of recording head for various modes of head cartridge, which enables its application to many different types of recording apparatuses. Hence, the versatility is enhanced to provide a desirable efficiency.

According to another embodiment of an ink jet recording apparatus of the present invention, an ink jet recording apparatus which performs recording by ejecting ink is characterized in that a recording head and an ink tank are separable and exchangeable, and that the foregoing recording head can be coupled to a carriage which carries the recording head in a given direction by pressing the foregoing recording head.

According to such an embodiment, irrespective of whether the recording head is coupled to the ink tank or not, the recording head is pressed against the carriage directly without any intervention of other members. As a result, the accuracy with which to position the recording head and carriage is highly improved. At the same time, the contacting reliability of the electrical connection to supply power from the recording apparatus to the recording head is remarkably improved to obtain an ink jet recording apparatus of an ink tank/head exchangeable type having a remarkable reliability and extremely high recording quality.

According to another ink jet recording apparatus embodying the present invention, an ink jet recording apparatus which performs recording by ejecting ink is structured to separate the ink tank and recording head and is characterized by allowing the foregoing ink tank and recording head to be mounted on a carriage by separate means, respectively.

With such an embodiment as this, it becomes possible to mount a most suitable ink tank without degrading the accuracy with which to mount a recording head to the carriage because the recording head and the exchangeable ink tank are arranged independent of each other thereby to enable the implementation of an ink jet recording apparatus demonstrating a desirable recording quality as well as a remarkable reliability, which can be operated at a low running cost.

Another ink jet recording apparatus embodying the present invention is characterized in the following:

(1) A member is arranged to mount an ink jet cartridge in a carrier detachably and hold it in the carrier for the foregoing ink jet cartridge.

(2) In an ink jet recording apparatus, an ink jet cartridge is partitioned for a recording head and an ink tank which are structured separably, a recording head is provided with a member to mount the recording head in a carrier detachably and to hold it in the carrier.

(3) In the ink jet cartridge described in Paragraph (2), an ink tank is provided with a member to mount the ink tank in the carrier detachably and hold it in the carrier.

With such an embodiment as this, there is arranged on an ink jet cartridge a member to mount the ink jet cartridge in a carrier detachably and hold it the carrier. Accordingly, it becomes unnecessary for the carrier to be provided with such a member; hence enabling the finished product to be made compact with a simple structure and an enhanced operativity.

According to another embodiment of an ink jet recording apparatus of the present invention, there are provided for an ink jet recording apparatus which performs recording by ejecting ink onto a recording medium, a carriage for mounting the foregoing recording head, which travels along the foregoing recording medium; and an ink tank detachably mountable in the foregoing recording head, and such an ink jet recording apparatus is characterized in that means for regulating the direction in which the foregoing ink tank approaches the recording head is arranged for the foregoing carriage or ink tank or the carriage and ink tank.

According to such an embodiment as this, there is arranged means for regulating the direction in which the foregoing tank approaches the recording head for the carriage and/or ink tank thereby to prevent the ink tank from causing any damage to the recording head even when an extra force is exerted by an operator when mounting the ink tank or the ink tank is pressed by mistake because the ink tank is controlled before the ink tank imparts such a pressure to the recording head.

Another ink jet recording apparatus embodying the present invention is characterized in that the head is provided with an ink supply inlet to supply ink to an ink cartridge, and a member to position the head and ink cartridge, and that the ink supply inlet is cylindrically shaped with a desirable sealing capability while a separate member is provided for positioning the ink cartridge and head.

According to another embodiment of an ink jet recording apparatus of the present invention, there are provided for an ink jet recording apparatus which performs recording by a recording head ejecting ink droplets onto a recording medium, a carriage for mounting the foregoing recording head, which travels along the foregoing recording medium, and an ink tank detachably mountable in the foregoing recording head, wherein means for controlling the mounting direction of the foregoing ink tank on the carriage only one way is arranged for the foregoing carriage or ink tank or the carriage and ink tank.

According to such an embodiment as this, means for controlling the mounting direction of the ink tank on the carriage only one way is provided thereby to avoid making any mistakes in deciding on the mounting direction of the ink tank with respect to the carriage as well as preventing any damage to the recording head due to any erroneous mounting of the ink tank.

According to another embodiment of an ink jet recording apparatus of the present invention, an ink jet recording apparatus in which an ink tank is coupled to the recording head when the recording head is mounted in the recording apparatus, it is characterized in that an indicator is provided to indicate that the recording head and ink tank have been correctly coupled.

According to such an embodiment as this, it is possible to couple the ink tank and recording head assuredly by conducting the coupling operation until positioning indications or positioning couplers provided for the ink tank and recording are matched or actuated.

Another ink jet recording apparatus embodying the present invention is characterized in the following:

(1) an absorbent is provided in the vicinity of the area where the recording head of the foregoing ink jet cartridge and the ink tank are coupled.

(2) a groove is provided in the vicinity of the area where the recording head of the foregoing ink jet cartridge and the ink tank are coupled.

(3) a hydrophilic or water repellent treatment is given to the vicinity of the area where the recording head of the foregoing ink jet cartridge and the ink tank are coupled.

According to such an embodiment as this, it is possible to prevent ink leakage and ink splashing by providing the absorbent, groove, and hydrophilic and/or water repellent treatment. Thus, an ink jet recording apparatus can be provided so as to contribute to the enhancement of the reliability and safety of a finished product.

In another ink jet recording apparatus embodying the present invention in which recording is performed by ejecting ink onto a recording medium, such an ink jet recording apparatus is characterized in that there are provided a recording head to eject ink; an ink tank which contains ink to be supplied to the foregoing recording head and is detachable together with the foregoing recording head with respect to the foregoing ink jet recording apparatus, the ink tank being interrelatedly detachable with the foregoing recording head; detecting means to detect whether the ink tank is mounted in the ink jet recording apparatus or not; and controlling means to control the recording operation of the ink jet recording apparatus on the basis of the detected results of the aforesaid detecting means.

Also, it should more preferably be characterized that the aforesaid detection means serves dually as detecting means to detect the amount of ink in the aforesaid ink tank.

According to such an embodiment as this, it becomes possible to suppress any recording operation in the ink jet recording apparatus when the ink tank is not mounted; thus enabling the prevention of an exhaustion of ink or the like in the midway of recording operation.

Also, even when an empty ink tank is erroneously mounted for recording, such an operation can be prevented; thus making it possible to prevent air from being mixed into the recording head or ink leakage from the recording head.

DETAILED DESCRIPTION OF THE PREFERRED EMBODIMENTS

Hereinafter, with reference to the accompanying drawings, the description will be made in detail of the embodiments according to the present invention.

Figure 1:
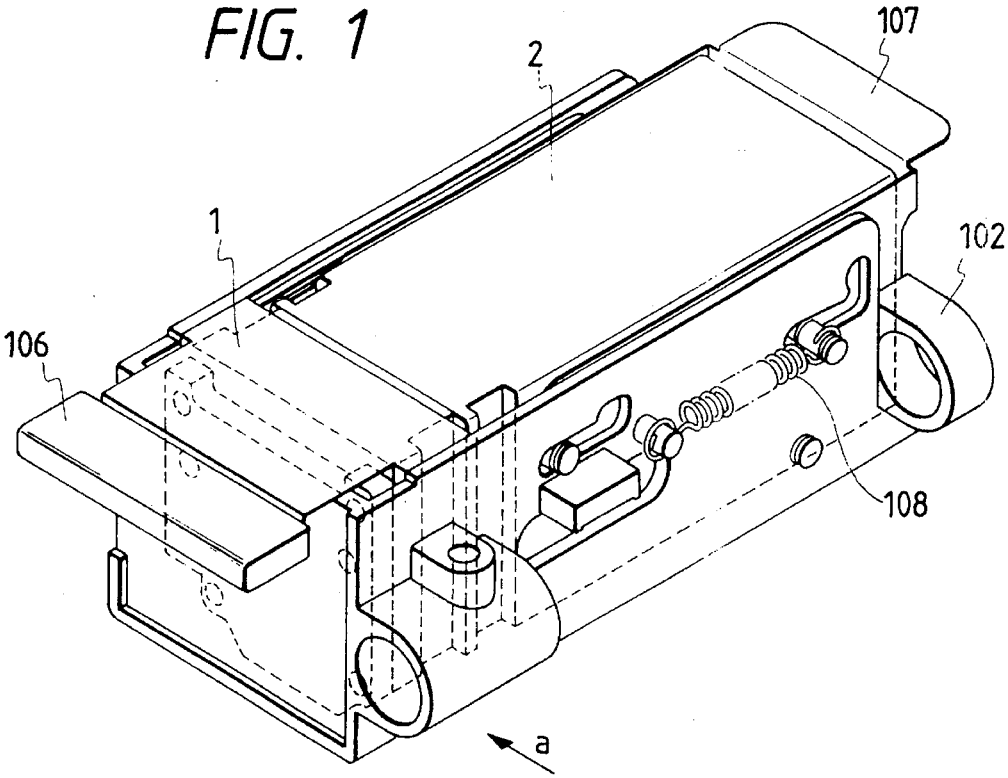
FIG. 1 is a perspective view schematically illustrating an embodiment of an ink jet recording apparatus according to the present invention.

FIG. 1 is a schematically perspective view illustrating the recording head unit and carrier unit of a recording apparatus embodying the present invention. In FIG. 1, a reference numeral 1 designates a recording head which ejects ink in accordance with electric signals; 2, an ink tank containing ink to supply it to the recording head 1; 102, a carrier provided for the recording apparatus body to hold the recording head 1 and ink tank 2; 106, a head lever to hold or release the recording head 1; 107, an ink tank lever to mount or demount the ink tank 2; and 108, a head fixing spring to fix the recording head 1 to the carrier 102. With these components, the recording head unit and carrier unit are constituted.

Figure 2:
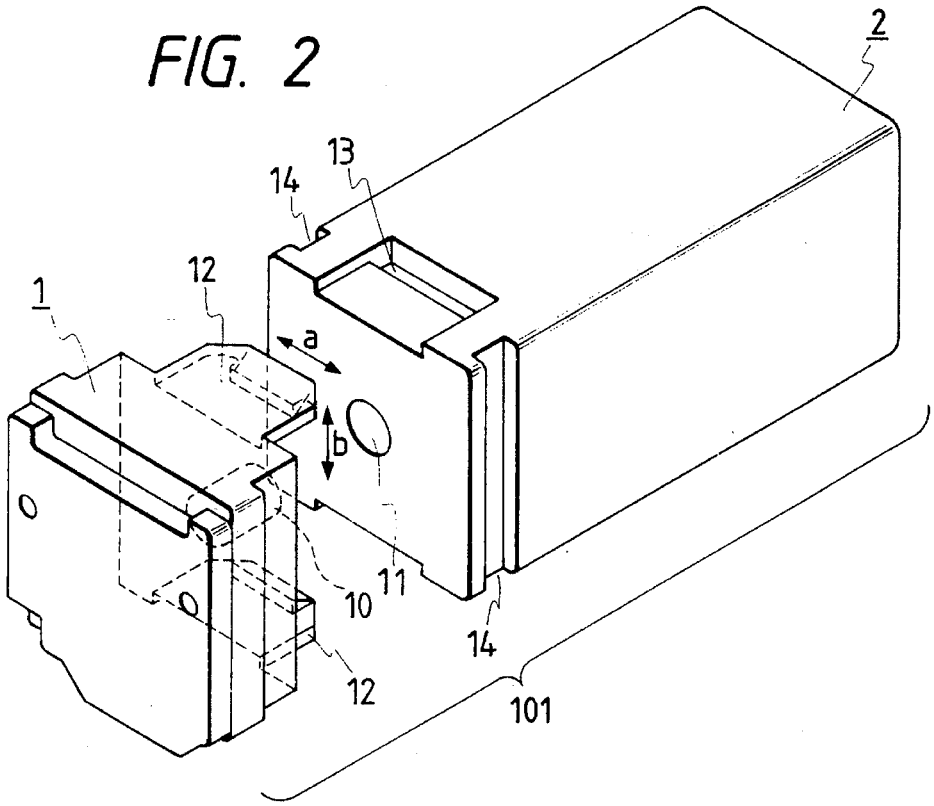
FIG. 2 is a schematic partial enlargement perspectively illustrating the embodiment.

FIG. 2 is a schematically perspective view illustrating the recording head 1 and ink tank 2 according to the embodiment of the present invention. In FIG. 2, a reference numeral 10 designates the ink supply inlet which serves as the ink passage for ink to be supplied from the ink tank 2 to the recording head 1; 11, an ink supply outlet to supply ink from the ink tank 2 to the recording head 1; 12, coupling nails or pawls to guide and hold the recording head 1 and ink tank 2 when integrally coupled; 13, coupling nail guiding grooves to engage with the coupling nails 12; and 14, ink tank holding grooves to hold the ink tank 2 when the ink tank 2 and recording head 1 are mounted or demounted. With these elements, a head cartridge 101 is constituted.

The recording head 1 comprises a substrate on which are formed a plurality of electrothermal transducers to generate thermal energy to be utilized for ejecting ink and a driving circuit to drive them; discharging ports and liquid passages corresponding to each of the above-mentioned plural electrothermal transducers; and further a ceiling board laminated thereon to constitute a common liquid chamber conductively connected to each of the liquid passages. Then, the recording head thus structured is mounted on the apparatus in such a manner that the discharging port surface having the discharging ports of the head are placed to face a recording medium.

The ink tank 2 is a tank which holds ink therein and supplies it to the recording head 1 appropriately in order to refill the ink which has been consumed by recording. If two single bodies constitute an ink tank, the ink supply outlet 11 is sealed by sealing means (not shown) to prevent any ink leakage therefrom. This sealing means is automatically or manually released when the ink tank is coupled to the recording head 1 to enable the ink supply. Also, it may be possible to arrange a mechanism so that air is introduced from the outside as the volume of ink is being reduced by the ink consumption. Further, it may be possible to provide a mechanism in the inside to keep a pressure exerted slightly negative on the ink to be supplied to the recording head for the purpose of improving the printing quality as well as preventing any ink leakage.

The recording head 1 and ink tank 2 are used for a recording apparatus in operation in a form of a cartridge 101 which is integrally fabricated with them. Now, the description will be made of the way in which to integrate them.

Figure 13:
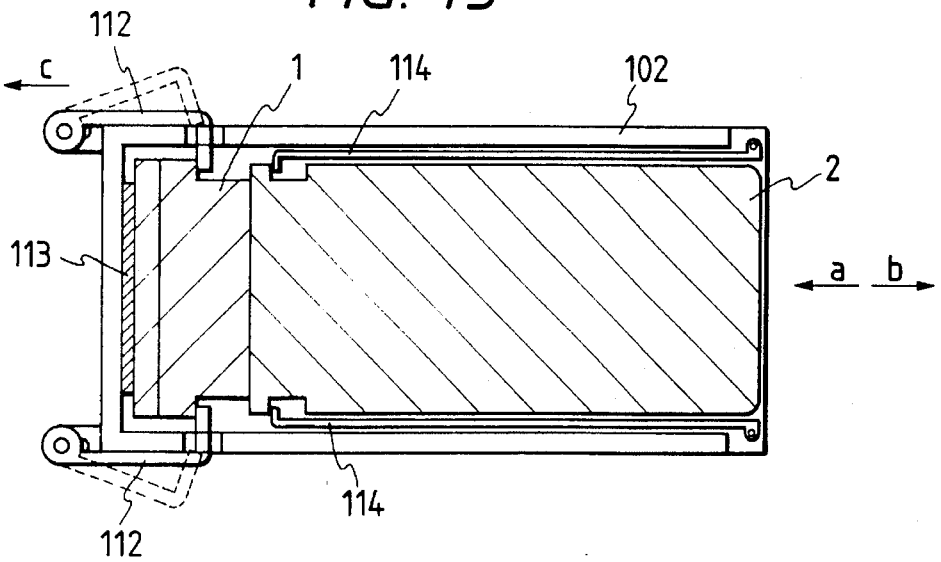
FIG. 13 is a schematic plan view illustrating another embodiment.

Fundamentally, the recording head 1 and ink tank 2 are integrated by coupling the ink supply inlet 10 and ink supply outlet 11. Therefore, this portion is carefully arranged to prevent ink leakage from or air intake into the ink passages. In the present embodiment, as shown in FIG. 13, a method is adopted to utilize the resiliency of a mold member for the purpose. In other words, the ink supply inlet hole 10*a* and the ink supply outlet hole 11*a* are formed cylindrically and then the inner diameter of the ink supply outlet 11*a* is slightly smaller than the outer diameter of the ink supply inlet hole 10*a*. Thus, when the ink supply inlet hole 10*a* is pressed into the ink supply outlet hole 11*a*, these two holes are tightly integrated while being slightly deformed in the radial direction. Also, the coupling portion is not necessarily of a mold member, but it will suffice only if the material has a sealing capability. The other coupling methods will be described later.

In the integration of the recording head 1 and ink tank 2, while it is good enough to couple the ink supply inlet 10 and ink supply outlet 11 as described above, the coupling is intensified in the present embodiment by providing the coupling nails 12 and coupling nail guiding grooves 13 in order to prevent them from being disengaged simply due to any unexpected force that may be exerted when the head cartridge 101 is handled or to facilitate the integration. In other words, the coupling nails 12 formed integrally with the ink supply inlet 10 by molding and capable of being resiliently deformed are provided with protrusions at the leading ends, and are fitted into the coupling nail guiding grooves 13 while being resiliently deformed by the portions corresponding to the height of the protrusions. The coupling is completed when the protrusions of the coupling nails 13 reach the deepest portions arranged in the rear sides of the coupling nail guiding grooves 13.

Further, the coupling nails 12 serve as guides so as to allow the ink supply inlet 10 and ink supply outlet 11 to be easily fitted when the recording head 1 and ink tank 2 are coupled. In other words, the coupling nails 12 are made longer than the ink supply inlet 10 so that the coupling nails 12 are to be in contact with the ink tank 2 before the ink supply inlet 10 reaches the ink supply outlet 11. Here, the leading ends of the coupling nails 12 are cut off diagonally. This diagonally cut off portion serves as its guide in the direction indicated by an arrow a in FIG. 2 to facilitate the engagement with the coupling nail guiding grooves. Also, the protrusions provided at the leading ends of the coupling nails 12 are also cut off diagonally to promote an easier engagement by serving as its guide in the direction indicated by an arrow b in FIG. 2.

In this respect, while the coupling nails are provided on the recording head side in the present embodiment, its position is not confined thereto. It may be possible to position them on the ink tank 2 side or on both sides of the recording head 1 and ink tank 2.

Now, the description will be made of the mechanical and electrical connections of the recording head 1 to the carrier 102.

Figure 3:
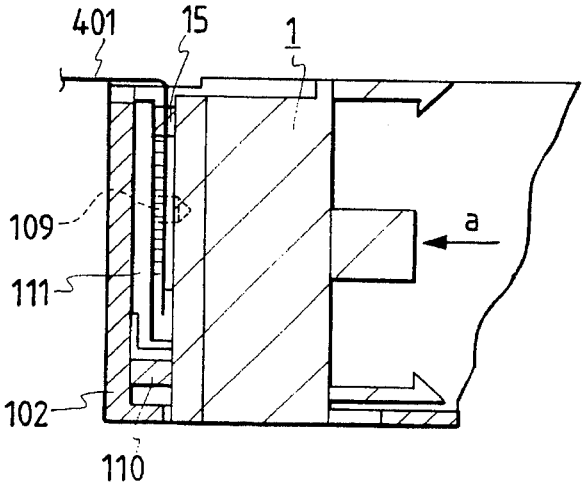
FIG. 3 is a cross-sectional view of a partial enlargement of the embodiment.

FIG. 3 is a cross-sectional view illustrating the portion where the carrier 102 is coupled to the recording head 1 viewed in the direction indicated by an arrow a in FIG. 1, in which a reference numeral 109 designates a positioning pin which is fitted into a hole provided for the recording head 1 fixed to the carrier 102 to set the position in the vertical direction in FIG. 3 and in the direction perpendicular to the plane thereof; 110, a stopper fixed to the carrier 102 to receive the recording head 1 which is pressed in the direction indicated by an arrow a in FIG. 3; 401, a flexible cable electrically connecting the recording apparatus body and the recording head 1; 111, a pad placed between the flexible cable 401 and the carrier 102 to support the flexible cable 401 resiliently; and 15, a contact provided for the recording head 1 and electrically connected to a heater unit in the recording head 1.

The recording head 1 is pressed in the direction indicated by an arrow a by means of the head fixing spring 108 through a lever which is not shown. Its position is unanimously fixed by the hole provided for the recording head 1, the positioning pin 109, and the intervention of the stopper 110. In this way, the recording head 1 and carrier 102 are mechanically coupled.

Also, there are arranged a plurality of electrically contacting points on the contact 15 of the recording head 1 and the end of the flexible cable 401 in the positions opposite to each other. By pressing them with a given pressure, the recording apparatus body and the recording head 1 are electrically connected. At this juncture, the plural electrically contacting points must be in contact under compression. To this end, the pad 111 made of a resilient material is inserted in the compressing portion so as to press those contacting points evenly. The material of the pad 111 is silicon rubber, for example, and it is arranged that the reaction force exerted thereby when depressed is made much smaller than the force exerted by the head fixing spring 108 which presses the recording head 1.

Particularly, the electrical contact provided for the flexible cable 401 may be extruded when configured in order to cause the reaction force to be concentrated when depressed so that the connection is made reliably.

In this respect, the electrical or mechanical connections are arranged on the recording head side in the present embodiment, but irrespective of this arrangement, the connections may be arranged on the ink tank 2 side or on both sides of the recording head 1 and ink tank 2. Also, it may be possible to arrange the electrical connections and the mechanical connections separately on either side, respectively.

Now, the description will be made of the handling of the recording head 1 and ink tank 2, that is, the method to replace an exhausted ink tank 2 with a new ink tank 2 or to replace the recording head 1 which is disabled to be used any more due to some causes.

As a first mode, the fixation between the recording head 1 and carrier 102 is released. From the carrier 102, the recording head 1 and ink tank 2 are removed as they are still in a coupled state. Then, in a state where they are detached from the carrier 102 (hereinafter referred to as off carrier condition), the recording head 1 and ink tank 2 are separated or coupled.

Figure 4:
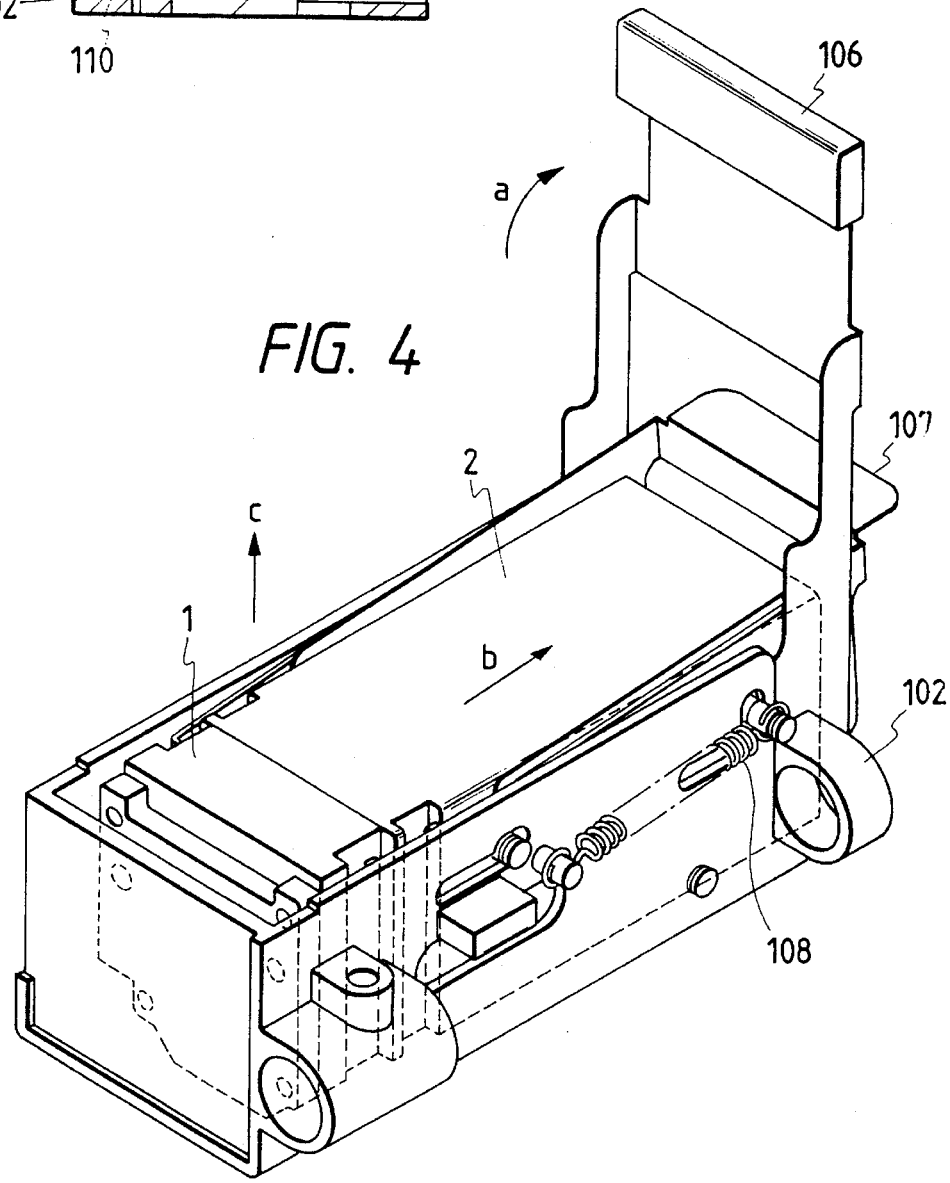
FIG. 4 is a perspective view schematically illustrating a first mode of an exchangeable type according to the embodiment.

FIG. 4 is a schematically perspective view illustrating the state where the recording head 1 and ink tank 2 are removed from the carrier 102 as they are still in a coupled condition. In this case, the head lever 106 is pulled up from the state as shown in FIG. 1 to the position shown in FIG. 4 rotatively in the direction indicated by an arrow a. Thus, the pressure exerted to the recording head 1 by the head fixing spring 108 is released. At this juncture, the recording head 1 and ink tank 2 are shifted in the direction indicated by an arrow b as they are still in a coupled condition by a lever (not shown) arranged in the carrier 102. This causes the engagement between the positioning pin 109 and the hole of the recording head 1 to be disengaged; hence enabling the recording head 1 and ink tank 2 to be shifted in the direction indicated by an arrow c in FIG. 4 as they are still in a coupled state, and to be in the off carrier condition. In the off carrier condition, a force is given in a direction opposite to the direction in which the recording head 1 and ink tank 2 are coupled to separate them and replace the one which requires the replacement. Then, by the coupling method described earlier, both of them are integrated and mounted in the carrier 102 in the reversed order to terminate the replacement operation.

In this respect, the head lever 106 is used to release the pressure exerted on the recording head 1 in the present embodiment, but irrespective of this method, it may be possible to make an arrangement so that the lever which presses the recording head 1 can be shifted directly. Also, irrespective of the method wherein the head fixing spring 108 is used to press the recording head for its fixation, it may be possible to use a latch hook or the like having a spring capability for the head fixation.

Furthermore, it may be possible to mount or demount the recording head 1 and ink tank 2 in the coupled state by holding the recording head 1 directly against the pressure exerted by such a pressing means.

When the first mode is adopted, the following effects are obtainable:

When either one of the recording head and ink tank must be replaced, it is possible to replace only the one which needs the replacement. Therefore, the operational economy is improved.

Also, the recording head 1 and ink tank 2 can be replaced as they are in the coupled condition. The recording heads and ink tanks having different colors can be retained as they are in the off carrier condition. Therefore, it becomes simple to change recording colors.

As a second mode, the recording head 1 and ink tank 2 are separated on the carrier 102 while the recording head 1 and carrier are still fixed (hereinafter referred to as on carrier condition).

Figure 5:
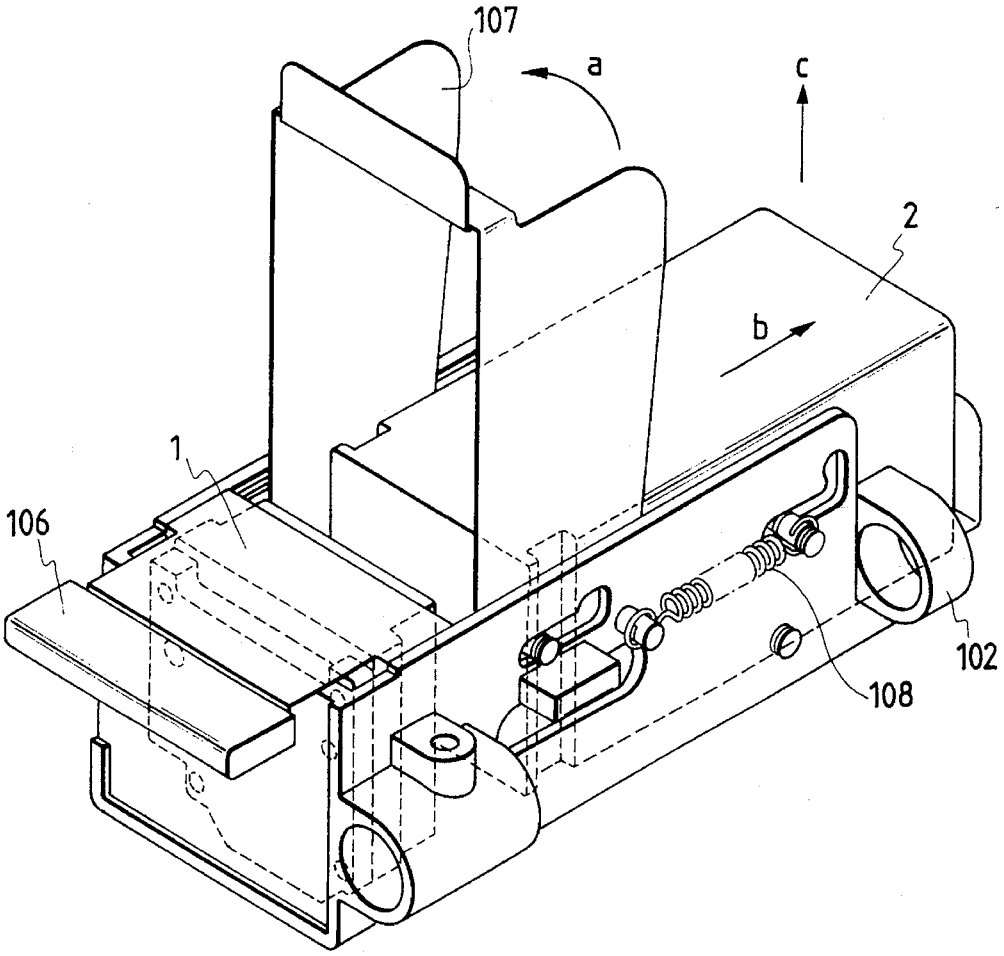
FIG. 5 is a perspective view schematically illustrating a second mode of an exchangeable type according to the embodiment.

FIG. 5 is a schematically perspective view illustrating the state where the ink tank 2 is separated from the recording head 1 on the carrier 102. In this case, by pulling up the tank lever 107 from the state shown in FIG. 1 to the position shown in FIG. 5 rotatively in the direction indicated by an arrow a, a lever (not shown) arranged in the carrier 102 engages with the ink tank guide groove 14 which is provided on the side of the ink tank 2 and is shifted in the direction indicated by an arrow b in FIG. 5. At this juncture, the fixation of the recording head 1 is in the same state as FIG. 1, and it is not shifted together with the ink tank 2. Accordingly, the engagement between the recording head 1 and ink tank 2 are disengaged; thus enabling them to be separated. Further, by allowing the ink tank 2 to be shifted in the direction indicated by an arrow c in FIG. 5, it can be removed from the carrier 102.

Figure 6:
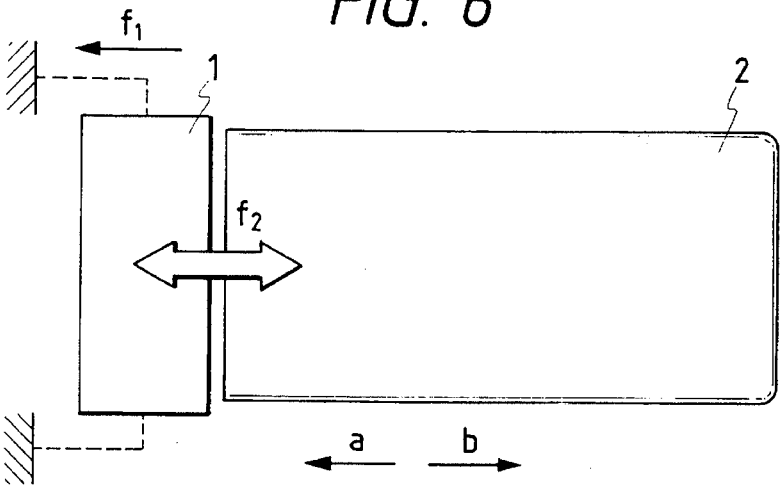
FIG. 6 is a schematic plan view illustrating the way in which pressure is exerted by the embodiment.

In this respect, if the recording head 1 is resiliently pressed by the head fixing spring 108 as in the present embodiment, there is a possibility that the head fixation is released depending on the way the separating force is exerted. It is preferable to arrange the structure as follows:

FIG. 6 is a schematic plan view showing the way in which such a force is exerted. In FIG. 6, the recording head 1 is pressed by a force f1 exerted by the head fixing spring 108 to the carrier 102. Also, it is assumed that a force f2 is needed to disengage the coupling nails 12 and the ink supply inlet 10 in order to separate the recording head 1 and ink tank 2. In this case, it is possible to prevent the fixation of the recording head 1 to be released in the separating operation by defining the strengths of the forces as $f1>f2$.

Here, in the present embodiment, the separation is executed by exerting a force equivalent to the force f2 using a tank lever 107, but irrespective of this method, it may be possible to arrange the structure so that the ink tank 2 is pulled up in the direction indicated by an arrow b in FIG. 5 by holding it directly to separate the recording head 1 and ink tank 2.

When the second mode is adopted, there are the following effects in addition to those obtainable in the first mode:

It is possible to control the speed with which the ink tank is pulled out when it is separated by designing the cam configuration of the tank lever 107; thus enabling the prevention of the ink scattering from the ink supply inlet 10 and ink supply outlet 11.

Also, there is no need for holding the recording head 1 by hand directly. Accordingly, there is no possibility that a hand touches the vicinity of the ink ejection nozzles of the recording head 1. Hence, it is possible to prevent any unwanted contamination which may produce adverse effects on printing.

Also, the portion where the force exerted by the ink tank 2 can be specified. Therefore, it will suffice only if such a portion is reinforced. All the other portions can be structured thin to make the ink tank lighter with a more ink containing capability among other effects.

Subsequently, the description will be made of the structure and operation of a recording apparatus wherein the above-mentioned recording head 1, ink tank 2, and carrier 102 are mounted.

Figure 7:
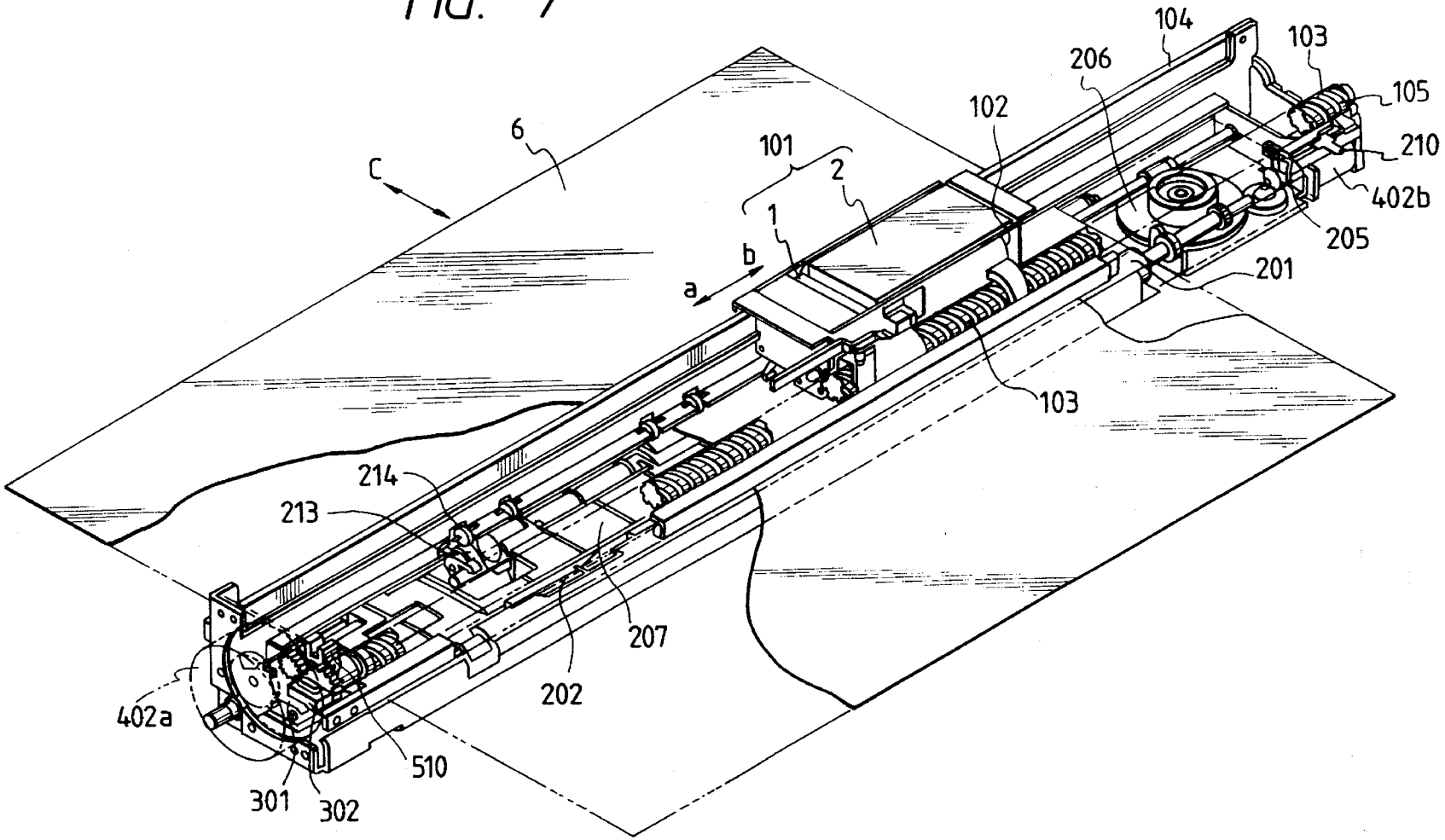
FIG. 7 is a perspective view schematically illustrating the entire body of a recording apparatus for an ink jet recording apparatus embodying the present invention.

FIG. 7 is a schematically perspective view illustrating the outline of a recording apparatus embodying the present invention.

A carrier 102 with a head cartridge 101 being mounted has a pin (not shown) to be engaged with the spiral groove 105 of a lead screw 103 which is interrelated with the normal and reverse rotations of a carrier motor 402*a* and rotated through a transmission mechanism (not shown). Thus, the carrier is reciprocated in the directions indicated by arrows a and b following the rotation of the lead screw 103. Here, a reference numeral 104 designates a slide shaft to regulate the rotation of the carrier. Also, with a carrier sensor 510, the carrier 102 establishes the position (home position) in the directions indicated by arrows a and b. A reference numeral 301 designates a recovery unit which comprises a cap 302 facing the discharging surface of the head cartridge 101 at a given position (a home position, for example) outside the recording area for the head cartridge 101, and a cap advance and retraction driver (not shown) to keep the cap in contact with the discharging surface to protect it when at rest or the like occasions. Also, it is possible to arrange a pump to suck overly viscous ink, dust particles, and air bubbles from the discharging ports when the cap is in contact with the discharging surface in order to maintain the ink ejection conditions desirably, and a member to contain such an unwanted ink thus sucked.

Furthermore, a wiper (not shown) is provided to clean the vicinity of the discharging ports of the head cartridge 101.

A reference numeral 201 designates a feed roller to feed a recording medium 6 in the directions indicated by an arrow c in FIG. 7 and 202, a pinch roller to press the recording medium 6 against the feed roller 201. The recording medium 6 is fed intermittently in the directions indicated by an arrow c in FIG. 7 while being pinched by a pair of these rollers. The feed roller 201 is coupled to a feeding motor 402*b* through a transmission mechanism formed by a feed roller gear 205 and feed roller idler gear 206 so as to receive the transmission of the driving force. Also, pinch roller 202 is capable of being in contact with or apart from the feed roller 201 by the operation of a release lever 210.

A reference numeral 207 designates a platen to regulate the recording surface of the recording medium 6 to keep it flat. Also, it may be possible to provide a member to prevent the recording medium 6 from being raised by pressing it against the platen 207.

A reference numeral 213 designates a discharge roller which rotates in synchronism with the feed roller 201 to deliver the recording medium 6 after recording in the directions indicated by an arrow c in FIG. 7. There is provided a spur roller 214 at a position opposite to the discharge roller 213 through the recording medium 6. With those rollers, the recording medium 6 is delivered outside the printer after the recording is over.

Figure 8:
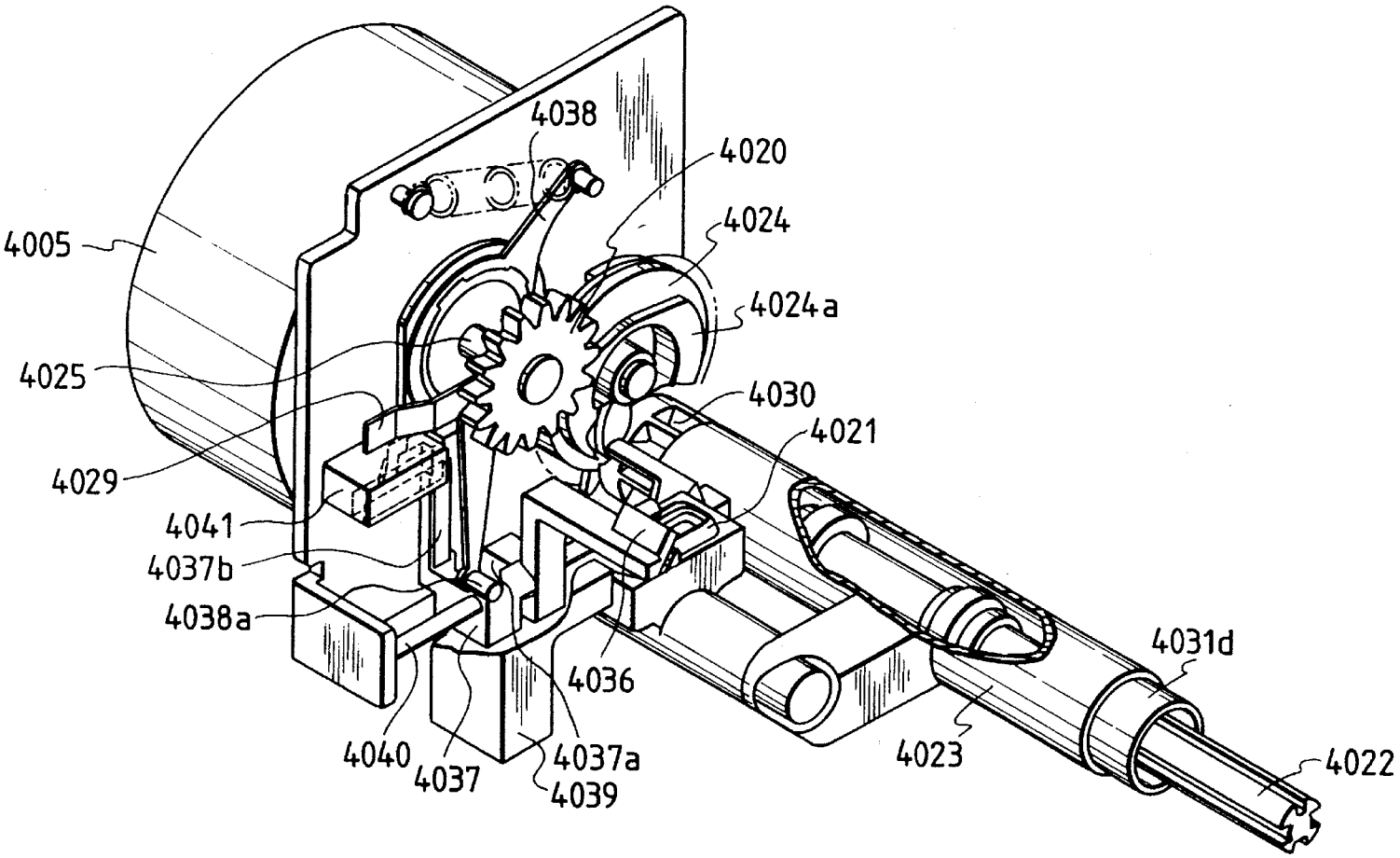
FIG. 8 is a cross-sectional view showing an exchangeable ink tank according to the embodiment.

As shown in FIG. 8, the recovery unit comprises a cap 4021 to cap the discharging surface 4002*c* of the recording head 4002*a*; a pump unit 4023 which makes the inside of the cap negatively pressurized to suck from the cap 4021 the waste ink forcibly exhausted from the discharging surface 4002*c* and forward it to a waste ink tube 4031*d*; and a transmission mechanism (timing gear) 4024 consisting of a known cam and gear mechanism to transmit driving forces to the foregoing cap 4021 for its forward and backward movement with respect to the discharging surface 4002*c* as well as for the driving of the foregoing pump unit 4023. To the aforesaid timing gear 4024, the rotational driving force of the carrier motor is transmitted through a carrier motor pinion 4020.

Figure 9:
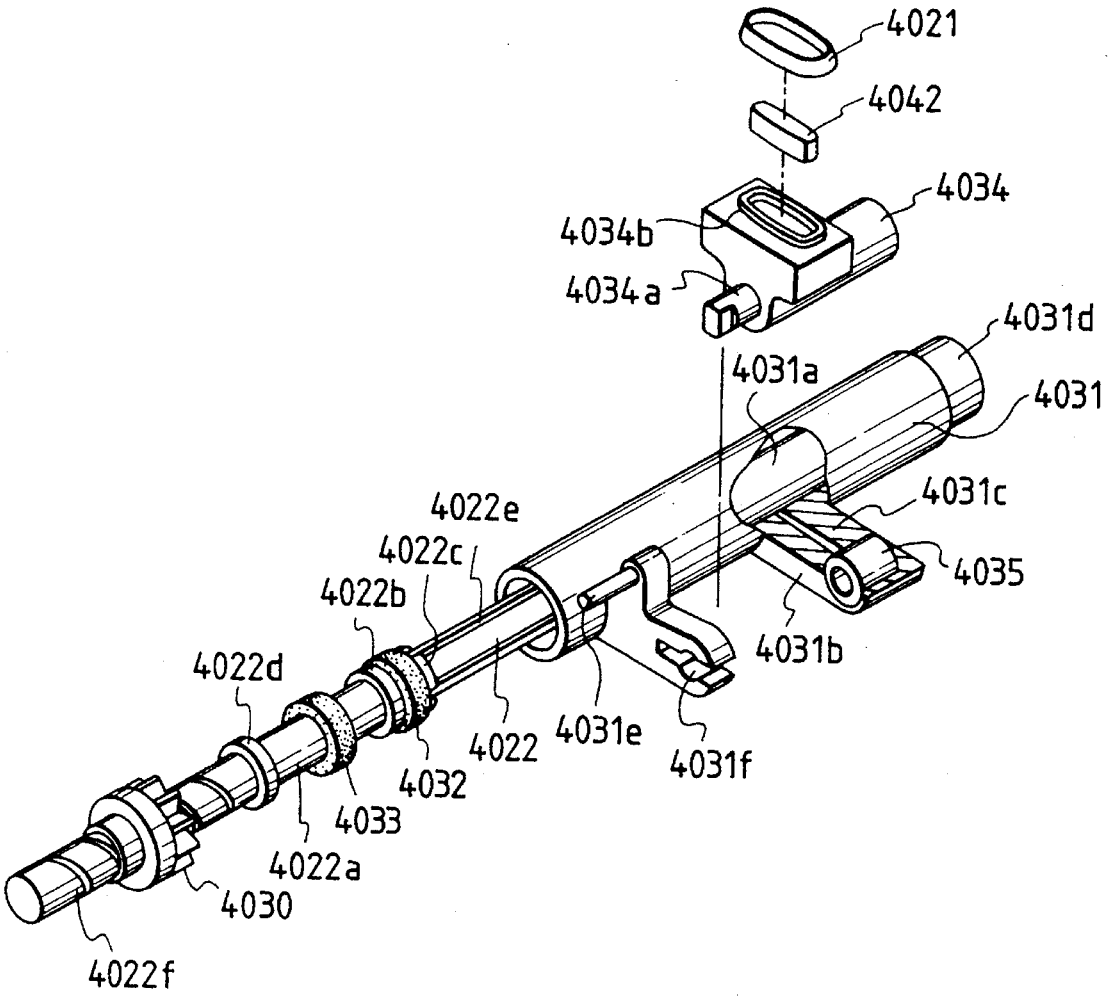
FIG. 9 is a perspective view illustrating an example of an ink jet recording apparatus to which the present invention is applicable.

Also, the pump unit 4023 comprises a plunger pump shown in FIG. 9, in which a reference numeral 4031 designates a cylinder having a cylindrical cylinder portion 4031*a* and a guide member (not shown) which guides a plunger 4022 which will be described later. Then, it is partially cut off in the axial direction to provide an ink passage; 4031*b*, a cap lever receptacle formed to allow the lever seal which will be described later to be inserted. Also, a reference numeral 4031*c* designates an ink suction inlet which is opened to a given position; 4031*d*, a waste ink tube the integrally formed leading end of which is inserted into a waste ink absorbent 4028; also, 4031*e*, a cap open and close protrusion which is pressed by the cap open and close cam 4024*a* of the timing gear 4024 to cause the cylinder 4031 to rotate to open and close the cap 4021.

A reference numeral 4022 designates a plunger comprising a operation shaft 4022*a*, a piston stopper 4022*b*, a piston receptacle 4022*c*, and a pump seal stopper 4022*d*. Then, a groove 4022*e* which serves as an ink passage is continuously formed on the aforesaid operation shaft 4022*a*. This groove is partially inserted into the aforesaid guide of the cylinder 4031 to hold the rotation of the plunger 4022. On the operation shaft 4022*a*, a lead groove 4022*f* is formed to control the reciprocation of the plunger 4022. The protrusion (not shown) of a stroke gear 4005 is inserted into this lead groove 4022*b*. Then, by the normal and reverse rotations of the stroke gear 4005, a desired stroking amount is given to the plunger 4022 to generate the negative pressure.

A reference numeral 4032 designates a piston made of a rubber material such as NBR. Its outer diameter is made larger than the inner diameter of the cylinder 4031 by a given amount, and it is appropriately compressed when inserted into the foregoing cylinder 4031; 4033, a pump seal made of a rubber material such as silicon rubber or NBR, which is inserted into the cylinder 4031. Its inner diameter is made slightly smaller to obtain a given pressure with respect to the plunger 4022 and, further, it can reciprocate in the cylinder 4031 by being pressed by the pump seal stopper 4022*d* of the plunger 4022 and the piston receptacle 4022*c*. Also, it may be possible to reduce the sliding friction between the cylinder 4031 and plunger 4022 by applying lubricant to the surface of the pump seal.

A reference numeral 4034 designates a cap lever. An ink guide (not shown) biases the cap lever seal which will be described later. The other rotational shaft 4034*a* is rotatively mounted to the hole 4031*f* of the cylinder 4031 by snap fitting, and 4035, a cap lever seal to which the ink guide of the aforesaid cap lever 4034 is inserted by compression. It is further inserted into the cap lever receptacle 4031*b* of the cylinder 4031.

A reference numeral 4021 designates a cap made of an annular chlorinated butyl rubber or some other resilient material having a triangular cross-section, and is mounted on the cap mounting unit 4034*b* of the foregoing cap lever 4034; also, 4042, a preliminary discharging pad which is made of a polymeric absorbent as the foregoing blade cleaner 4039. It is mounted on the foregoing cap lever 4034. The aforesaid preliminary discharging pad is an absorbent to absorb the ink preliminarily ejected aside from the ordinary ink ejection for a printing operation. This preliminary ink ejection is conducted to prevent ink on the discharging surface 4002*c* from being dried in the printing operation.

Subsequently, the description will be made of an information processing apparatus in which a recording apparatus embodying the present invention is incorporated. Its structure and electrical circuitry will be described.

Figure 10A:
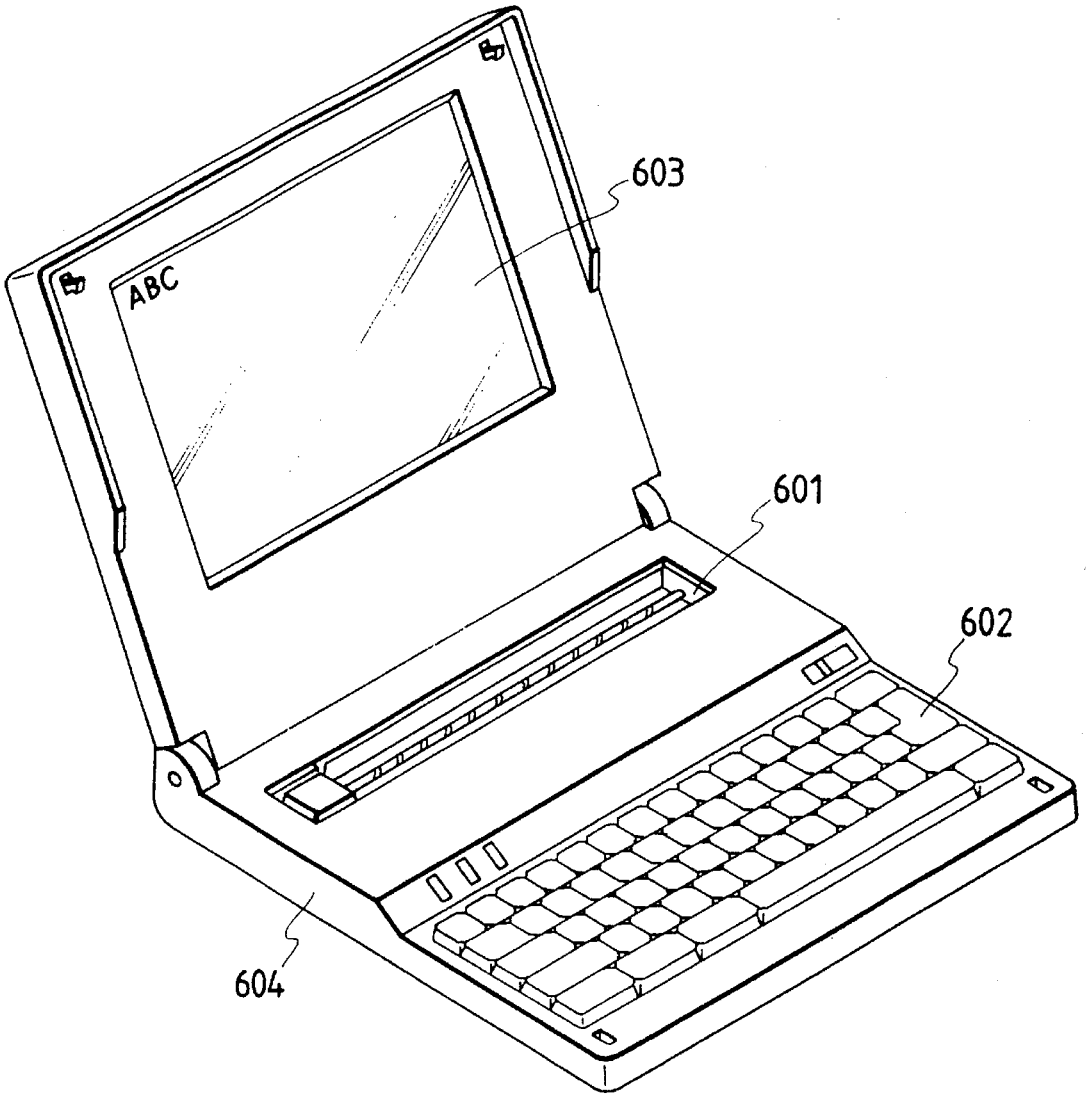
FIGS. 10A and 10B are schematic perspective views illustrating an information processing apparatus using an ink jet recording apparatus according to the present invention.

FIG. 10A is a schematically perspective view illustrating the outer appearance of an information processing apparatus 604 wherein a recording apparatus embodying the present invention is incorporated.

Figure 10B:
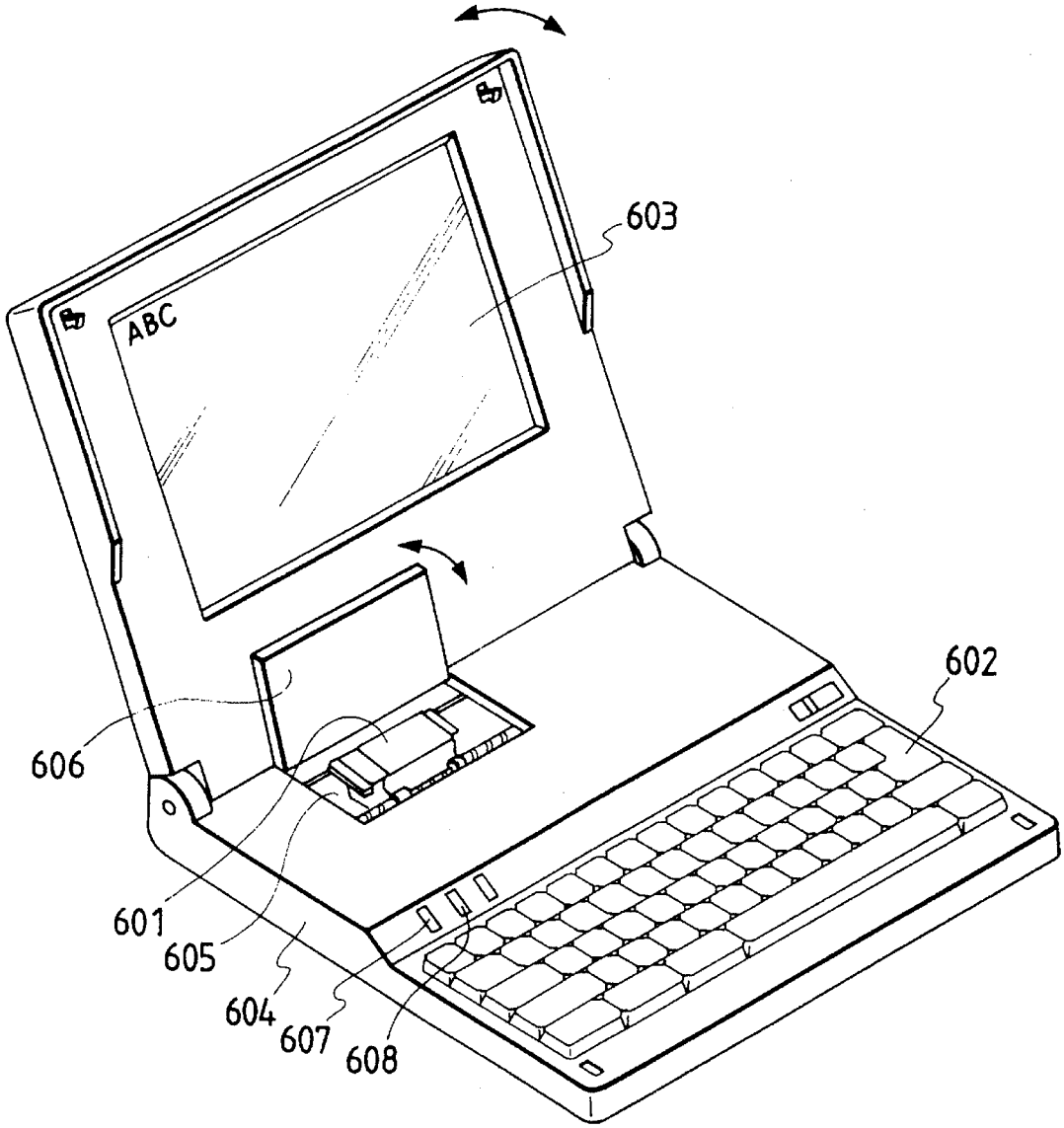

In FIG. 10A, a reference numeral 601 designates the above-mentioned printing unit; 602, a key board provided with keys to input letters, numerals, and other characters as well as keys to give various instructions; and 603, an indication unit provided with a display. FIG. 10B is a schematically perspective view illustrating the outer appearance of an information processing apparatus 604 wherein a recording apparatus embodying the present invention is incorporated. In FIG. 10B, a reference numeral 605 designates a window provided for replacing the foregoing recording head 1 and ink tank 2; 606, a cover for the window 605 to cover it except when the replacement operation is executed. The window 605 is made large enough to provide a head lever 601 and tank lever 605 to be operated when the recording head 1 or ink tank 2 is replaced. A reference numeral 607 designates a change over switch for the intended replacement of the recording head 1 or ink tank 2. When the change over switch 607 is turned on, a carrier motor 402*a* is driven to shift the carrier 102 to the window position 605 from the foregoing home position or the recording area. In this position, when the replacement of the recording head 1 or ink tank 2 is completed, the carrier 102 is shifted to its home position when a release switch 608 is turned on and then a recovery unit 301 is actuated to execute the ink suction and ejection, or wiping and other recovery operations. Thus, the current status returns to the operation before the change over switch 607 is turned on. Now, FIG. 11 is a block diagram showing the structure of electric circuits for an information processing apparatus according to the present embodiment.

Figure 11:
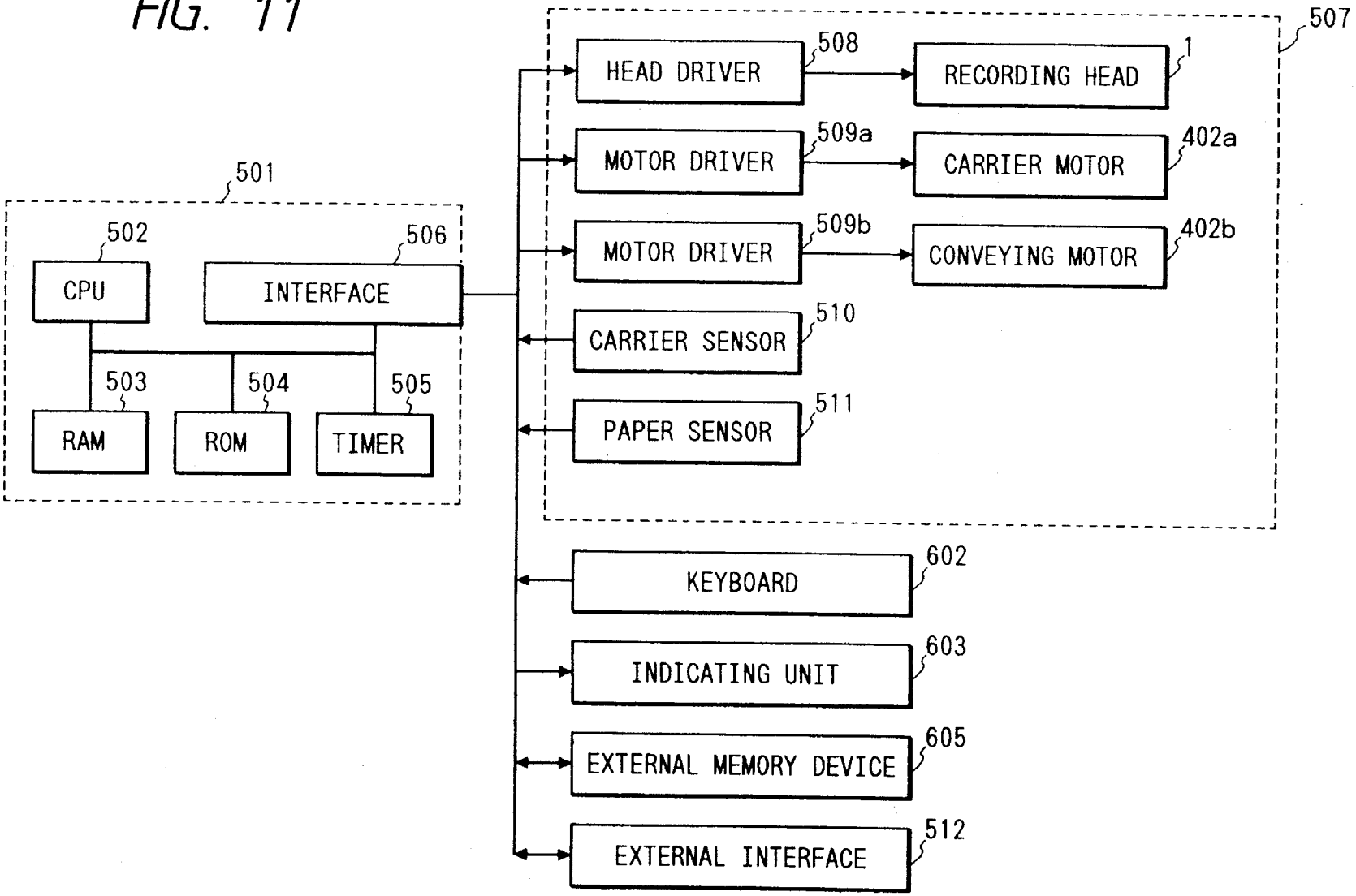
FIG. 11 is an electrical circuit diagram showing an information processing apparatus using an ink jet recording apparatus according to the present invention.

In FIG. 11, a reference numeral 501 designates a controller to execute main controlling; 502, a CPU for a microcomputer mode to execute certain procedures, for example; 503, RAM for providing development and work areas for text data and image data; 504, ROM for storing programs corresponding to the aforesaid procedures; 505, a timer for the CPU 502 to work out execution cycles and for the printing unit 601 to work out the timing required when a recording operation is executed; and 506, an interface unit to connect signals from the CPU 502 to the peripheral apparatuses.

Also, a reference numeral 507 designates a controller for the printing unit 601; 508, a head driver to transmit recording signals and electric power to the head cartridge 101; 509*a* and 509*b*, motor drivers to transmit signals and electric power required to drive a carrier motor 402*a* and feed motor 402*b*, respectively; 510, a carrier sensor to detect the current position of the carrier 102 and determine whether the carrier 102 is currently at its home position or not, for example; and 511, a paper sensor to detect the presence of a recording medium 6 in order not to perform recording on any places other than the recording medium 6 when the recording medium 6 is yet to be inserted or a recording is terminated up to the end of a page.

Moreover, a reference numeral 605 designates an external storage such as FDD, HDD, or RAM card, and 512, an external interface to communicate with other information processing apparatuses, or to control peripheral apparatuses by making connection with inner buses.

In this respect, although not included in the block diagram shown in FIG. 11, an electric power source is provided to supply current to the above-mentioned electric circuits. For such an electric power source, there is available a rechargeable battery, disposable dry cells, or AC power converter when the information processing apparatus body is fixed for use, for example.

Figure 12:
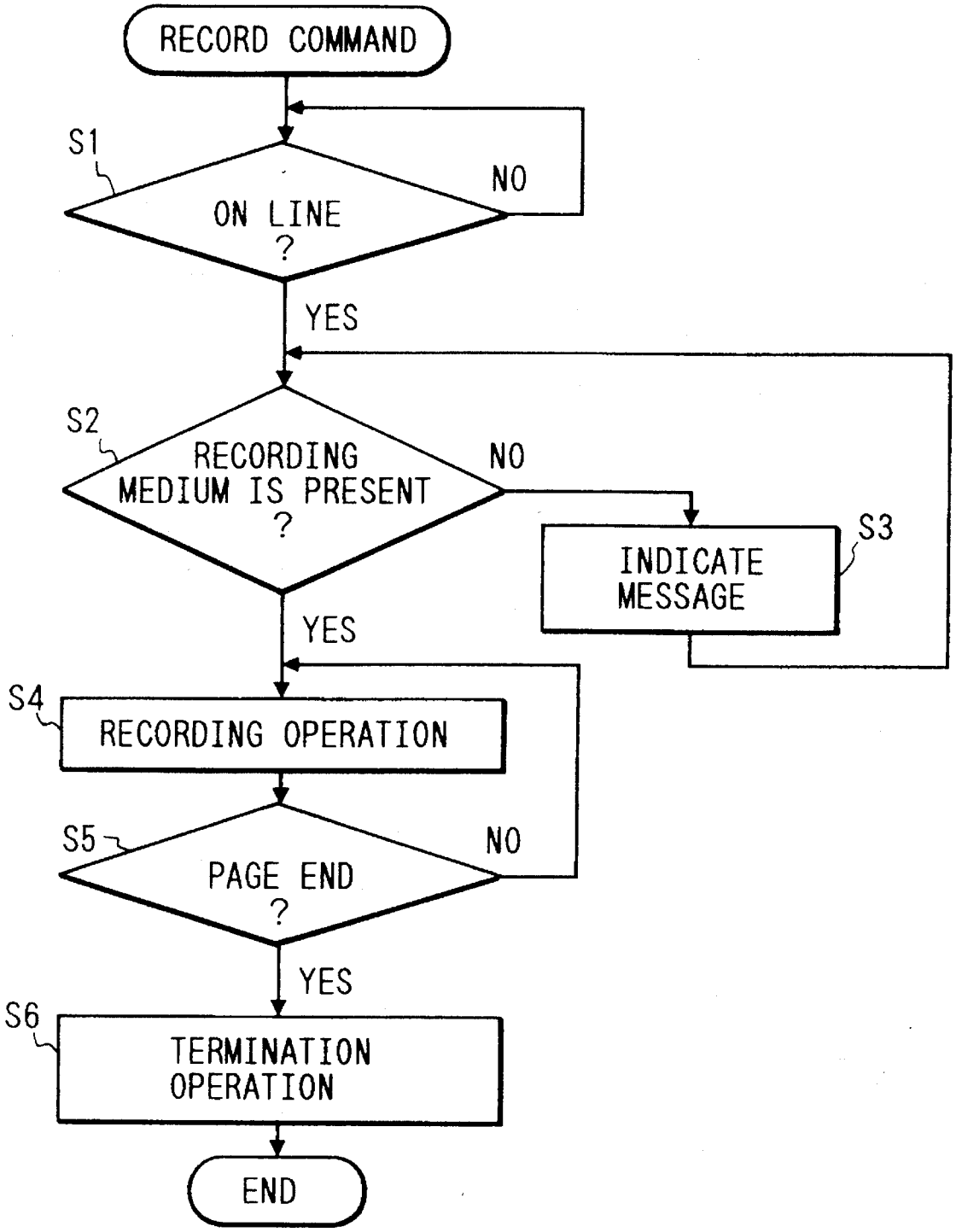
FIG. 12 is a flowchart showing the recording operation according to the embodiment.

With the above-mentioned structure of electric circuits, recordings are performed on the recording medium 6 by the recording unit. Now, using a flowchart shown in FIG. 12, the recording operation control sequence will be described briefly.

With an instruction to start recording by the use of the recording instruction key on an indication operation unit of a printer body or by an external instruction to start recording through the external interface, a series of procedures are started as follows:

At first, in step S1, whether the indication operation unit is in the on line status or not is determined. This is a precaution not to start any recording operation without a required preparation on the printer side when an external instruction to start recording operation is transmitted mainly by communications. Here, if the indication operation unit is determined to be in the on line status, the procedure will proceed to step S2.

In the step S2, whether the recording medium 6 is set on the printing unit or not is determined in accordance with signals from the paper sensor 511 and others. This is a precaution not to start printing because if any printing is started without a recording medium, ink is scattered in the printer to stain the apparatus itself particularly when an ink jet printer or the like is used as a recording apparatus, or the ink is wastefully consumed.

Furthermore, in the step S2, it may be possible to determine whether the pinch roller 202 and feed roller 201 are released or not in addition to the detection of the presence of the recording medium. This is required to prevent any irregular feeding of the recording medium because when the pinch roller 202 is released, the normal feed is impossible even if the recording medium 210 is set. Whether the pinch roller 202 is released or not can be detected by means of a mechanical switch provided for the release lever or the like.

Here, if it is found that the recording medium is not normally set, the procedure will proceed to the next step 3.

In the step S3, a message is emitted to call the attention of an operator to set the recording medium. Such a message can be emitted by illuminating light in the indication operation unit or make a buzzer sound.

Also, in the step S3, if the recording medium 6 is found to have been set, the procedure will proceed to step S4.

In the step, the recording is started. With the instruction from the CPU 502, the head driver 508 drives the head cartridge 101. Also, in synchronism therewith, the motor drivers 509*a* and 509*b* drive the carrier motor 402*a* and feed motor 402*b*, respectively, to perform the recording while allowing the carrier 102 to be shifted in the main scanning direction, the recording medium to be shifted in the sub-scanning direction, and the recording head 1 to be cleaned among others.

Lastly, in step S5, if an instruction to terminate the recording operation is given by the corresponding signal from the CPU 502, for example, or if it is determined that any more recording is possible when the number of recording lines in a page in a given sub-scanning direction has been reached or the terminating end of the recording area in a recording medium 6 is detected by the paper sensor 511, it is judged that the recording operation is terminated and that the recording operation procedures are completed.

In step S6, then, the carrier 102 is returned to its home position as a procedure to terminate the recording operation. This is carried out to cap the ink discharging surface of the recording head 1 for its protection in preparation for the power turn off after the termination of the recording operation. Then, for example, the feed motor 402*b* is driven for a given amount or the feed motor 402*b* is driven until the paper sensor 510 detects and verifies that the recording medium 6 has been discharged. In this way, the recording medium is discharged. After that, the CPU 502 instructs the indication operation unit to display the termination of the recording operation or informs the peripheral apparatuses accordingly through the external interface; hence terminating the recording operation completely.

As described above, the recording head and ink tank are separable as in the present embodiment, and then, by arranging the structure of the ink jet recording apparatus such as to conduct the separating or integrating operation either in the on carrier condition or off carrier condition, the following effects can be obtained:

Since the ink tank is mounted on the carrier, any ink supply tube and the like are no longer needed. Thus, it is possible to fabricate the apparatus smaller.

Also, when ink is totally consumed, it will suffice only if the ink tank is replaced, not the cartridge which is integrated with the head. Therefore, it is possible to reduce the running cost significantly.

Also, if either one of the recording head and ink tank needs to be replaced, it is possible to replace only the one which must be replaced. Thus, the operational economy is improved.

Also, when the recording head and ink tank are separated on the carrier by the use of a lever or the like, it is possible to control the speed with which the separation is carried out; thus preventing ink to be scattered from the ink supply inlet 10 and ink supply outlet 11.

Also, when the recording head and ink tank are separated on the carrier, there is no need for holding the recording head by hand directly. Accordingly, there is no possibility that a hand touches the vicinity of nozzles of the recording head 1. It is thus possible to prevent any unwanted contamination that may produce adverse effects on printing.

Also, when the recording head and ink tank are separated on the carrier, the portion where force is exerted by the ink tank 2 can be specified. Therefore, the structure can be arranged so that it is made strong enough only at such specific portion. Consequently, any other portions than this can be fabricated thin; thus enabling the tank to be made light in its weight while increasing its volume. Also, if ink colors should be replaced, the recording heads and ink tanks can be replaced as they are still in the coupled state. There is no possibility that ink colors are mixed. The replacement can also be carried out simply.

FIG. 13 is a plan view schematically showing another embodiment according to the present invention.

FIG. 13 is a plan view corresponding to the view of the foregoing embodiment shown in FIG. 1 observed from the above, in which a reference numeral 112 designates a head clamp lever to fix the recording head 1 to the carrier 102; 113, a head contact to connect the head electrically; and 114, an ink tank pressure lever which is interrelated with an ink tank lever 107 to execute the integration and separation of the ink tank 2. The head unit and carrier unit of the ink jet recording apparatus comprise each of these elements.

In the foregoing embodiment, the recording head 1 is pressed to the stopper 110 in the direction indicated by an arrow a in FIG. 6 to couple the recording head 1 and carrier 102 mechanically with the pressure exerted by the head fixing spring 108. The method for fixing the recording head is not confined thereto. It may be possible to adopt a method given below.

In other words, the head clamp lever 112 is structured with a rigid material to be able to rotate and move in parallel, not with a resilient material to press the object. Here, the description will be made of a method for fixing the recording head to the carrier 102. At first, the head clamp 112 is retracted to the position which is indicated by a broken line. Then, the recording head 1 itself or the recording head 1 and ink tank 2 which are in the integrated state are inserted in the direction indicated by an arrow a in FIG. 13 and shifted from such a state shown until the leading end of the recording head 1 is butted to the head contact 113. From this state, the head clamp lever 112 is shifted in the direction indicated by an arrow c in FIG. 13 while being rotated to arrive at the position which is indicated by a solid line and is fixed as it is.

In the head contact 113, a resilient pad 111 is pinched as described in conjunction with the foregoing embodiment. Therefore, the recording head 1 is pressed back in the direction indicated by an arrow b in FIG. 13, but due to the presence of the head clamp lever 112, it cannot be shifted but fixed there. At this juncture, by the force exerted to press it back, the contact pressure of the hear contact 113 is secured. Also, the separation of the recording head 1 and carrier 102 can be performed in the operation contrary to the above, and withdrawn by shifting them in the direction indicated by an arrow b in FIG. 13.

In this respect, for the separation of the ink tank 2, the ink tank lever 107 (not shown) is operated to cause the ink tank pressure lever 114 to be shifted in the direction indicated by an arrow b in FIG. 13. With the above-mentioned structure, the following effects can be obtained:

When the separating operation for the ink tank 2 is executed in the on carrier condition, the force exerted on the recording head 1 is received by the head clamp level 112.

Therefore, the recording head 1 is not shifted; obtaining an enhanced reliability.

Also, when only the ink tank 2 is separated in the on carrier condition, or the recording head 1 and ink tank 2 are separated from the carrier 102 still in the coupled state, the shifting direction is as indicated by an arrow b in FIG. 13. Accordingly, the operativity is improved.

Figure 14:
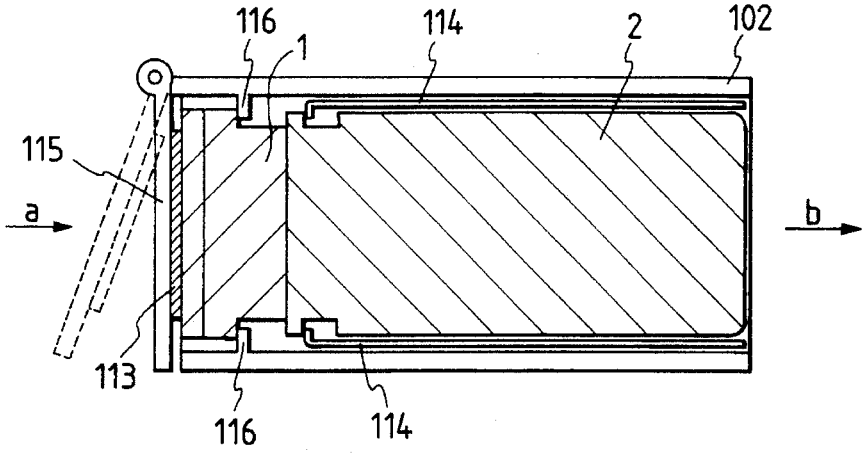
FIG. 14 is a schematic plan view illustrating a second type according to another embodiment.

FIG. 14 is a plan view schematically showing a method according to another embodiment.

In FIG. 14, a reference numeral 115 designates a head pressure lever holding a head contact 113, which can rotate or move in parallel and 116, a head stopper fixed on the inner side of the carrier.

According to the present embodiment, the following procedures will be taken to fix the carrier 102 and recording head 1. The head fixing lever 115 which is rotatively fixed to the carrier 102 is rotated to the position indicated by a broken line in FIG. 14. Then, the recording head 1 itself or the coupled recording head 1 and ink tank 2 are inserted in the direction perpendicular to the plane of FIG. 14, so that the protrusion of the recording head 1 is placed between the head stopper 116 and head pressure lever 115. Then, the head fixing lever 115 is rotated to the position indicated by a solid line; hence fixing the head fixing lever 115 by a means which is not shown in FIG. 14. At this juncture, since a resilient pad 111 is used for the head contact 113 as in the case of the foregoing embodiment described in FIG. 13, the contact pressure is secured by the compressed resilience of the resilient material.

Also, the separation of the recording head 1 and carrier 102 can be performed by the operation contrary to the above, and withdrawn by shifting them in the direction perpendicular to the plane of FIG. 14.

In this respect, in order to separate the ink tank 2, the ink tank lever 107 (not shown) is operated to shift the ink tank pressure lever 114 in the direction indicated by an arrow b in FIG. 14. With the above-mentioned structure, the following effect can be obtained:

When the ink tank 2 separation is performed in the on carrier condition, the force exerted on the recording head 1 is received by the head stopper 116 so as not to cause the recording head 1 to be shifted; hence obtaining an improved reliability.

Figure 16:
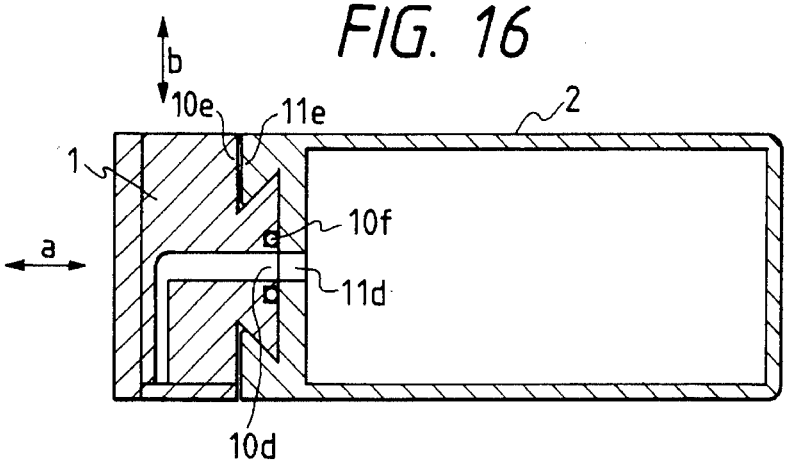
FIG. 16 is a schematically cross-sectional view showing the structure of the embodiment shown in FIG. 15.
Figure 15A:
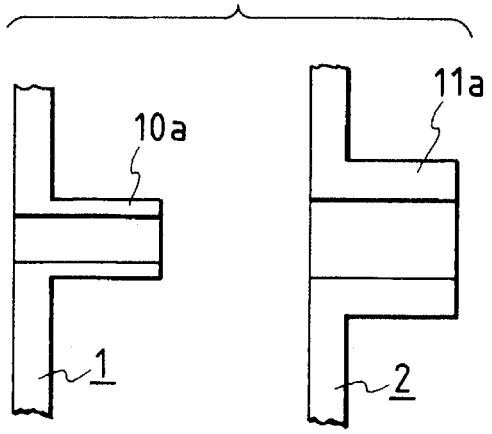
FIGS. 15A, 15B, and 15C are schematically cross-sectional views showing the structures of still another embodiment.
Figure 15B:
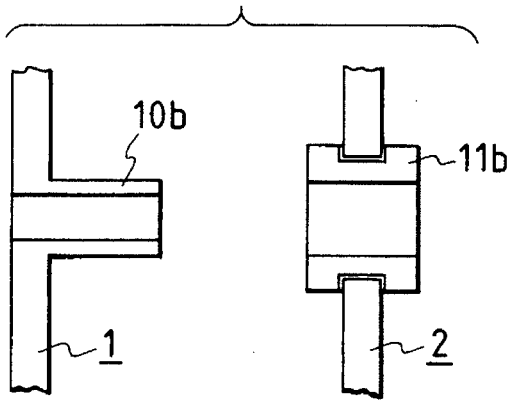
Figure 15C:
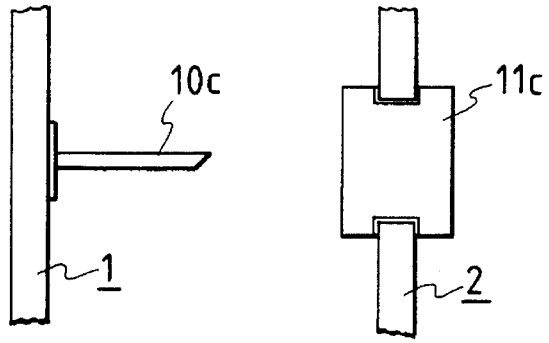

FIGS. 15B, 15C, and FIG. 16 illustrate the ink passage coupling of the recording head and ink tank according to still another embodiment of the present invention. FIG. 15B shows the case where the ink supply outlet 11*b* is made of a resilient material such as rubber, and it is possible to make the inner diameter of the ink supply outlet 11*b* smaller than the outer diameter of the ink supply inlet 10*a*; thus improving the contact between the ink supply inlet 10*a* and ink supply outlet 11*b* when the recording head 1 and ink tank 2 are coupled. Accordingly, the sealing capability of the ink passage is also improved. Further, since a force required to deform the ink supply outlet 11*b* can be small, it is possible to make the force required to mount and demount the recording head 1 and ink tank 2 equally small.

FIG. 15C illustrates the case where the ink supply inlet 10*c* is made annular having an acute end while the ink supply outlet 11*c* is formed by a resilient material such as rubber without any hole. When separated from the recording head 1, the ink supply outlet 11*c* of the ink tank 2 is closed so as not to allow any ink leakage from the ink supply outlet 11*c*. Therefore, the ink tank 2 itself can be handled in an excellent condition. Also, when the ink tank 2 and recording head 1 should be coupled, the acute end of the ink supply inlet 10*c* makes a hole in the ink supply outlet 11*c* to form an ink passage. Thus, a stabilized coupling of ink passages is possible, at the same time making the force required to connect or separate the ink tank 2 to or from the recording head small.

FIG. 16 illustrate the case where guides 10*e* and 11*e* are provided in the direction perpendicular to the direction of the ink passage. By shifting the ink tank 2 in the direction perpendicular to the plane of FIG. 16 with respect to the recording head 1, the coupling and separation are performed. Also, in the coupling portion, a sealing member 10*f* made of a resilient material such as rubber is provided to prevent ink leakage. When the directions in which the recording head 1 are mounted or demounted are the same as the directions in which the ink tank 2 is mounted or demounted, the structure will be the same as the foregoing embodiment, but such directions are arranged as indicated by arrows a and b in FIG. 16, the mounting or demounting directions are different for the recording head 1 and ink tank 2. As a result, the relationship associated with the forces as shown in FIG. 6 will be eliminated; thus making it possible to mount or demount the ink tank 2 and recording head 1 with a minimum force required.

Figure 17A:
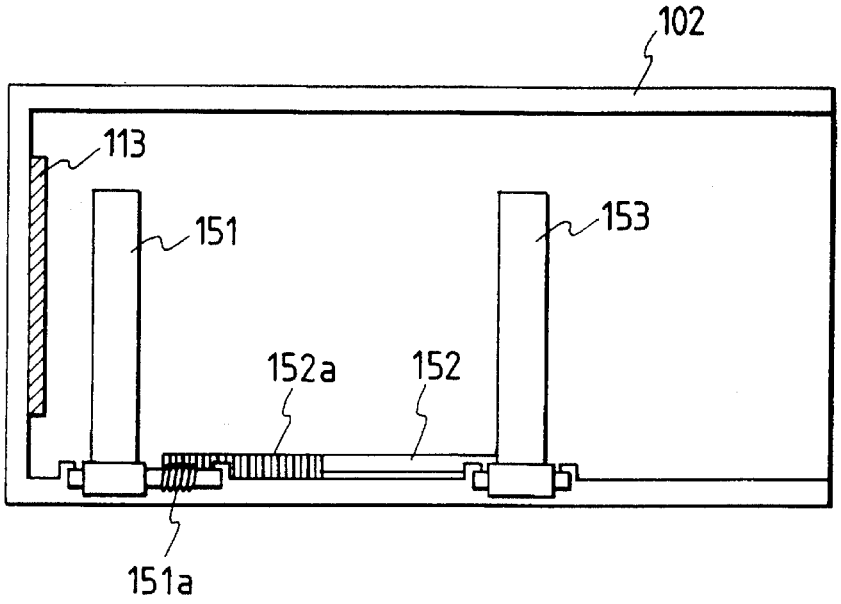
FIGS. 17A and 17B are schematically cross-sectional views showing the structure of a further embodiment.
Figure 17B:
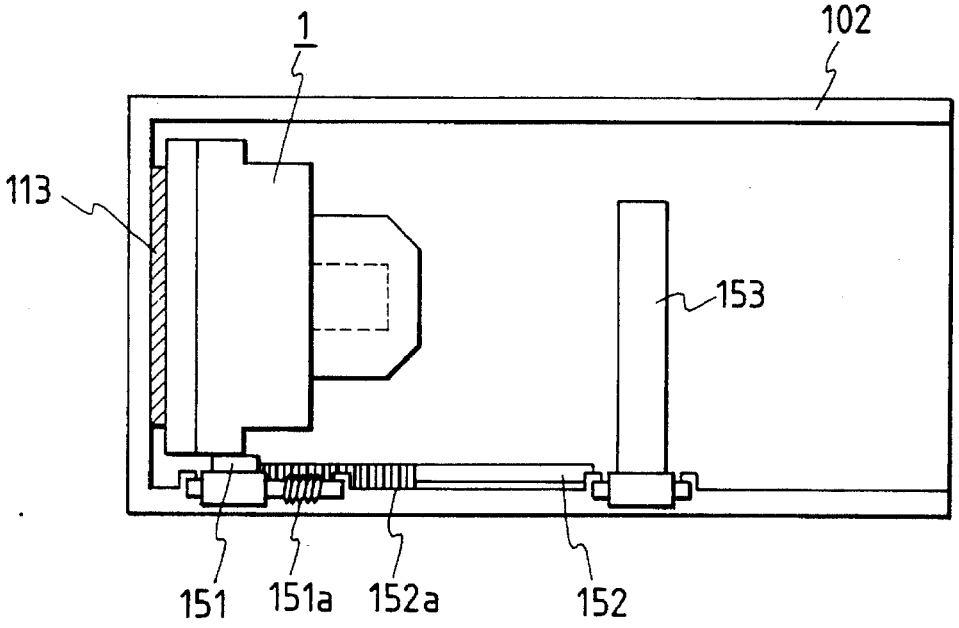

FIGS. 17A and 17B illustrate another embodiment according to the present invention wherein the mounting and demounting of the ink tank 2 are controlled. FIG. 17A shows the state where neither the recording head 1 nor the ink tank 2 is present, in which a reference numeral 151 designates a head detection lever rotating in response to the mounting or demounting of the recording head 1; 151*a*, a pinion transmitting the rotation of the head detection lever 151 to the rack 152*a* of a stopper 152; a tank control lever to control the installation of the ink tank 2. When neither the recording head 1 nor the ink tank 2 is present, both the head detection lever 151 and tank control lever 153 are arranged to block the installation passages of the ink tank 2 and recording head 1 by the biasing force exerted by springs or the like (not shown). Also, the stopper 152 is shifted by the head detection lever 151 to the position where it can regulate the rotation of the tank control lever 153 in the installation direction of the ink tank 2. In other words, when the recording head 1 is yet to be mounted, the installation of the ink tank 2 is blocked by the tank control lever 153. FIG. 17B illustrates the state where the recording head 1 is mounted. The head detection lever 151 is rotated due to the installation of the recording head 1 as shown in FIG. 17B. The rotation of the head detection lever 151 is transmitted to the stopper 152 through the pinion 151*a* to release the rotational regulation of the tank control lever 153 as shown in FIG. 17B. In other words, when the recording head 1 is mounted, the installation of the ink tank 2 becomes possible. As a result, the ink tank 2 can be attached to or detached from the recording head 1. Also, in a case where the arrangement is simple so that only the recording head 1 is mounted on or demounted from the carrier 102, the installation of the ink tank 2 is prohibited when the recording head 1 is yet to be mounted; hence preventing any erroneous operations.

Figure 18A:
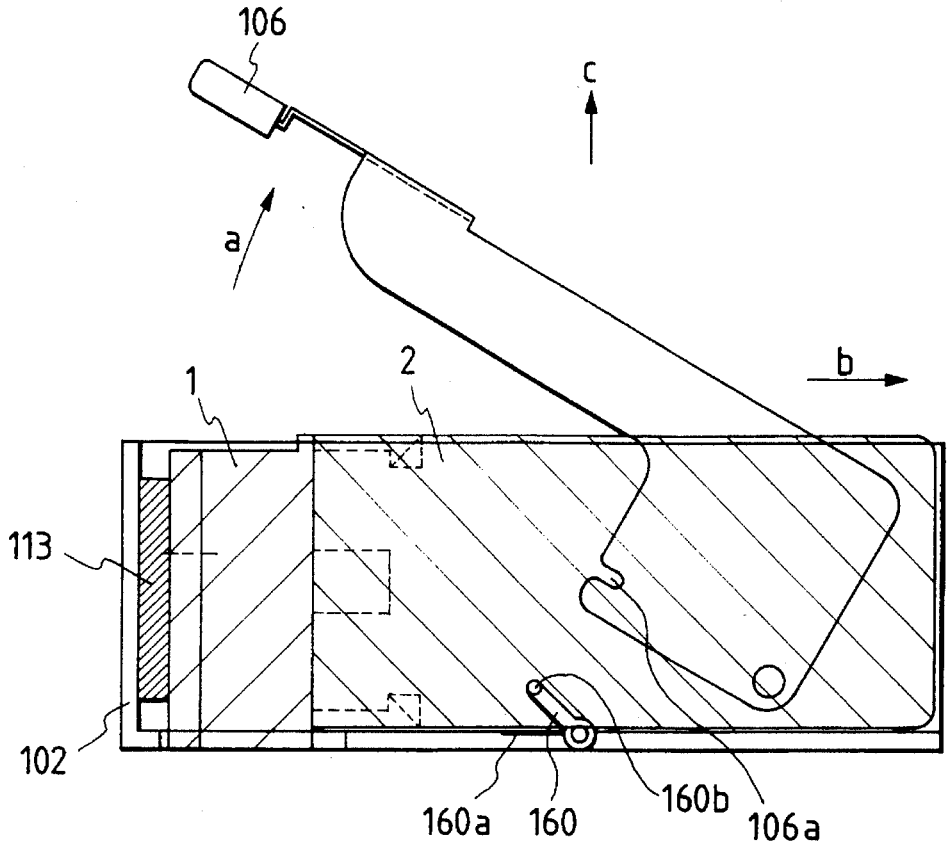
FIGS. 18A and 18B are schematic plan views showing still a further embodiment.
Figure 18B:
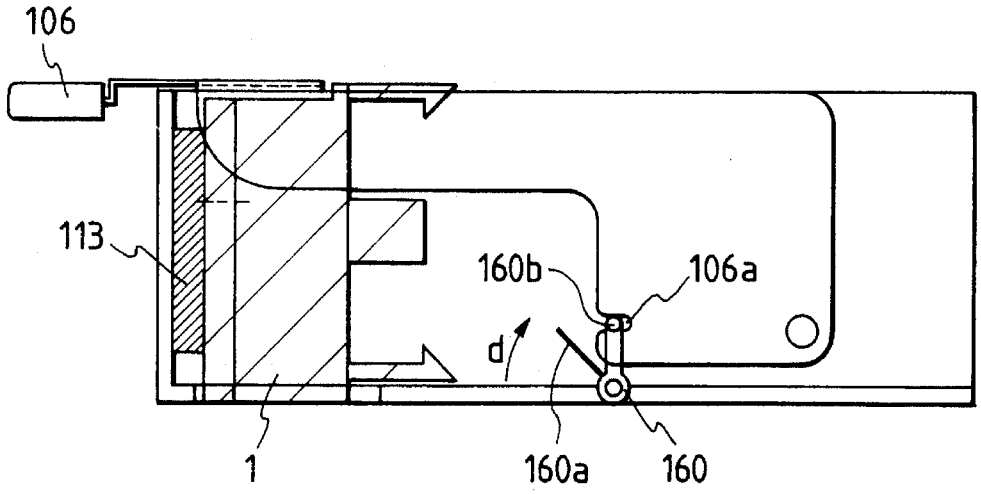

FIGS. 18A and 18B illustrate still another embodiment according to the present invention wherein the mounting and demounting of the recording head 1 are controlled. FIG. 18A shows the state where both the recording head 1 and ink tank 2 are installed. The structure is the same as FIG. 4, but there is a tank detection lever 160 provided beneath the lower part of the ink tank mounting unit of the carrier 102. The contacting portion 160*a* of the tank detection lever 160 is regulated by the ink tank 2 to set its position while the hook 160*b* of the ink detection lever 160 is released from the cut off portion 106*a* of the head lever 106. Thus, the head lever 106 is rotative. When the head lever 106 is rotated in the direction indicated by an arrow at 16*a*, the recording head 1 and ink tank 2 are shifted in the direction indicated by an arrow at 16*b* as they are still in the coupled condition as in the case shown in FIG. 4. Hence, it becomes possible to remove them. FIG. 18B shows the state where the recording head 1 is mounted while the ink tank 2 is yet to be mounted. The tank detection lever 160 is biased by biasing means (not shown) such as a spring in the direction indicated by an arrow d. When the ink tank 2 is not present, the lever is rotated as it is in the state shown in FIG. 18B. Then, the hook 160*b* engages with the cut off portion 106*a* to regulate the rotation of the head lever 106. In other words, it becomes impossible to remove the recording head 1 if no ink tank 2 is present. As a result, it becomes impossible to handle the recording head 1 itself. Thus, there is no possibility that a hand touches the vicinity of the ink ejection nozzles of the recording head 1 or the vicinity of the ink supply inlet 10. Any contamination which may produce adverse effects on recording can be prevented assuredly. Also, any adverse effect that may affect the recordings attributable to the fact that the recording head 1 is handled as a single body can be eliminated assuredly because there is no possibility that air is taken from the ink ejection nozzles and the ink supply inlet 10 to be mixed in the ink passages.

In the foregoing embodiment described in FIG. 1, the presence of the recording head 1 on the carrier 102 can be detected by discriminating whether the recording head 1 is electrically connected or not. However, it does not have any means to detect the remaining quantity of ink in the ink tank 2 or to transmit to an information processing apparatus the information regarding the presence of the ink tank 2 on the carrier 102. The present invention is not confined to this, and it may be possible to provide the above-mentioned detecting means.

Figure 19:
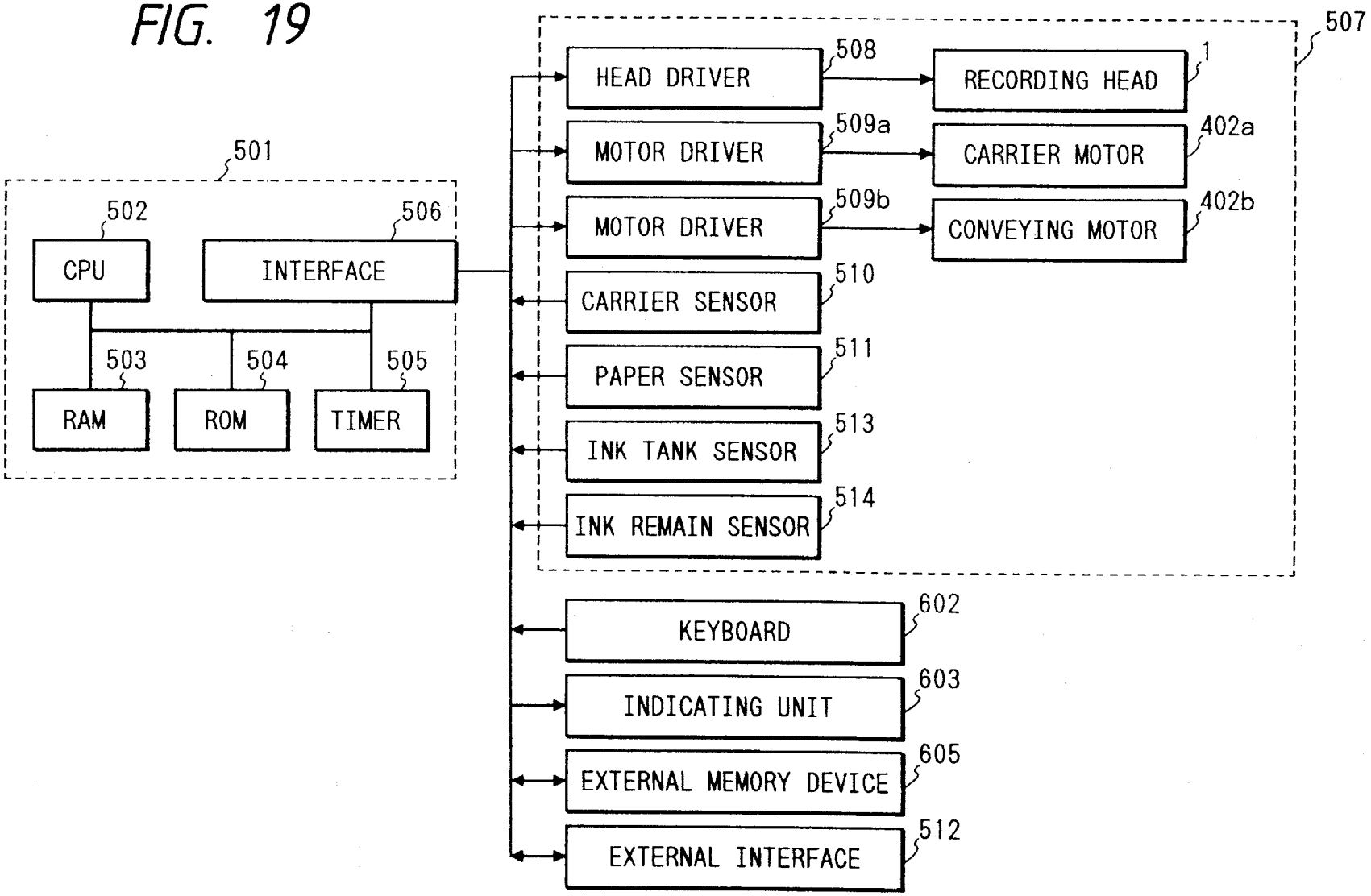
FIG. 19 is an electrical circuit diagram showing the structure of still another embodiment.
Figure 20:
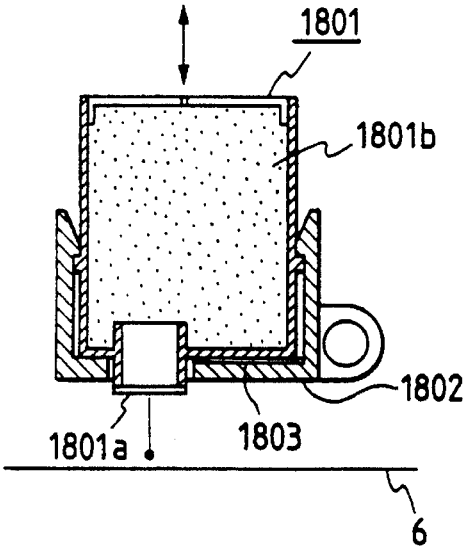
FIG. 20 PRIOR ART
FIG. 20 is a schematically cross-sectional view illustrating a prior art.
Figure 22:
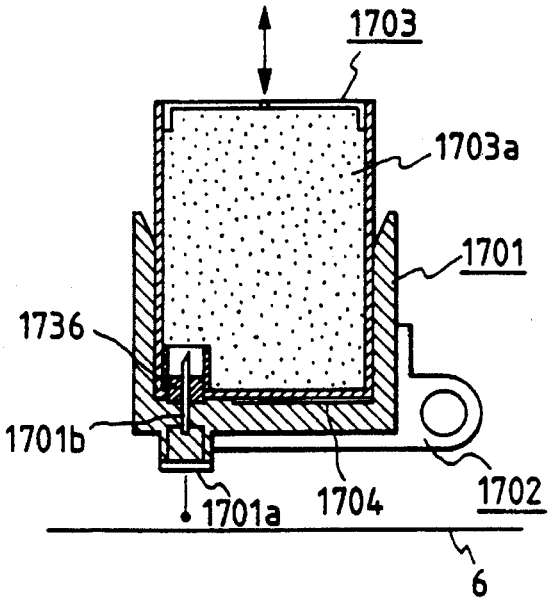
FIG. 22 PRIOR ART
FIG. 22 is a schematically cross-sectional view illustrating a prior art.
Figure 21:
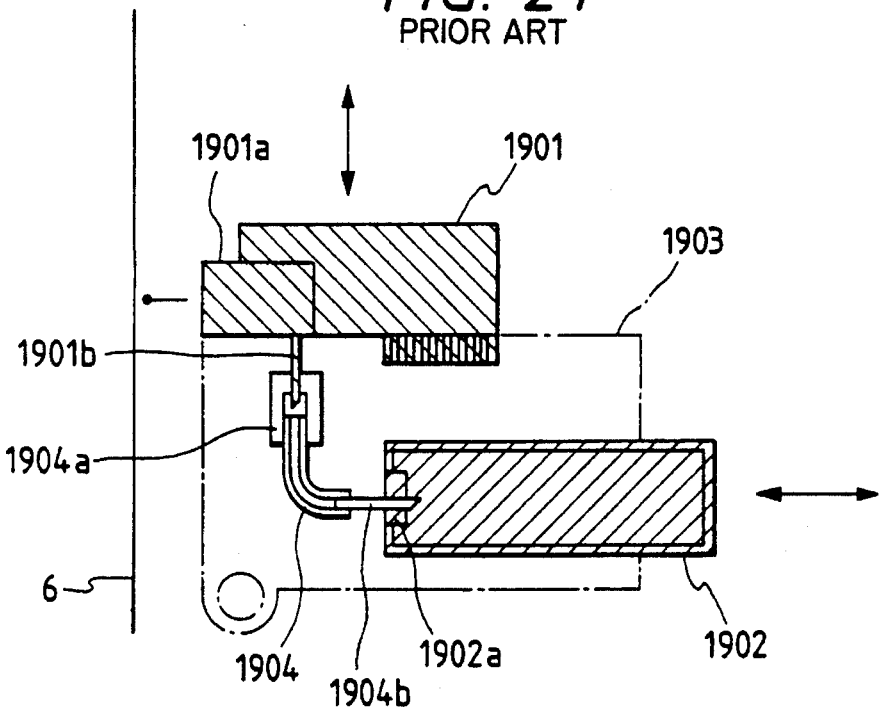
FIG. 21 PRIOR ART
FIG. 21 is a schematically cross-sectional view illustrating a prior art.

FIG. 19 is a block diagram showing the electric circuits of an information processing apparatus according to still another embodiment of the present invention.

In FIG. 19, a reference numeral 513 designates an ink tank sensor to detect whether the ink tank 2 is present on the carrier 102 or not, and 514 an ink remain sensor to detect the presence of printable ink in the ink tank 2. The description of any elements having the same reference numerals as those in FIG. 11 will be omitted.

More specifically, the ink tank sensor 513 may be such that mechanical contacts are arranged on the carrier 102, or a structure is arranged so as to provide an optical sensor for the purpose. The ink remain sensor 514 may be arranged in such a manner that by making the ink tank 2 with a transparent material so as to allow the remaining quantity to be detected optically from outside, or a sensor is provided in the ink tank 2 to sense the liquid therein and contacts are arranged on the surface of the ink tank connecting to such a sensor; thus arranging the contacts on the carrier 102.

With the above-mentioned sensors, it is possible to transmit to the CPU 502 information through the interface 506 to issue warning or execute appropriate processes when a recording operation is intended without the presence of ink tank 2 or recording head 1, or the related printing becomes disabled due to the shortage of the remaining ink during the recording operation.

For example, there is a possibility that the recording operation becomes disabled immediately after the ink tank 2 is connected to the recording head 1 because of air bubbles mixed in the recording head 1. In order to prevent this, it may be possible to arrange the system to interpret such a change in the status that while the recording head 1 is on the carrier 102, the ink tank 2 which is absent is now present as a case where an ink tank 2 is newly connected to the recording head in the on carrier condition, and to allow the carrier 102 to return to its home position for the suction operation by the recovery unit 301.

With the above-mentioned structure, the following effects can be obtained.

While in printing, if ink is totally consumed, the operation is automatically suspended and a warning is given accordingly. Thus, no recording medium will be wasted.

Also, after the replacement of ink tanks, there is no need for executing the recovery operation manually. Therefore, operativity will be improved.

Each of the embodiments set forth below can be preferably used for the foregoing ink jet recording apparatus. Hereinafter, as another embodiment, the description will be made of an embodiment wherein a recording head and an ink tank are separable and replaceable, and the recording head is coupled by pressing it to the carriage which carriers the recording head in a given direction.

Figure 23:
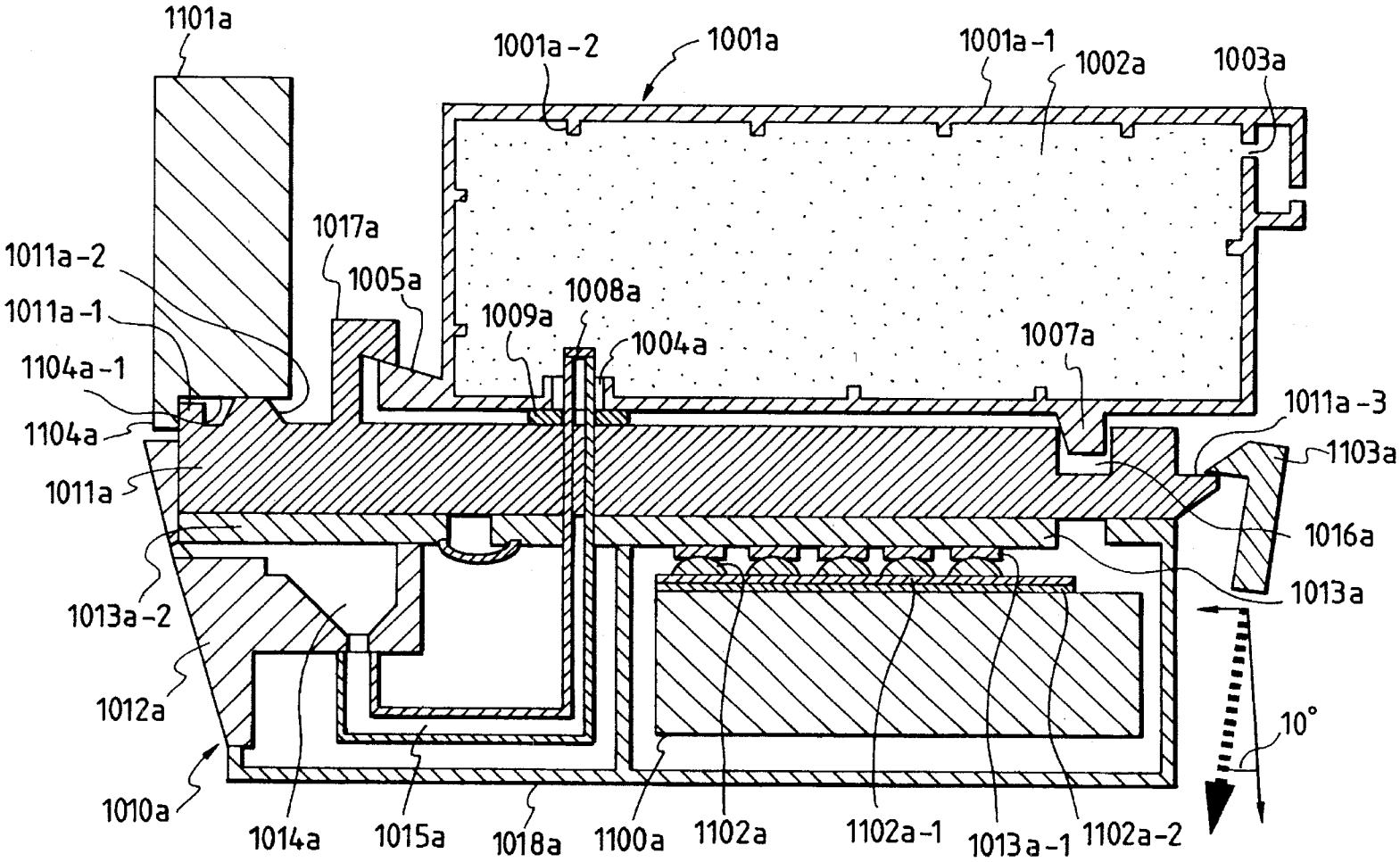
FIG. 23 is a schematically cross-sectional view illustrating the state where an exchangeable recording head and exchangeable ink tank according to another embodiment are mounted on a carriage.

FIG. 23 is a cross-sectional view showing the state where a recording head, ink tank, and carriage are coupled in an ink jet recording apparatus according to another embodiment of the present invention.

In the present embodiment, a recording head 1010*a* is of a type which is used for an ink jet method using electrothermal transducers to generate thermal energy to give film boiling to ink in accordance with electric signals.

In FIG. 23, the principle structure of the recording head 1010*a* is such that all the elements are laminated by adhesion or pressing on a head base plate 1011*a* with the positioning protrusions 1011*a*-1 and 1011*a*-2 arranged on the head base plate 1011*a* as positioning reference.

Here, in the vertical direction in the inner face in FIG. 23 is positioned by the reference face 1104*a*-1 of a front board 1101*a* and a protrusion 1011*a*-1, while the horizontal direction in the inner face of FIG. 23 is positioned by a head positioning unit 1104*a* and a protrusion 1011*a*-2. Further, the direction perpendicular to the cross-section of FIG. 23 is positioned by the protruded portion (not shown) of the protrusion 1011*a*-2 which is protruded partially to cover the head positioning unit 1104*a*, and the head positioning unit 1104*a*.

On a heater board 1013*a*-2, there are formed by film deposition on an Si substrate, electrothermal transducers (ejection heaters) arranged in plural arrays and electric lines of aluminum and others to supply electric power. The heater board is connected to a head flexible board (hereinafter referred to as head PCB) 1013*a* having lines with pads 1013*a*-1 arranged at its leading ends to receive electric signals from the apparatus body. The connection is made by wire bonding with each of the corresponding lines arranged face to face. Then, the ink ejection unit is formed with a common liquid chamber inducing ink from a replaceable ink tank 1001*a* through partition walls to partition each of the plural ink passages in accordance with the ejection heaters and liquid passages in order to supply it to ink passages, and a grooved ceiling board 1012*a*, which is integrally formed with orifices constituting a plurality of discharging ports by polysulfone or the like, is pressed by a spring (not shown) to the heater board 1013*a*-2, at the same time being fixed by pressing with adhesives and sealed; thus fabricating the ink discharging unit. The liquid passages 1015*a* coupled to the grooved ceiling 1012*a* and sealed can be connected to the replaceable ink tank 1001*a* in the present embodiment. To this end, the liquid passages are penetrated through to the opposite side of the head base plate 1011*a* through the hole provided for the head PCB 1013*a* and head base plate 1011*a*, at the same time being fixed adhesively to the head base plate 1011*a*.

Also, at the end of the coupling side between the liquid passage 1015*a* and ink tank 1001*a*, a filter 1008*a* is provided to prevent dust particles and unwanted air bubbles from flowing into the discharging ports. Also, a head cover 1018*a* is provided to protect the discharging ports of the recording head 1010*a* and the pad 1013*a*-1 for electrical connection as well as to make it easier to hold the recording head 1010*a* from its handling end.

The replaceable ink tank 1001*a* has, in its tank case 1001*a*-1 having ribs 1001*a*-2 on its inner face, the ink absorbents 1002*a* retaining ink stuffed with almost no space, the ink supply outlet (hole) 1004*a* to which the leading end of the liquid passage 1015*a* with the filter 1008*a* provided at its leading end is inserted to make ink connection, and the air conduit 1003*a* (hole) to prevent a negative pressure from being generated excessively by introducing air into the replaceable ink tank 1001*a* in an amount corresponding to ink flowing out from the replaceable ink tank 1001*a*. On the inner wall of the tank case 1001*a*-1, the ribs 1001*a*-2 are provided in order to prevent direct air conduction to the ink supply outlet 1004*a* through the inner wall of the tank case 1001*a*-1 for the maximum utilization of ink in the total area of the ink absorbents 1002*a* by the force exerted by the capillary phenomenon and at the same time, the air conduit 1003*a* is arranged away form the ink supply outlet 1004*a* as far as possible. The ribs 1001*a*-2 function to reinforce the tank case 1001*a*-2 simultaneously so as to contribute to improving the operativity when tanks are replaced. The initial amount of ink retained in the ink absorbents 1002*a* is less than the total absorbable amount of the ink absorbents 1002*a* in order to give a negative water head pressure to the meniscus of the discharging ports of the recording head 1010*a* when it is coupled for the functional purpose to enable a stabilized ejection as well as for the operational purpose to prevent any ink leakage even when a slight shock is given at the time of replacing ink tanks. It may be possible to control ink leakage from the air conduit 1003*a* by arranging the provision of a liquid repellent treatment for the ink absorbent 1002*a* in the air conduit 1003*a* or using a separate liquid repellent absorbent. The ink supply to the replaceable ink tank 1001*a* comes to a limit when the retained ink in the ink absorbent 1002*a* becomes extremely small to make the ink suction of the ink absorbent 1002*a* greater than the ink supply capability to the recording head 1010*a* by the force exerted by the capillary phenomenon of the nozzles following the ink ejection or when the air induced from the air conduit 1003*a* becomes great around the filter 1008*a* and the air is supplied to the ink absorbent 1002*a* in a large amount through the air filter 1008*a*.

The mechanical and electrical connection of the recording head 1010*a* and replaceable ink tank 1001*a* to the carrier HC are conducted in the following manner.

For the carriage HC, there are provided a front board 1101*a* positioned on the platen side (the front side of the head); a flexible sheet 1102*a*-1 provided with the head driving electrode 1102*a* corresponding to the pad 1013*a*-1 on the head PCB of the recording head 1010*a*; an electrical contact supporting board 1100*a* with a resilient member (rubber pad) 1102*a*-2 pressing the flexible sheet from its rear side; a head positioning unit 1104*a* to fix the recording head 1010*a* mechanically; and a pressing hook 1103*a* to support the recording head 1010*a* with one-way biasing. Here, two front boards 1101*a* are arranged each for the foregoing positioning protrusions 1011*a*-1 and 1011*a*-2 providing the positioning reference surface 1104*a*-1 for the head base plate 1011*a* of the recording head 1010*a*. The pressure hook 1103*a* of the carriage HC is structured to exert a biasing force in the direction indicated by a broken arrow in FIG. 23, that is, inclined approximately at ten degrees in the traveling direction of the carriage HC. Therefore, due to such a biasing force, the recording head 1010*a* is pressed in both directions toward the front board 1101*a* and the electric connection supporting board 1100*a*. At the same time, it is biased in the traveling direction of the carriage HC in the head positioning unit 1104*a* with the electric connection supporting board 1100*a* as its pivot. Although this pressure coupling operation of the pressure hook 1103*a* can be executed any way it is preferable to do it by a lever or the like from the upper surface side of the carriage HC. In any way, when this pressure hook 1103*a* is coupled, the recording head 1010*a* and replaceable ink tank 1001*a* are electrically connected after being slightly rotated on the carrier HC to allow the positioning protrusions 1011*a*-1 and 1011*a*-2 to be in contact with the positioning reference surface 1104*a*-1 of the front board 1101*a*. Thus, the positioning of the pad 1013*a*-1 on the head PCB 1013*a* and head driving electrode 1102 is also reliably executed.

Figure 24:
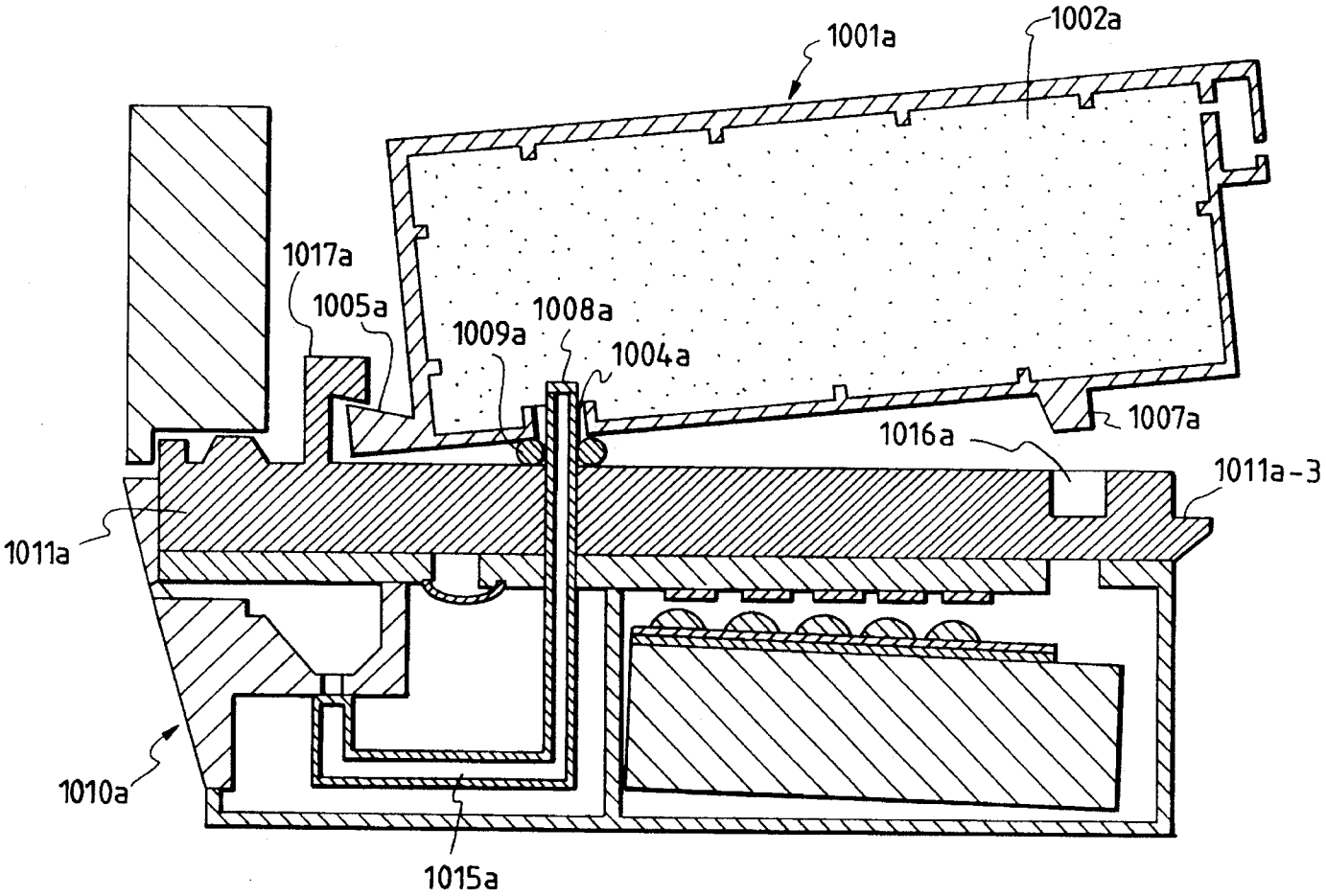
FIG. 24 is a schematically cross-sectional view illustrating a mounting sequence.
Figure 25:
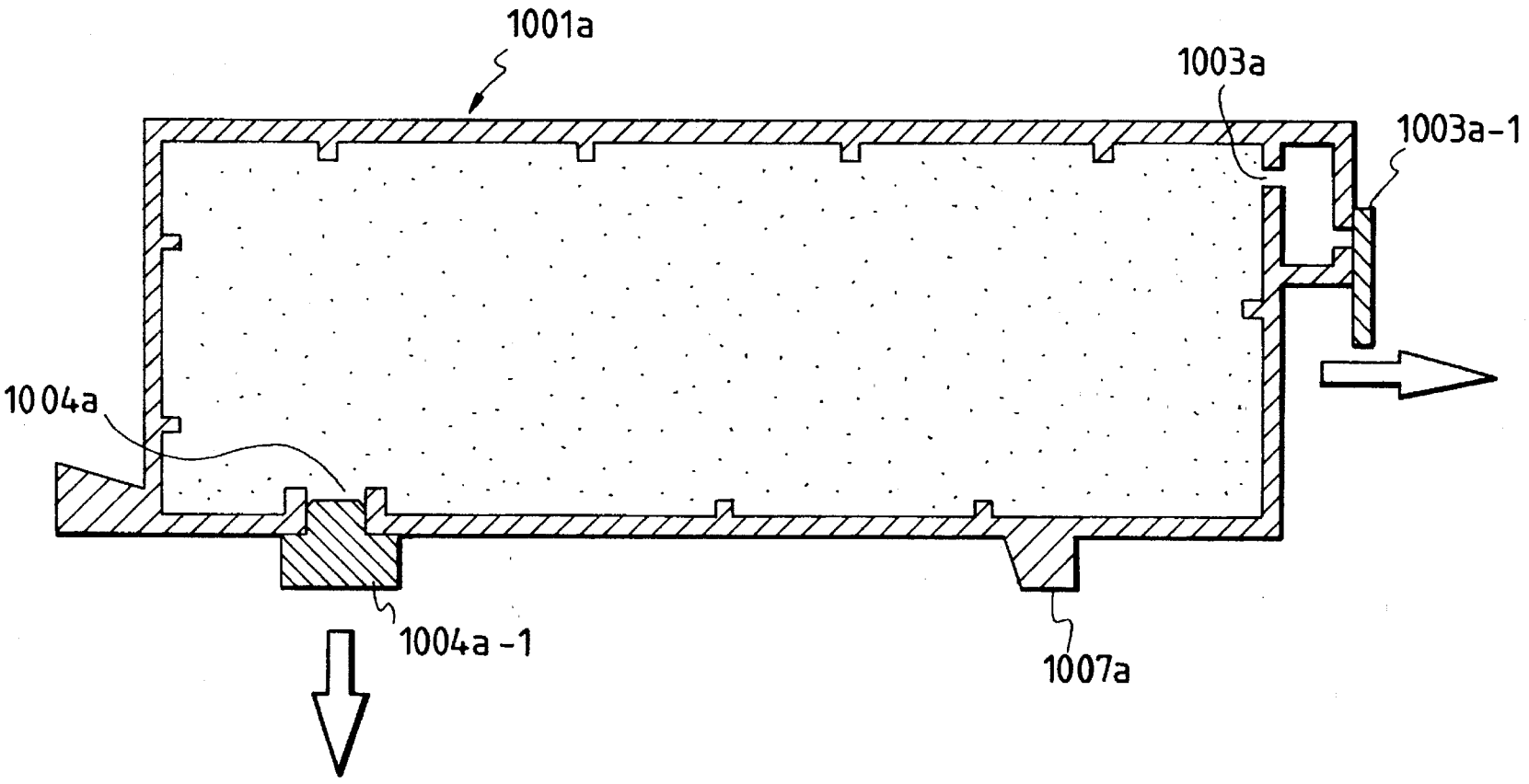
FIG. 25 is a schematically cross-sectional view illustrating an exchangeable tank.

Before the recording head 1010*a* and replaceable ink tank 1001*a* are coupled, the carriage HC and recording head 1010*a*, and the recording head 1010*a* and replaceable ink tank 1001*a* are separated as shown in FIG. 24. Only the respective coupling portions are in contact. The recording head 1010*a* and replaceable ink tank 1001*a* begin to be coupled with the engagement between the coupling hook 1017*a* provided on the head base plate 1010*a* and coupling guide 1005*a* provided on the replaceable ink tank 1001*a* as shown in FIG. 24. To arrange this coupling portion between the ink supply outlet 1004*a* and head positioning unit 1104*a* makes it possible to connect ink supply passages reliably when the replaceable ink tank is coupled to the recording head 1010*a*.

In other words, as clear from FIG. 24, when the replaceable ink tank 1001*a* is rotated in clockwise direction in FIG. 24, the ink supply outlet 1004*a* becomes the actuating point with the coupling portion between the coupling hook 1017*a* and coupling guide 1005*a* as its pivot if a thought is given as to the coupling of the recording head 1010*a* and replaceable ink tank 1001*a*. Therefore, the liquid passage end are coupled with the ink absorbent 1002*a* and filter 1008*a* as coupling faces. Further, at the same time, a resilient ring seal 1009*a* pinched between the head base plate 1011*a* and the outer wall of the replaceable ink tank is pressed and deformed to be tightly in contact with them. Thus, the conduction between the interior of the replaceable ink tank 1001*a* and the atmosphere is completely blocked in the ink supply outlet 1004*a*. If this sealing is insufficient, the air induction to the interior of the replaceable ink tank 1001*a* following the ink supply to the recording head 1010*a* occurs directly without any intervention of the ink absorbent 1002*a*. As a result, it becomes difficult to effectively utilize ink retained in the ink absorbent 1002*a*. The pressure hook 1103*a* is established to provide its pressure in the direction inclined at ten degrees in order to position the recording head 1010*a* in the direction toward the plane of FIG. 24 with respect to the carriage HC as described earlier. Therefore, also, in consideration of the coupling to the recording head 1010*a*, a force is exerted in the direction orthogonal to the coupling direction.

Now, given the force in the pressure direction as F and the contacting force between the pad 1013a-1 on the head PCB 1013a of the recording head 1010a and the head driving electrode 1102a on the flexible sheet 1102a-1 through the rubber pad 1102a-2 on the electrical connection supporting board 1100a as $F_1$, the following relationship is obtainable:

$$F_1=F \cos 0°$$

On the other hand, given the contacting pressure between the positioning protrusion 1011a-1 of the head base plate 1011a of the recording head 1010a and the positioning reference surface 1104a-1 of the front board 1101a of the carriage as $F_2$, the following relationship is obtainable:

$$F_2=F \sin 10°$$

This force $F_1$ which effectuates the electrical connection is a component in the direction toward the plane of the head driving electrode when the pressure hook 1103a is inclined at ten degrees to the plane perpendicular to the head driving electrode plane with respect to the pressure guide 1011a-3 which is a part of the head base plate 1011a of the recording head 1010a. However, it effectuates the recording head 1010a directly without intervention of any other members such as the replaceable ink tank 1001a. Therefore, it is possible to obtain an optimally effective force $F_1$ assuredly; hence enabling the provision of a recording apparatus having an extremely high reliability in its electrical connection in terms of environmental and distributional aspects.

On the other hand, it is implemented by the application of the contact force $F_2$ to obtain the position where the carriage HC is opposed to the surface of a recording medium. The recording quality depends greatly on the positional relationship between the carriage HC and recording head 1010a. If such a position is not appropriate, the recording is slanted or the ruled lines represent a saw tooth configuration. In a worst case, the electrical connection is displaced to cause defective contacts, which generates missing dots.

In the present embodiment, the positioning contact pressure $F_2$ directly effectautes the pressure guide 1011a-3 which is a part of the head base plate 1011a of the recording head 1010a without the intervention of any other members. Its effective force is not attenuated and thus an optimal contact force $F_2$ can be obtained. In this way, a significant improvement is made for the accuracy of the distance between the recording medium and recording head, which is one of the major factors to affect the recording quality of an ink jet recording apparatus.

Moreover, since the $F_1$ force effectuates the pressure guide with the electrical connection as its pivot, a moment is generated on the recording head 1010a with the electrical connection as its pivot. Therefore, a contact force is given by the foregoing moment to the positioning protrusion 1011a-2 which is a part of the head base plate 1011a of the recording head 1010a, and the head positioning unit 1104a on the front board 1101a of the carriage HC without the intervention of any other members. As a result, the positioning accuracy of the recording head 1010a in the printing direction is significantly improved.

As described above, by directly passing the recording head 1010a, the electric power is assuredly supplied from the recording apparatus to the recording head 1010a, at the same time enabling the positioning accuracy to be significantly improved for the carriage HC and recording head 1010a. Hence, it is possible to obtain an ink jet recording apparatus having a high reliability and desirable recording quality.

Subsequently, the description will be made of another embodiment with reference to FIGS. 26 to 29.

Although the fundamental structures of the recording head 1010b and replaceable ink tank 1001b are the same as the embodiment described in FIG. 23, this embodiment is different in the direction of pressing force for coupling the recording head 1010b to the carriage HC as well as the direction in which the replaceable ink tank 1001b is installed.

Figure 26:
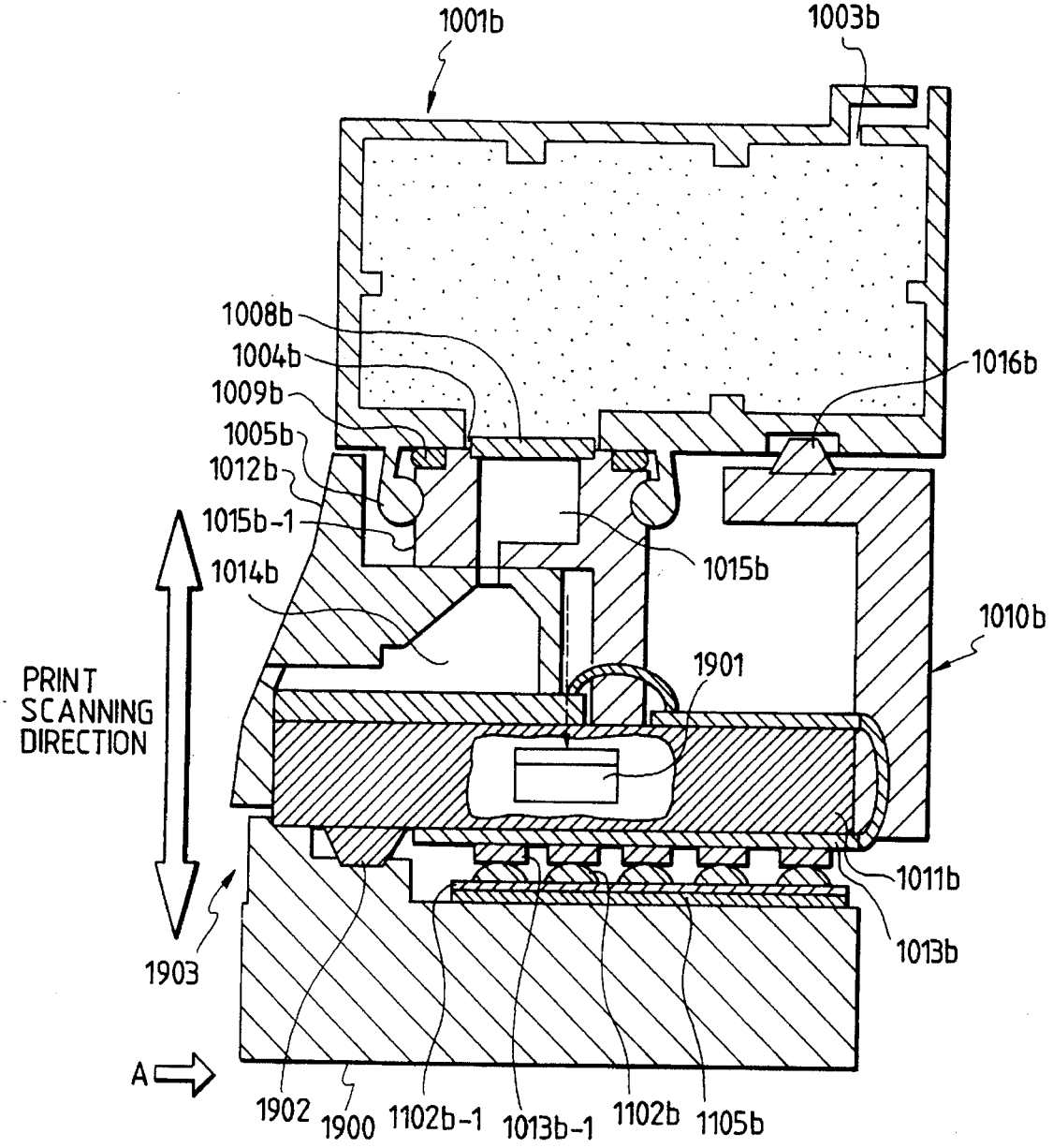
FIG. 26 is a schematically cross-sectional view illustrating the state where an exchangeable recording head and exchangeable ink tank according to another embodiment are mounted on a carriage.

In other words, as shown in FIG. 26, there is no front board positioned in the platen side (front side of the head). A side board 1900 of the carriage HC is provided in the direction perpendicular to the platen instead. On this, the electrical connection is arranged as in the embodiment described in FIG. 23. In the two locations in the substantial center of both ends of the head base plate 1011b of the recording head 1010b, pressure guides 1901 are provided. To the pressure guides 1901, the side board 1900 of the carriage HC is pressed by the pressure hook 1908 shown in FIG. 29. Thus, it becomes possible to supply power from the recording apparatus to the recording head 1010b. In this case, too, the pressing force is directly given to the recording head 1010b vertically without the intervention of any other members. Thus, an optimal pressure force can be obtained assuredly. Hence, it is possible to obtain a recording apparatus having an extremely high reliability in its electrical connection in terms of environmental and distributional aspects.

Also, the protrusion 1902 which a part of the base plate 1011b of the recording head 1010b and the carriage positioning unit 1903 are butted so as to enable the pressing force to the carriage HC to be given directly from the recording head 1010b. Consequently, the positioning accuracy of the recording head 1010b in the recording direction is significantly improved.

In this respect, it may be possible to couple the replaceable ink tank 1001b to the recording head 1010b after the recording head 1010b has been coupled to the carriage HC or to couple the recording head 1010b to the replaceable ink tank 1001b before the recording head 1010b is installed on the carriage HC.

Figure 27:
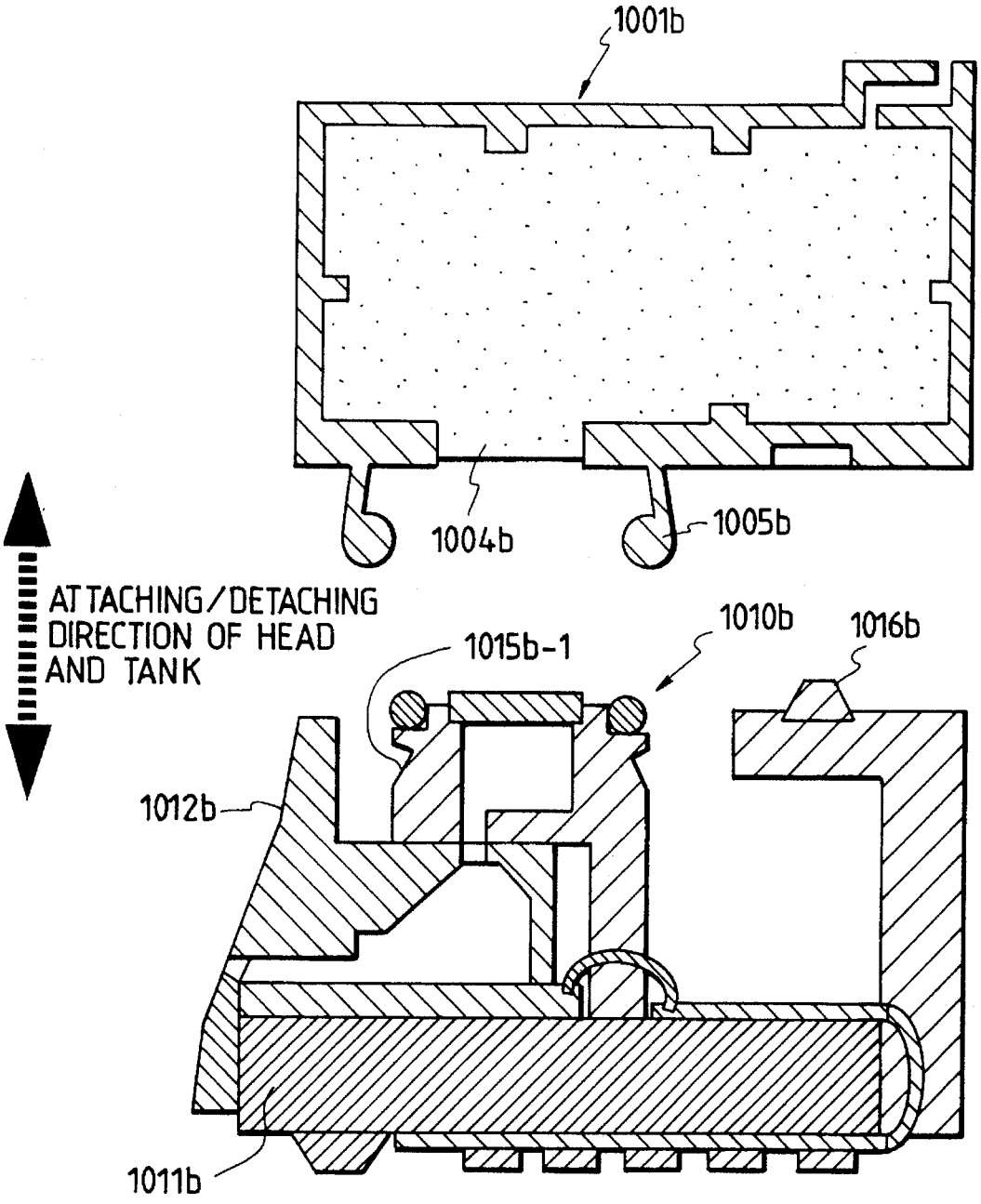
FIG. 27 is a schematically cross-sectional view illustrating a mounting sequence for a recording head and an exchangeable ink tank.
Figure 28:
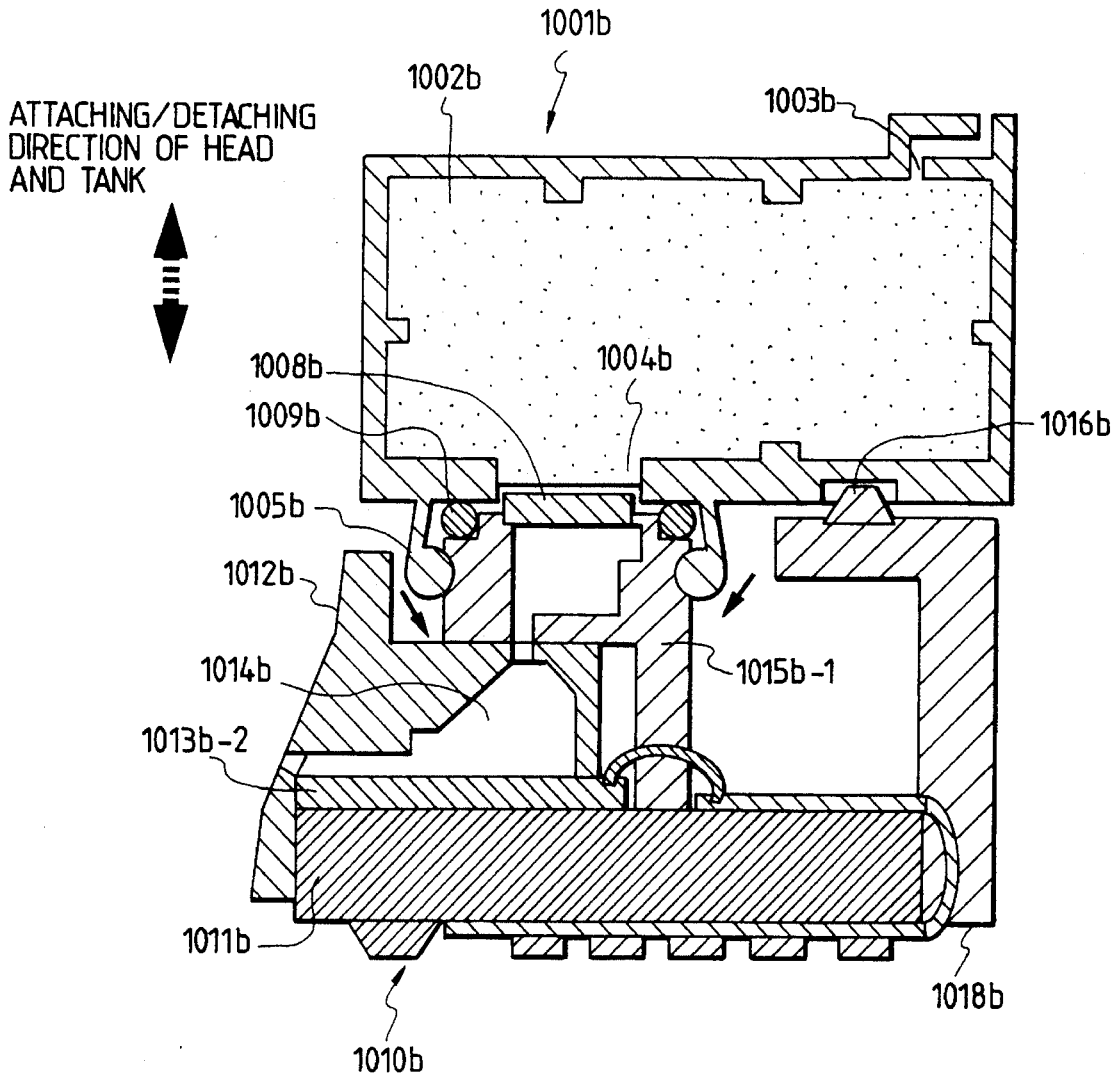
FIG. 28 is a view illustrating the coupling of a recording head and exchangeable ink tank.

FIG. 27 shows the state where the recording head 1010b and replaceable ink tank 1001b are separated. Also, FIG. 28 shows the state where the recording head 1010b and replaceable ink tank 1001b are coupled.

Figure 29:
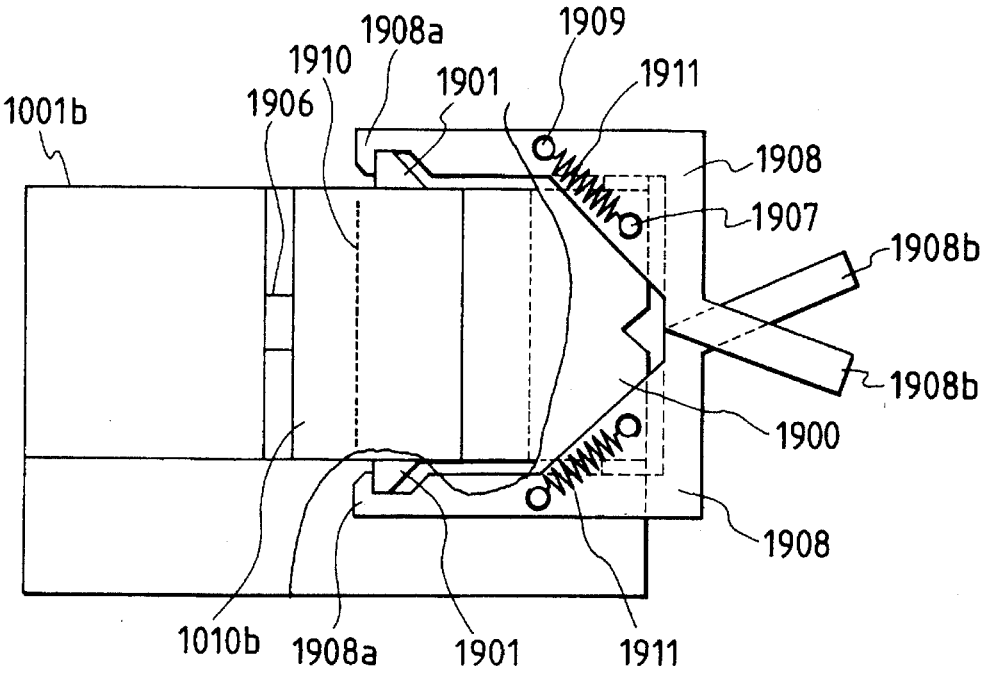
FIG. 29 is a view illustrating the recording head according to the embodiment shown in FIG. 26 viewed from the direction in which ink is ejected.

FIG. 29 is a partially cross-sectional view observed in the direction indicated by a blank arrow A shown in FIG. 26, in which a reference numeral 1906 designates the portion where the recording head 1010b and replaceable ink tank 1001b are coupled. On the side board 1900 of the carriage, a dowel 1907 is provided, the pressure hook 1908 is rotated with this dowel 1907 as its pivot. At the leading end 1908a of the pressure hook 1908, the nail is provided to hold the pressure guide 1901 which is integrated with the base head base plate of the recording head 1904. Also, the dowel 1907 and pressure hook dowel 1909 are tensioned by a tensioning coil spring 1911. In this way, the recording head 1010b is electrically connected to the carriage HC through its side board 1900 reliably. These recording head amounting pressure hooks 1908 are also provided beneath the recording head 1010b. Thus, the recording head 1010b is stably pressed to the carriage side board 1900 from above and below as well.

In this respect, a reference numeral 1910 designates nozzles ejecting ink; 1908b, a lever to be used when the recording head 1010b is removed from the carriage HC. By pinching the two places thereof, the leading end 1908a of the pressure hook 1908 is released from the pressure guide 1901 of the recording head 1010*b*; thus enabling the recording head 1010*b* to be demounted from the carriage.

Subsequently, as another embodiment, the description will be made of an embodiment wherein an ink tank and recording head can be separated while the foregoing ink tank and recording head are mounted by separate means, respectively.

Figure 31:
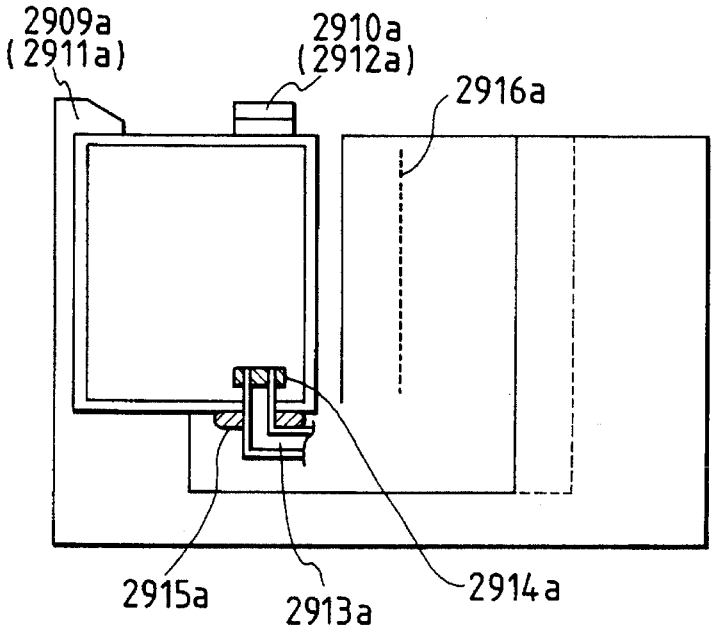
FIG. 31 is a partially sectional view illustrating the embodiment shown in FIG. 30 viewed from the direction in which ink is ejected.
Figure 30:
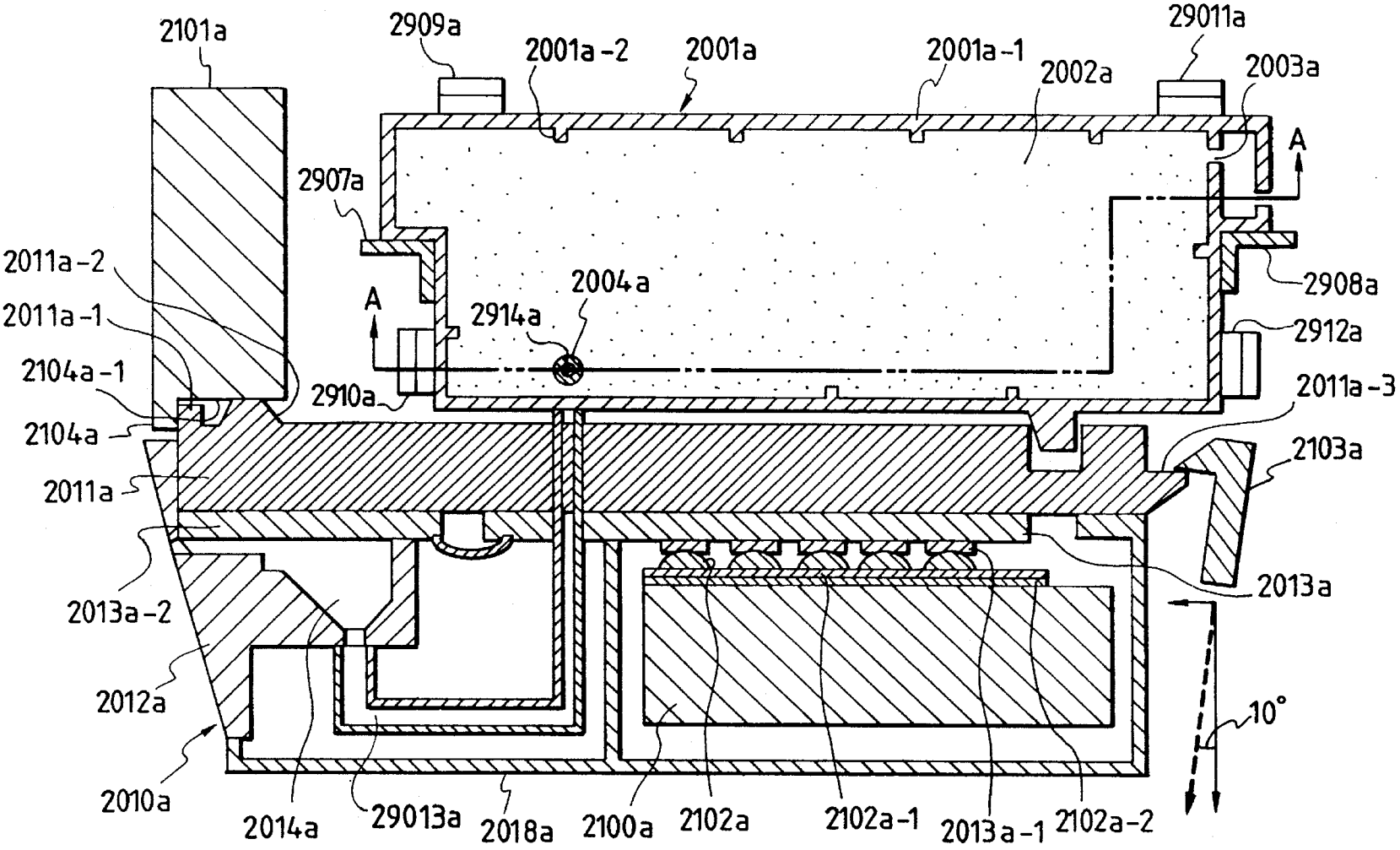
FIG. 30 is a schematically cross-sectional view illustrating the state where an exchangeable recording head and exchangeable ink tank according to still another embodiment are mounted on a carriage.

An ink tank 2001*a* is inserted into a carriage HC in the direction perpendicular to the plane of FIG. 30 in the state where it is coupled to a recording head 2010*a*. At this juncture, the replaceable ink tank 2001*a* is installed in a given location in the carriage HC by being guided by a replaceable ink tank front guide 2907*a* and replaceable ink tank rear guide 2908*a* on the carriage HC. Then, the replaceable ink tank 2901*a* is regulated by the snapping function of a pair of tank pressing front nails 2909*a* and 2911*a* and that of tank pressing rear nails 2910*a* and 2912*a*. FIG. 31 is a partially sectional view illustrating this viewed from the ink discharging surface side. The liquid passage 2913*a* extending from the recording head 2010*a* penetrates the bottom of the replaceable ink tank 2001*a* to the ink absorbent 2002*a* in the replaceable ink tank 2001*a*.

Here, in order not to allow dust particles and other impurities to be mixed in the recording head 2010*a*, a filter 2914*a* is provided and also, a ring seal 2915*a* is provided around the liquid passage 2913*a* to prevent ink leakage from the portion where the recording head 2010*a* and replaceable ink tank 2001*a* are coupled.

Figure 32:
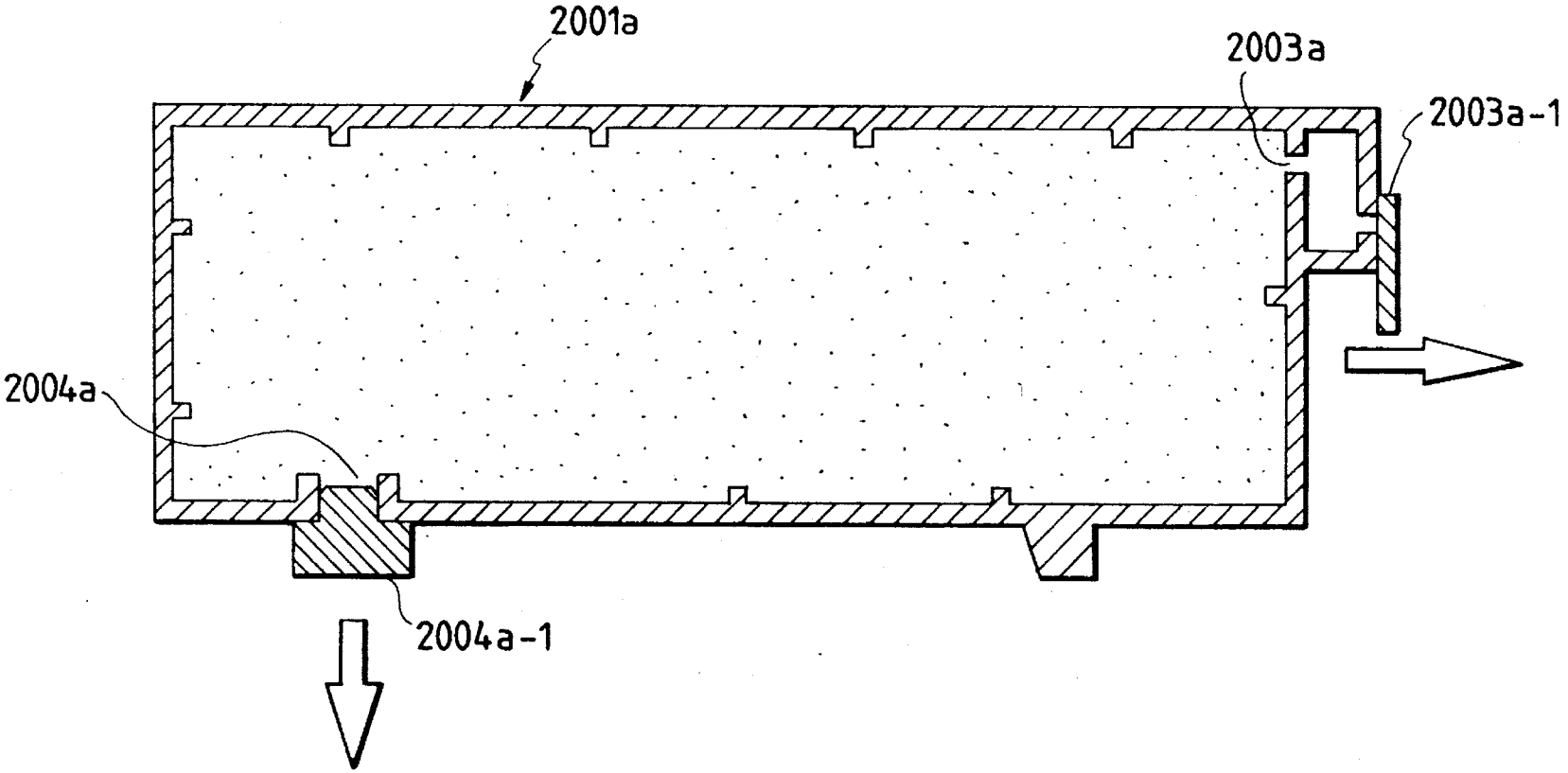
FIG. 32 is a schematically cross-sectional view illustrating an exchangeable ink tank.

A member which connects the ink tank and recording head, that is, an ink absorbent 2002*a* with which a liquid passage 2913*a* is in contact under pressure, is of a sponge type. Also, the ring seal 2915*a* is made of a resilient material having a low hardness. Therefore, no compulsory force is exerted by the ink tank 2001*a* against the recording head 2010*a*. In this respect, a reference numeral 2916*a* designates nozzles. FIG. 32 is a cross-sectional view taken-along line A—A in FIG. 30 to illustrate the replaceable ink tank itself. When it is mounted on the recording head 2010*a*, a supply unit seal 2004*a*-1 and conduit unit seal 2003*a*-1 are removed in the direction indicated by arrows, respectively.

Now, the description will be made of still another embodiment with reference to FIG. 33 to FIG. 35.

In the present embodiment, the fundamental structures of a recording head 2010*b* and replaceable ink tank 2001*b* are the same as the foregoing embodiment described in FIG. 30. What differs is the direction in which pressure is given when the recording head 2010*b* is coupled to the carriage HC and also the direction in which the replaceable ink tank 2001*b* is installed.

Figure 33:
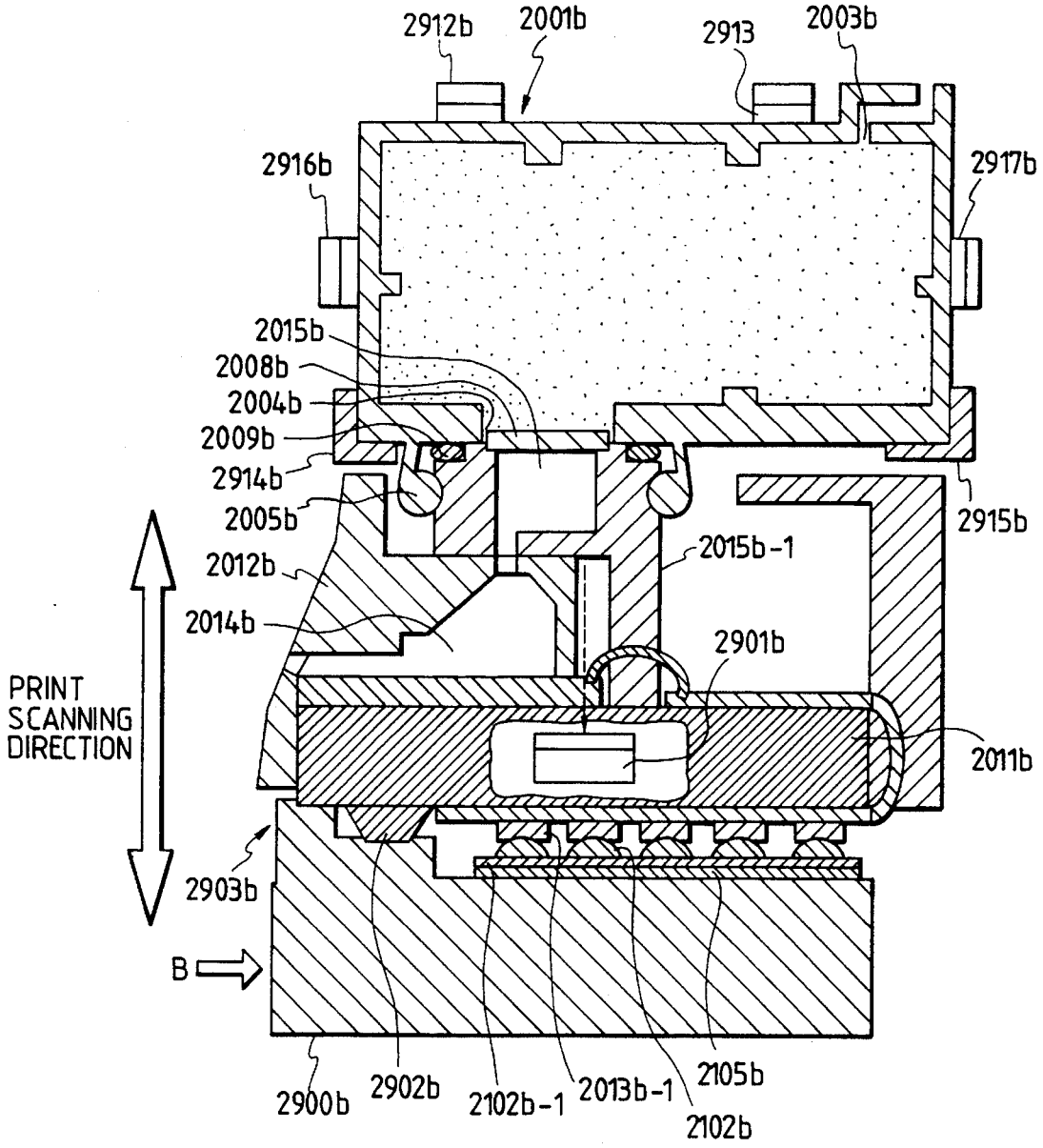
FIG. 33 is a schematically cross-sectional view illustrating the state where an exchangeable recording head and exchangeable ink tank according to still another embodiment are mounted on a carriage.

In other words, as shown in FIG. 33, there is no front board positioned on the platen side (front side of the head). A side board 2900*b* of the carriage HC is provided in the direction perpendicular to the platen instead. On this, the same electrical connection unit as the foregoing embodiment described in FIG. 30 are arranged. In two locations in the substantial center of both ends of the head base plate 2011*b* of the recording head 2010*b*, pressure guides 2901*b* are arranged. These pressure guides 2901*b* are pressed to the side board 2900*b* of the carriage HC by the pressure hooks 2908*b* shown in FIG. 35. Thus, it becomes possible to supply power from the recording apparatus to the recording head 2010*b*. Here, the pressure is exerted directly on the recording head 2010*b* vertically without the intervention of any other members. As a result, an optimal pressure is obtained reliably. It is thus possible to obtain a recording apparatus having an extremely high reliability in its electrical connection in terms of environmental and distributional aspects.

Also, the protrusion 2902*b* which is a part of the head base plate 2011*b* of the recording head 2010*b* and the carriage positioning unit 2903*b* are butted to enable a direct effect of the pressure from the recording head 2010*b* to the carriage HC. The positional accuracy of the recording head 2010*b* in the recording direction can be significantly improved.

In this respect, the replaceable ink tank 2001*b* is coupled to the recording head 2010*b* after the recording head 2010*b* is mounted on the carriage HC.

Figure 34:
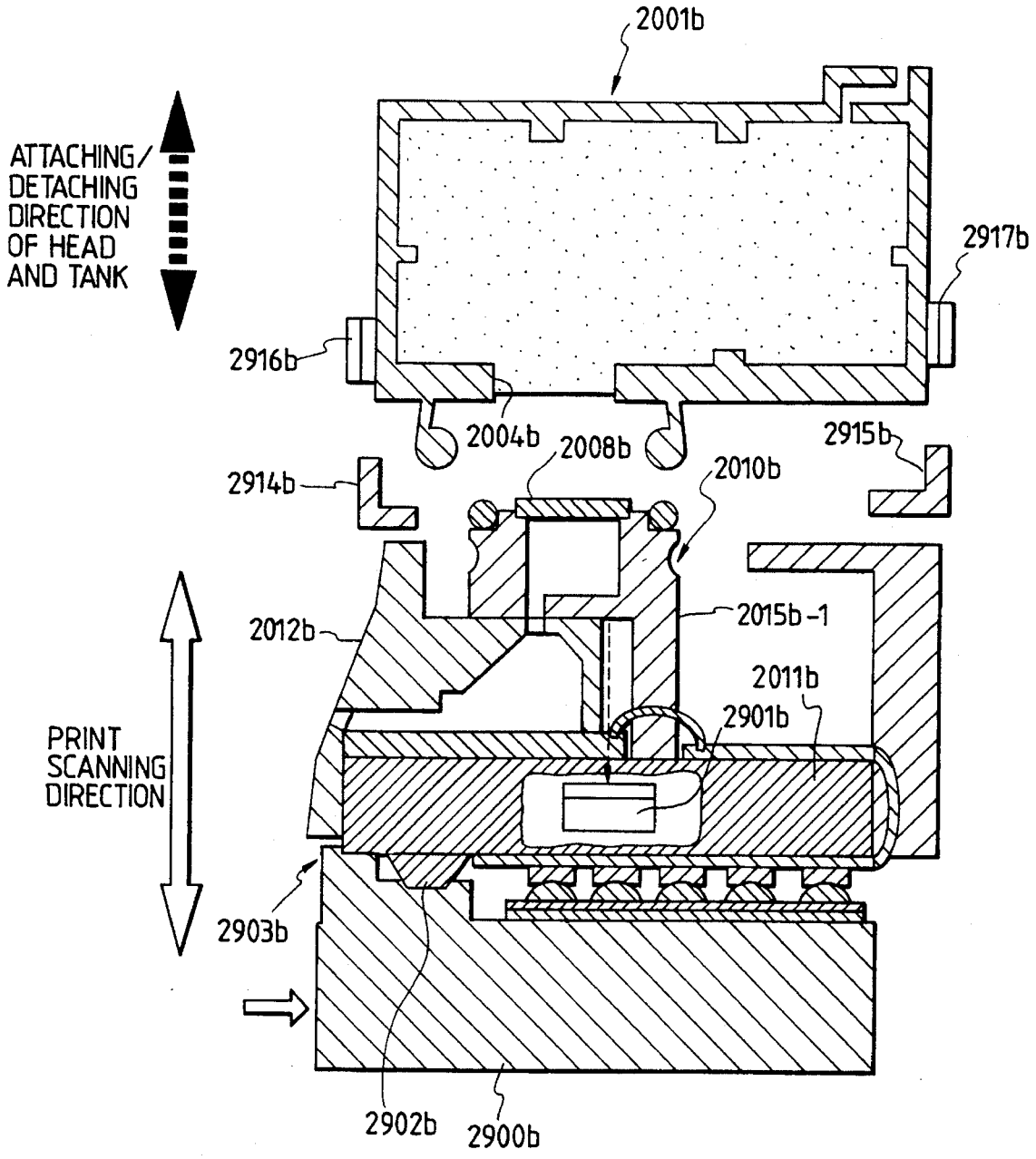
FIG. 34 is a schematically cross-sectional view illustrating a mounting sequence for a recording head and an exchangeable ink tank.

FIG. 34 illustrates the state where the recording head and replaceable ink tank are separated.

Figure 35:
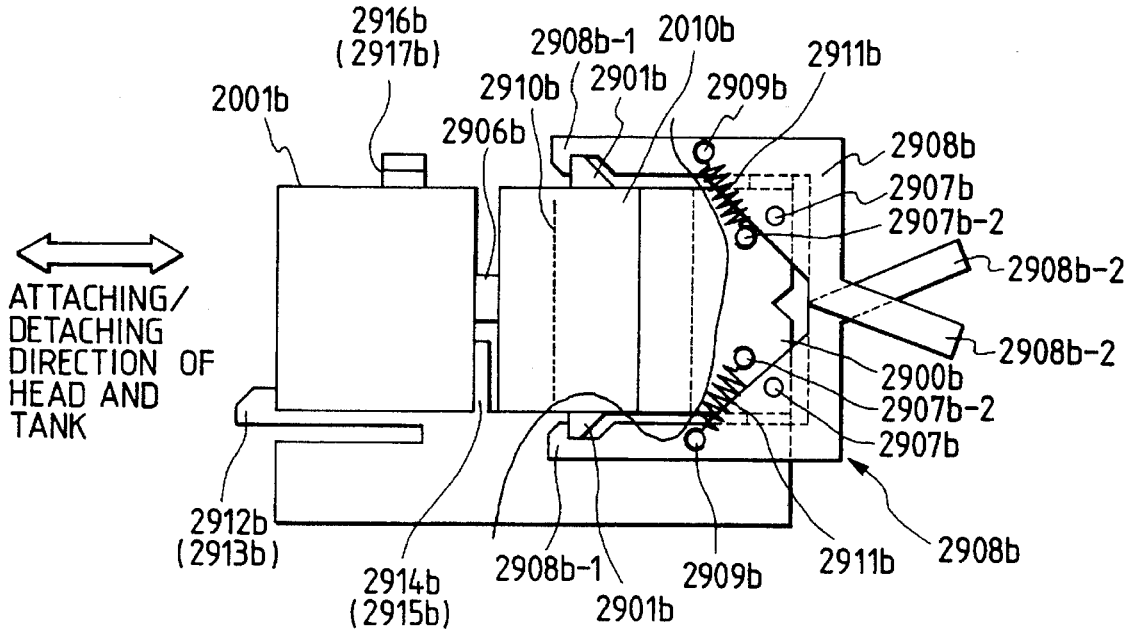
FIG. 35 is a partially sectional view illustrating the embodiment shown in FIG. 33 viewed from the direction in which ink is ejected.

FIG. 35 is a partially cross-sectional view illustrating the recording head and tank viewed in the direction indicated by a blank arrow B in FIG. 33, in which dowels 2907*b* are arranged on the side board 2900*b* of the carriage HC, and the pressure hooks 2908*b* are rotated with the dowels 2907*b* as pivots, respectively. At the leading ends 2908*b*-1 of the pressure hooks 2908*b*, nails are arranged to hold the pressure guides 2901*b* which are integrally formed with the head base plate 2011*b* of the recording head 2010*b*. Also, the dowels 2907*b* arranged on the side board 2900*b* and the pressure hook dowels 2909*b* are tensioned by tensioning spring coils 2911*b*, respectively. Hence, the recording head 2010*b* is electrically connected assuredly to the carriage HC on the side board 2900*b*. These recording head mounting pressure hooks 2908*b* are also provided beneath the recording head 2010*b* to press the recording head 2010*b* to the side board 2900*b* of the carriage from above and below stably.

In this respect, a reference numeral 2910*b* designate discharging ports (may be referred to nozzles in some cases) which eject ink, and 2908*b*-2, a notch used when the recording head 2010*b* is to be removed from the carriage. By pinching two parts of the notch, the leading ends 2908*b*-1 of the pressure hooks 2908*b* are released from the pressure guides 2901*b* of the recording head 2010*b*. Thus, the recording head 2010*b* is detached from the carriage HC.

FIGS. 33 and 35 are views illustrating the replaceable ink tank 2001*b* installed in the horizontal direction as in FIG. 34 when the entire status is such as described above. The replaceable ink tank 2001*b* is installed in the horizontal direction against the pressure exerted by a pair of tank side end nails 2912*b* and 2913*b*. Accordingly, when it is butted against a pair of carriage stoppers 2914*b* and 2915*b*, the tank side end nails 2912*b* and 2913*b* are restored to complete the installation of the replaceable ink tank 2001*b* thereby to fit it there. Also, the carriage front nail 2916*b* and carriage rear nail 2917*b* are those which prevent the replaceable ink tank 2001*b* from being detached upward.

Here, at the same time that the replaceable ink tank 2001*b* is mounted on the carriage, a resilient ring seal 2009*b* provided in the portion 2906*b* where the recording head 2010*b* and replaceable ink tank 2001*b* are coupled is deformed to connect them. As a result, no ink leakage will take place. Also, since the coupling portion is flexibly structured using resilient material, no compulsory force is exerted on the recording head 2010*b* when the replaceable ink tank 2001*b* is mounted on the carriage. There is no possibility that the positioning accuracy of the recording head 2010*b* to the carriage is not lowered.

Figure 36:
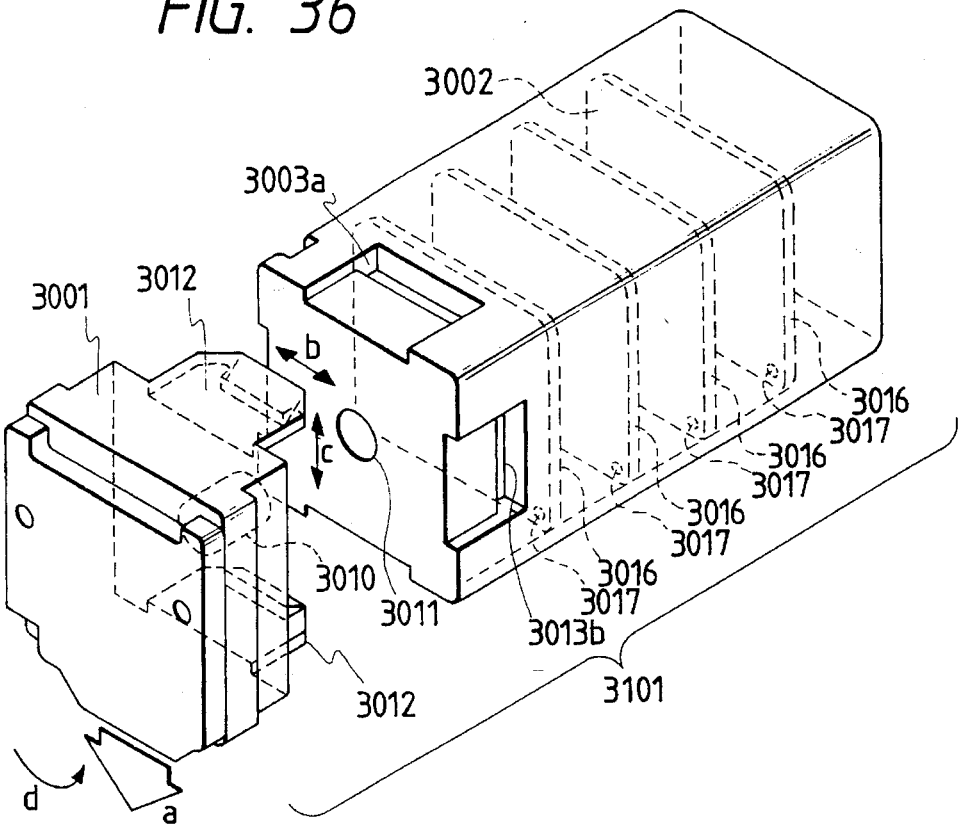
FIG. 36 is a schematically perspective view illustrating another embodiment.

FIG. 36 is a schematically perspective view illustrating the recording head and ink tank of an ink jet recording apparatus according to another embodiment. In FIG. 36, a reference numeral 3001 designates a recording head ejecting ink in accordance with electric signals; 3002, an ink tank (ink cartridge) containing ink to be supplied to the recording head 3001; 3010, an ink supply inlet (liquid passage connecting unit) which serves as a passage for supplying ink from the ink tank 3002 to the recording head 3001; 3011, an ink supply outlet (liquid passage connecting unit) to supply ink from the ink tank 3002 to the recording head 3001; 3012, coupling nails which guide and hold the recording head 3001 and ink tank 3002 when both of them are integrated; 3013*a* and 3013*b*, coupling nail guide grooves to engage with the coupling nails 3012; 3016, a plurality of tank inner walls to partition the interior of the ink tank 3002 into small chambers; and 3017, conductive holes opened on the tank inner walls 3016. With these elements, the head cartridge 3101 is structured.

Figure 37:
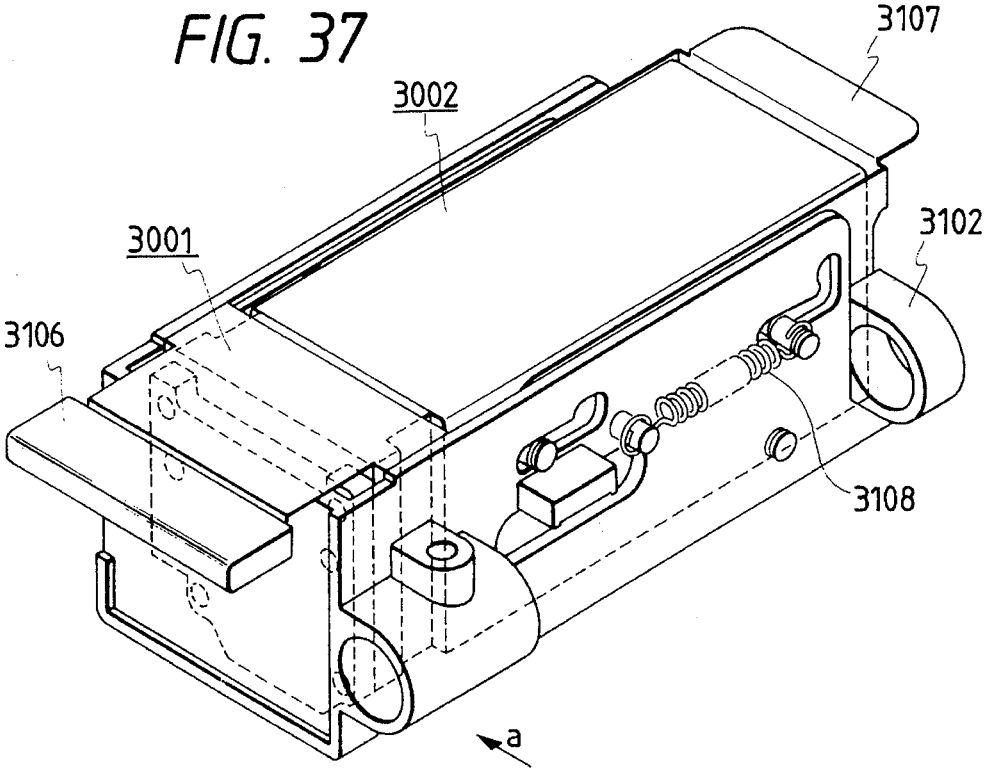
FIG. 37 is a schematically perspective view illustrating the state where the head cartridge shown in FIG. 36 is mounted on a carrier.

FIG. 37 is a schematically perspective view illustrating the state where the head cartridge 3101 shown in FIG. 36 is mounted on the carrier unit. In FIG. 37, a reference numeral 3102 designates a carrier (mounting unit) provided for a recording apparatus body which holds the recording head 3001 and ink tank 3002; 3106, a head lever to hold or release the recording head 3001; 3107, an ink tank lever to mount or demount the ink tank 3002; and 3108, a head fixing spring to fix the recording head 3001 to the carrier 3102. With these elements, the head unit and carrier unit of the recording apparatus are structured.

The above-mentioned recording head 3001 comprises a plurality of electrothermal transducers which generate thermal energy to be utilized for ejecting ink, and a substrate on which a driving circuit is formed to drive these transducers; discharging ports and liquid passages arranged on the substrate corresponding to each of the above-mentioned plural electrothermal transducers; and further, a laminated ceiling board constituting a common liquid chamber conductively connected to each of the liquid passages. Then, the recording head 3001 thus structured is mounted on the apparatus in such a manner that the discharging surface where the discharging ports are arranged is placed to face a recording medium. In the head cartridge 3101 shown in FIG. 36, the structure is arranged so that ink is ejected in the direction indicated by an arrow a.

The ink tank 3002 is arranged to refill ink consumed by recording while holding ink and supplying ink to the recording head 3001 appropriately. When this ink tank 3002 is present as a single body, the ink supply outlet 3011 is sealed with sealing means (not shown) so as not to allow any ink leakage. This sealing means is automatically or manually released when the ink tank is integrated with the recording head 3001 to make ink supply possible. Also, it may be possible to arrange a mechanism to induce air from the outside as the ink volume is being decreased by the ink consumption. Furthermore, the structure may be made to arrange a mechanism inside so as to maintain the pressure of ink to be supplied to the recording head 3001 slightly negative; thus making it possible to improve the printing quality as well as to prevent any ink leakage.

Also, the recording head 3001 and ink tank 3002 are used for the apparatus in a recording operation as a head cartridge 3101 wherein both of them are integrated. Now, the description will be made of a method for integrating both of them.

Figure 38:
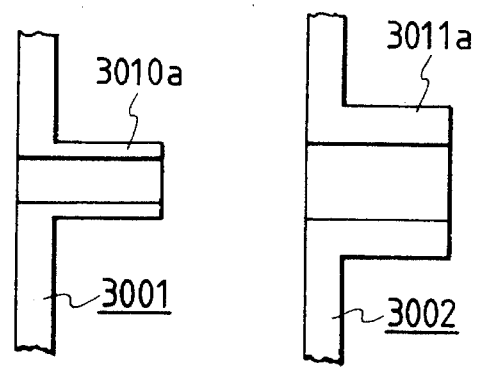
FIG. 38 is a cross-sectional view schematically showing the coupling portion of the ink passage shown in FIG. 36.

Fundamentally, the recording head 3001 and ink tank 3002 are integrated by coupling the ink supply inlet 3010 and ink supply outlet 3011. Therefore, this portion is carefully arranged to prevent ink leakage from or air intake into the ink passages. In the present invention, as shown in FIG. 38, a method is adopted to utilize the resiliency of a mold member for the purpose. In other words, the ink supply inlet hole 3010*a* and the ink supply outlet hole 3011*a* are formed cylindrically and then the inner diameter of the ink supply outlet 3011*a* is slight smaller than the outer diameter of the ink supply inlet hole 3010*a*. Thus, when the ink supply inlet hole 3010*a* is pressed into the ink supply outlet hole 3011*a*, these two holes are tightly integrated while being slightly deformed in the radial direction. Also, the coupling portion is not necessarily of a mold member, but it will suffice only if the material has a sealing capability. The other coupling methods will be described later.

In the integration of the recording head 3001 and ink tank 3002, while it is good enough to couple the ink supply inlet 3010 and ink supply outlet 3011 as described above, the coupling is intensified in the present embodiment by providing the coupling nails 3012 and coupling nail guiding grooves 3013*a* in order to prevent them from being disengaged simply due to any unexpected force that may be exerted when the head cartridge 3101 is handled or to facilitate the integration. In other words, the coupling nails 3012 formed integrally with the ink supply inlet 3010 by molding and capable of being resiliently deformed are provided with protrusions at the leading ends, and are fitted into the coupling nails guiding grooves 3013*a* while being resiliently deformed by the portions corresponding to the height of the protrusions. The coupling is completed when the protrusions of the coupling nails 3012 reach the deepest portions arranged in the rear sides of the coupling nail guiding grooves 3013*a*.

Further, the coupling nails 3012 serve as guides so as to allow the ink supply inlet 3010 and ink supply outlet 3011 to be easily joined when the recording head 3001 and ink tank 3002 are coupled. In other words, the coupling nails 3012 are made longer than the ink supply inlet 3010 so that the coupling nails 3012 are to be in contact with the ink tank 3002 before the ink supply inlet 3010 reaches the ink supply outlet 3011. Here, the leading ends of the coupling nails 3012 are cut off diagonally. This diagonally cut off portion serves as its guide in the direction indicated by an arrow b in FIG. 36 to facilitate the engagement with the nail guiding grooves 3013*d*. Also, the protrusions provided at the leading ends of the coupling nails 3012 are also cut off diagonally to promote an easier engagement by serving as its guide in the direction indicated by an arrow c in FIG. 36.

In this respect, while the coupling nails 3012 are provided on the recording head 3001 side, its position is not confined thereto. It may be possible to position them on the ink tank 3002 side or on both sides of the recording head 3001 and ink tank 3002.

Here, in the above-mentioned embodiment, the interior of the ink tank 3002 is separated into several small chambers by the inner walls 3016. The structure is arranged so that the small chambers themselves are connected through conductive holes 3017 provided in the vicinity of the bottom end of the inner walls 3016 of the ink tank 3002. In this case, some of the conductive holes 3017 must be filled with ink. Accordingly, it is necessary for the ink tank 3002 to have the end where the conductive holes 3017 are arranged at its bottom with respect to gravity (in the direction in which it is located in FIG. 36).

Therefore, if it is required to rotate the ink ejection direction a from the downward direction as shown in FIG. 36 to the direction indicated by an arrow d in FIG. 36, or to use the recording head for an apparatus wherein the advancing direction of its recording medium (not shown) is vertical and not horizontal, for example, or to place a recording apparatus itself vertically or horizontally for its use, the ink tank 3002 which is rotated together with the ink cartridge 3101 cannot satisfy the foregoing conditions, thus disabling its ink supply. In the present embodiment, therefore, a second coupling direction which is rotated approximately 90 degrees is arranged in addition to a first direction wherein the coupling nails 3012 and coupling nail guiding grooves 3013*a* are engaged. For this second coupling direction, the coupling nails 3012 are used in the same manner, but the coupling nail guiding groove 3013 engages with the other coupling nail guiding groove 3013*b*. The coupling method in this case is the same as the one used for the coupling in the first direction.

Also, since the positional relationship between the coupling nails 3012 and coupling nail guiding grooves 3013 is symmetrical in rotation with respect to the ink supply inlet 3010, the coupling is possible in a total of four directions, that is, two more directions at 90 degrees each further from the above-mentioned second coupling direction.

Figure 39A:
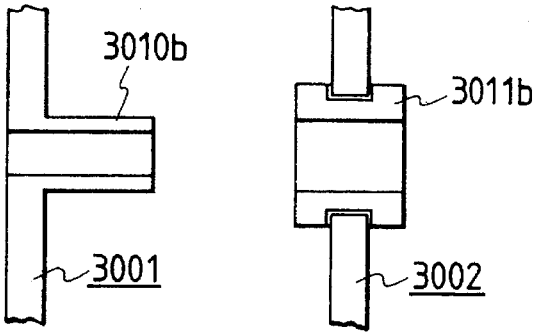
FIGS. 39A and 39B are cross-sectional views illustrating the structure of another embodiment.

FIG. 39 illustrates another embodiment to show the portion where the ink passages of the recording head 3001 and ink tank 3002 are coupled. FIG. 39A represents a case where the ink supply outlet 3011*b* is made of a resilient material such as rubber. Here, it is possible to make the inner diameter of the ink supply outlet 3011*b* smaller than the outer diameter of the ink supply inlet 3010*b*. Thus, the contactness between the ink supply inlet 3010*b* and ink supply outlet 3011*b* is improved when the recording head 3001 and ink tank 3002 are coupled. As a result, the sealing capability of the ink passages is enhanced. Also, a force required to deform the ink supply outlet 3011*b* can be small. The force required to effect the attachment and detachment of the recording head 3001 and ink tank 3002 can also be small.

Figure 39B:
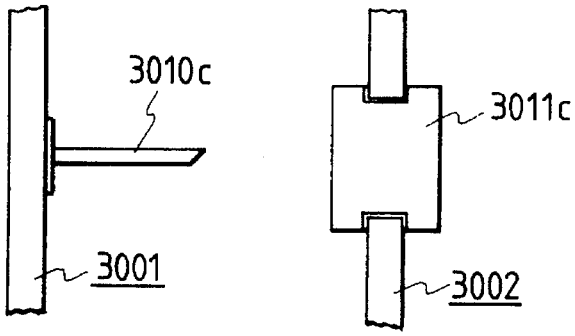

Also, FIG. 39B illustrates a case where the ink supply inlet 3010*c* is formed to be annular having an acute end, while the ink supply outlet 3011*c* is made of a resilient material such as rubber having no holes. When separated from the recording head 3001, the ink supply unit 3011*c* of the ink tank 3002 is in a blocked state. Therefore, there is no ink leakage from the ink supply unit 3011*c*. The ink tank 3002 can be handled excellently as a single body. Also, when the ink tank 3002 is coupled to the recording head 3001, the acute end of the ink supply inlet 3010*c* makes a hole in the ink supply outlet 3011*c* to provide an ink passage. The liquid passages can be coupled stably. A force required to attach or detach the ink tank 3002 can also be small.

Figure 40:
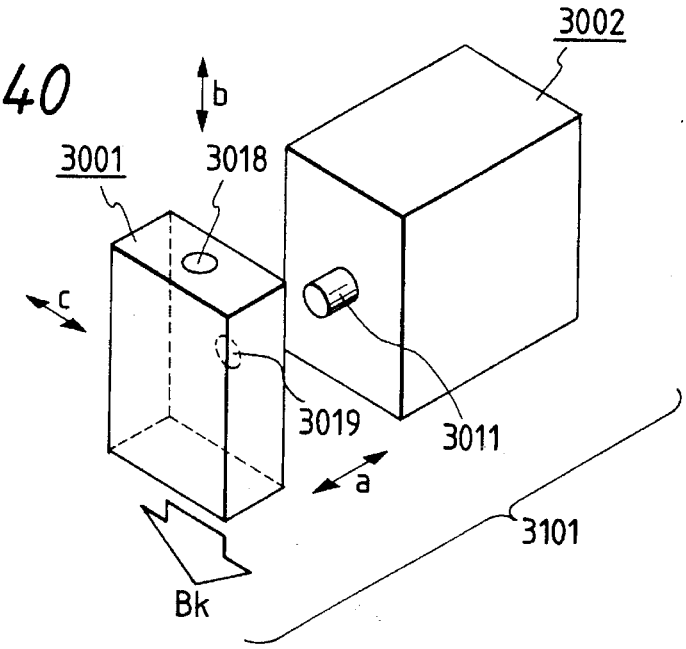
FIG. 40 is a schematically perspective view illustrating the structure of still another embodiment.

In the other embodiment described in FIG. 36, the mounting direction of the ink tank 3002 is of such a type that it is different only by the difference in angle in the axial direction, but irrespective of this, it may be possible to provide ink passages in a different position. FIG. 40 is a view schematically showing still another embodiment structured such as this to illustrate the direction in which the recording head 3001 and ink tank 3002 are coupled. In FIG. 40, a reference numeral 3018 designates a first ink supply inlet provided for the recording head 3001, and 3019, a second ink supply inlet arranged in a direction different from the first ink supply inlet 3018. A head cartridge 3101 comprises each of these elements. Here, the ink ejecting direction of the recording head 3001 is the one indicated by an arrow Bk in FIG. 40. As ink supply inlets to supply ink to the recording head 3001, the first ink supply inlet 3018 and second ink supply inlet 3019 are opened at angles of approximately 90 degrees to each other. These inlets are sealed if no ink supply outlets 3011 of the ink tank 3002 are installed. By a mechanism (not shown), these are released only when the ink supply outlet 3011 is mounted to form an ink passage. Therefore, when the ink tank 3002 is attached to either one of them, the other one is closed, and no air is mixed in the ink passage. Also, when the ink tanks are attached to both of them, ink can flow smoothly.

In this respect, unlike the embodiment described in FIG. 36, it is possible to use an ink tank which can supply ink without being affected by gravity as the ink tank 3002. Hence, in the present embodiment, it is also possible to attach the ink tank 3002 to the second ink supply inlet 3019 in the direction indicated by an arrow a. Also, the ink tank 3002 can be attached to the first ink inlet 3018 in the direction indicated by an arrow b in FIG. 40.

Also, if the scanning direction of the carrier 3102 is assumed to be in the direction indicated by an arrow a in FIG. 40 when the head cartridge 3101 is mounted on the carrier 3102, the ink tank 3002 which is attached to the second ink supply inlet 3019 is not protruded above the recording apparatus. Thus, the total height can be lowered. When the ink tank 3002 is attached to the first ink inlet 3018, it is possible to narrow the width of the carrier 3102. Thus, the total width of the recording apparatus can be narrowed. Further, in a case where another ink supply inlet is provided to allow the ink tank 3002 to be attached in the direction indicated by an arrow c in FIG. 40, the total width of the recording apparatus can also be narrowed.

As described above, with the structure which allows the coupling direction of the recording head 3001 and ink tank 3002 to be provided in two or more directions, it is possible to obtain an effect that with only one recording head 3001, the mode of head cartridge 3101 can be varied to meet many kinds of recording apparatuses thus enabling its versatility to be enhanced to provide a desirable efficiency.

Figure 41:
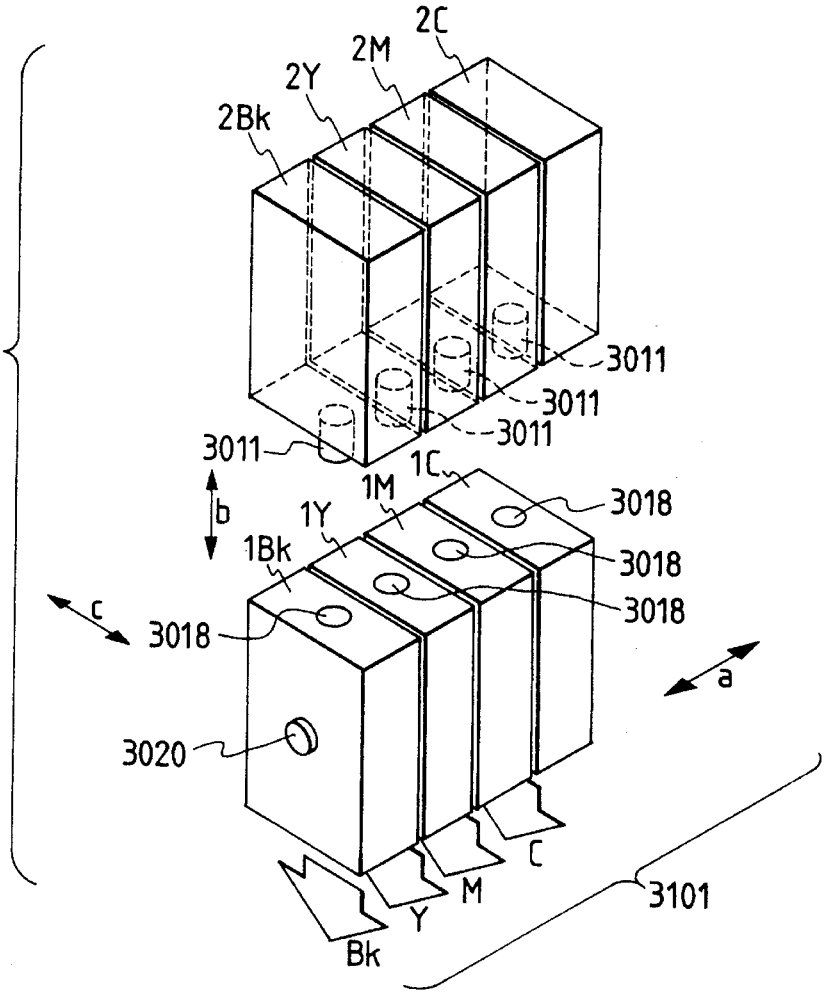
FIG. 41 is a schematically perspective view illustrating the structure of a further embodiment.

FIG. 41 is a perspective view illustrating the structure of a further embodiment according to the present invention. To be specific, the present embodiment is to constitute a color recording head by the utilization of the recording head 3001 in the embodiment described in conjunction with FIG. 40.

In FIG. 41, the recording head 3001 and ink tank 3002 comprise the recording heads 1BK, 1Y, 1M, and 1C which eject color ink materials of black (Bk), yellow (Y), magenta (M), and cyanogen (C), respectively, and ink tanks 2BK, 2Y, 2M, and 2C. The directions indicated by arrows in FIG. 41 represent those in which ink materials are ejected.

For the configuration of the above-mentioned recording head 3001, the same type of head used in the embodiment described in FIG. 40 can be used. For the structure of the liquid passage between the head and ink tank 3002, the first ink supply inlet 3018 is also usable. Here, in a case of heads for color recording, it is required to maintain the precision with which to position the recording heads themselves accurately. Therefore, a positioning protrusion 3020 is provided on the side of the recording head 1 opposite to a second ink supply inlet. This is coupled to the second ink supply inlet of the adjacent recording head. In this way, the positioning may be arranged.

Also, ink supply inlets can be arranged in the direction indicated by an arrow c in FIG. 41 and the ink tank 3002 may be connected in such a direction as matter of course.

As described above, the installation direction of the recording head 3001 and ink tank 3002 are made arrangeable in two directions or more and then a plurality of these recording heads 3001 and ink tanks 3002 are made usable. Hence, the following effects can be obtained:

It is possible to simply obtain a color recording cartridge by adding head cartridges for plural colors to the head cartridge 3101 which is usually used for a single color.

Also, by arranging the size of an ink tank 3002 for the use of a single color and that of the recording head 3001 which is added for recording in multicolor substantially the same, it is possible to perform a single color recording and a multicolor recording with a carrier which can be shared for the purpose. Hence, it becomes possible to provide a compact color recording apparatus at a low cost. Further, by utilizing the ink supply inlet for positioning, it is possible to accurately execute the positioning between heads for a high quality color recording.

Figure 42:
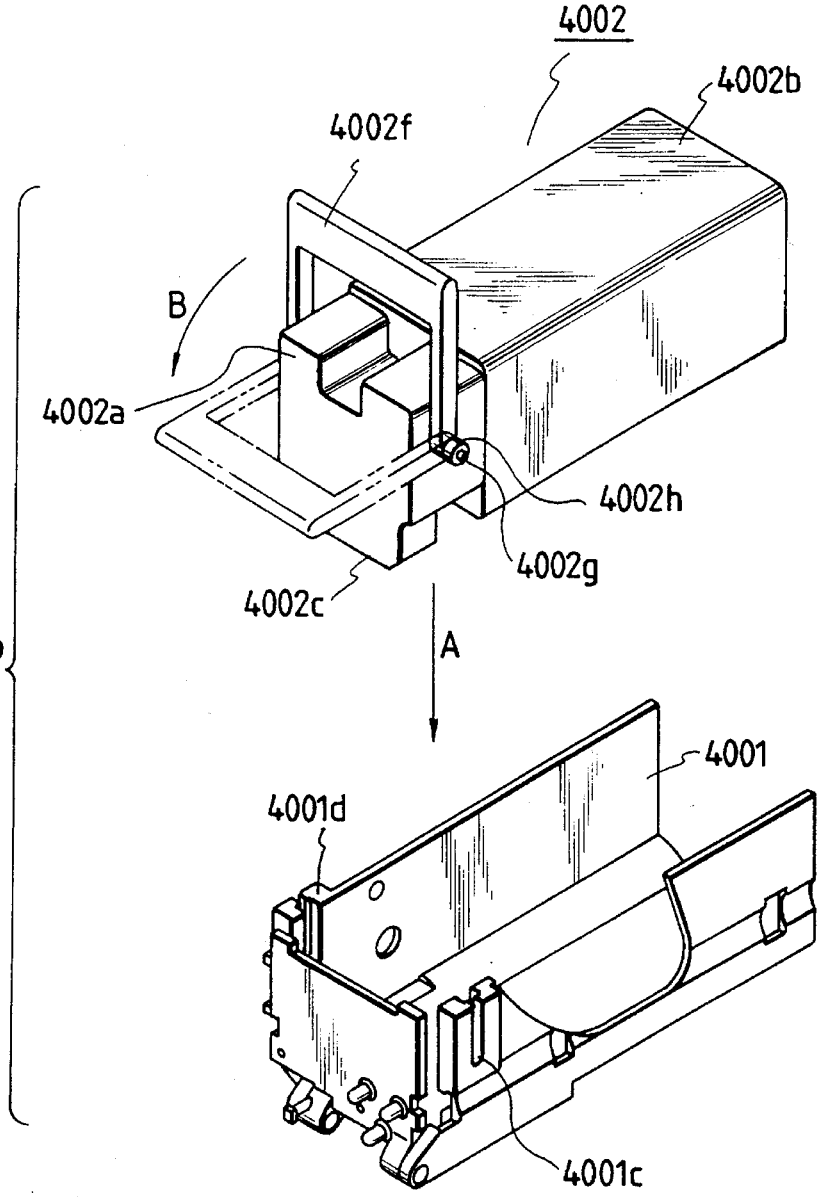
FIG. 42 is an exploded view illustrating a carrier and ink jet cartridge according to another embodiment.
Figure 43:
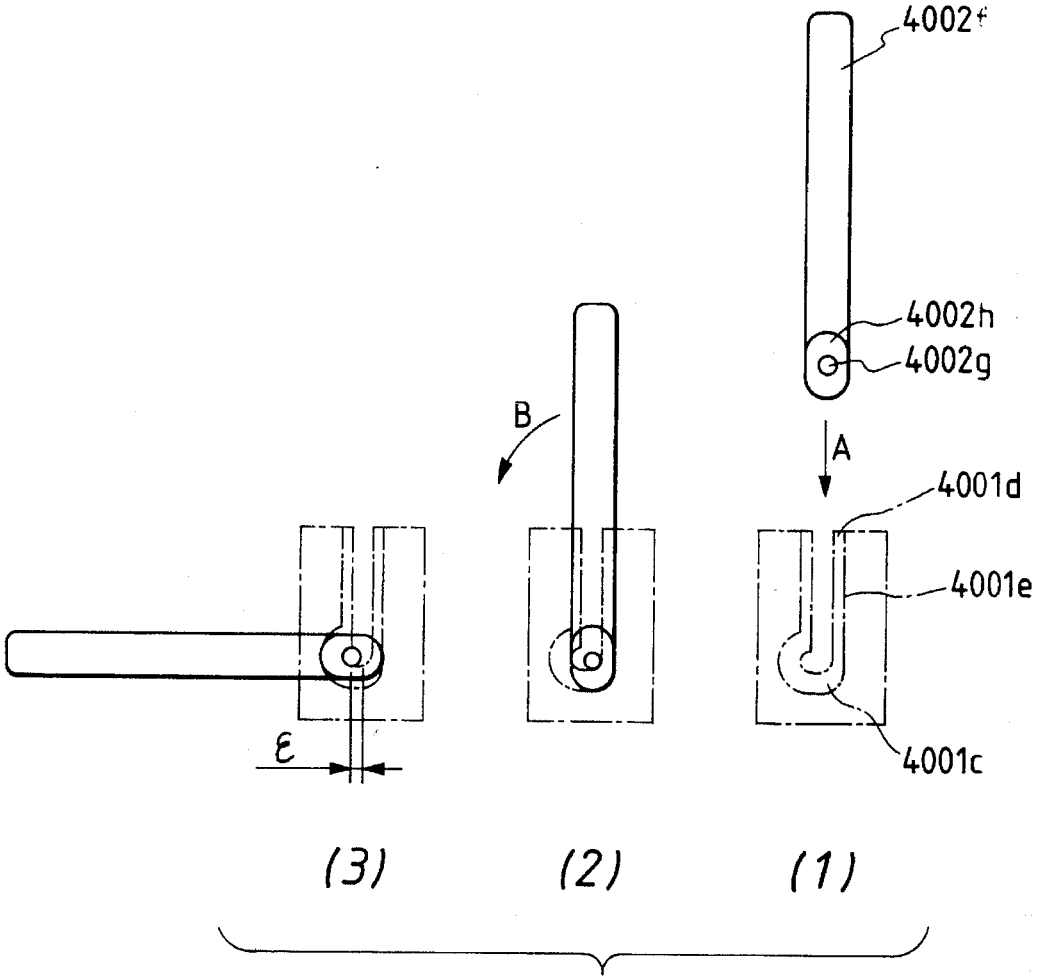
FIG. 43 is a view illustrating the operation of an ink jet cartridge mounting and holding lever.

FIG. 42 illustrates another embodiment. In a recording head 4002*a*, a detaching and holding lever 4002*f* is provided for an ink cartridge 4002. This lever 4002*f* can be held down with its mounting shaft 4002*g* as pivot. When an ink jet cartridge 4002 is installed in the carrier, the lever is raised in the direction opposite to the ink ejection direction as indicated by solid lines in FIG. 42 so as to install it in the direction indicated by an arrow A with the aforesaid mounting shaft 4002*g* being fitted along the carrier guide grooves 4001*c*. Then, as shown in FIG. 43, when the mounting shaft 4002*g* reaches the bottom of the guide grooves 4001*c* and becomes no longer shiftable, the lever 4002*f* is rotated in the direction B by 90 degrees to hold the carrier 4001. In practice, it is preferable to provide a click function or the like to improve the sense of operation. At this juncture, the elongated cylindrical portions 4002*h* provided for the lever 4002*f* are regulated by the walls 4001*e* of the positioning grooves 4001*d* and are shifted by $\epsilon$ to the left in FIG. 43. By this shift, the contact between the recording head 4002*a* and carrier 4001 is made to electrically connect them.

Figure 44:
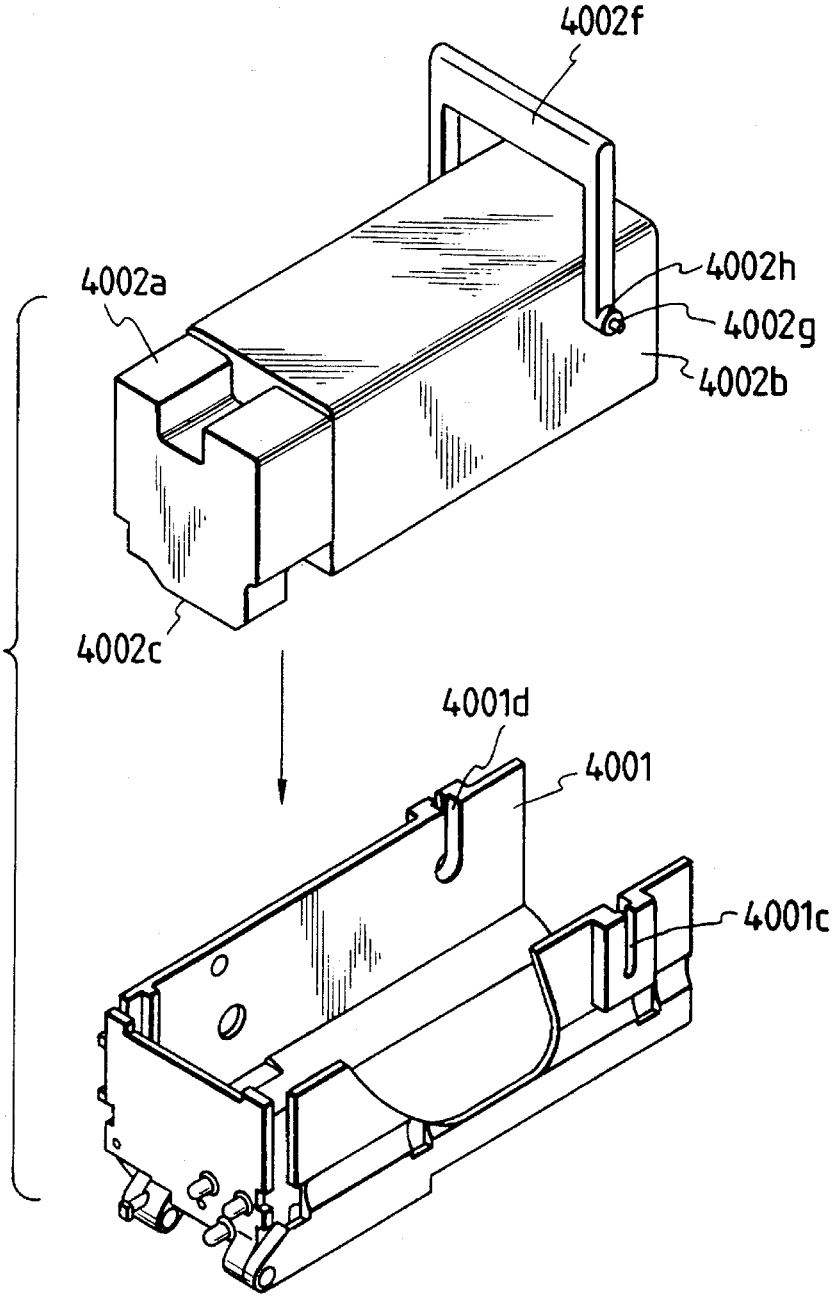
FIG. 44 is an exploded view illustrating a carriage and ink jet cartridge according to still another embodiment.

Now, still another embodiment will be described. As shown in FIG. 44, the present embodiment is such that the ink jet cartridge detaching and holding lever 4002*f* provided for the recording head 4002*a* in the foregoing embodiment described in conjunction with FIG. 42 is arranged on the ink tank 4002*c*. Any structures other than this are the same as the embodiment in FIG. 42.

Figure 45:
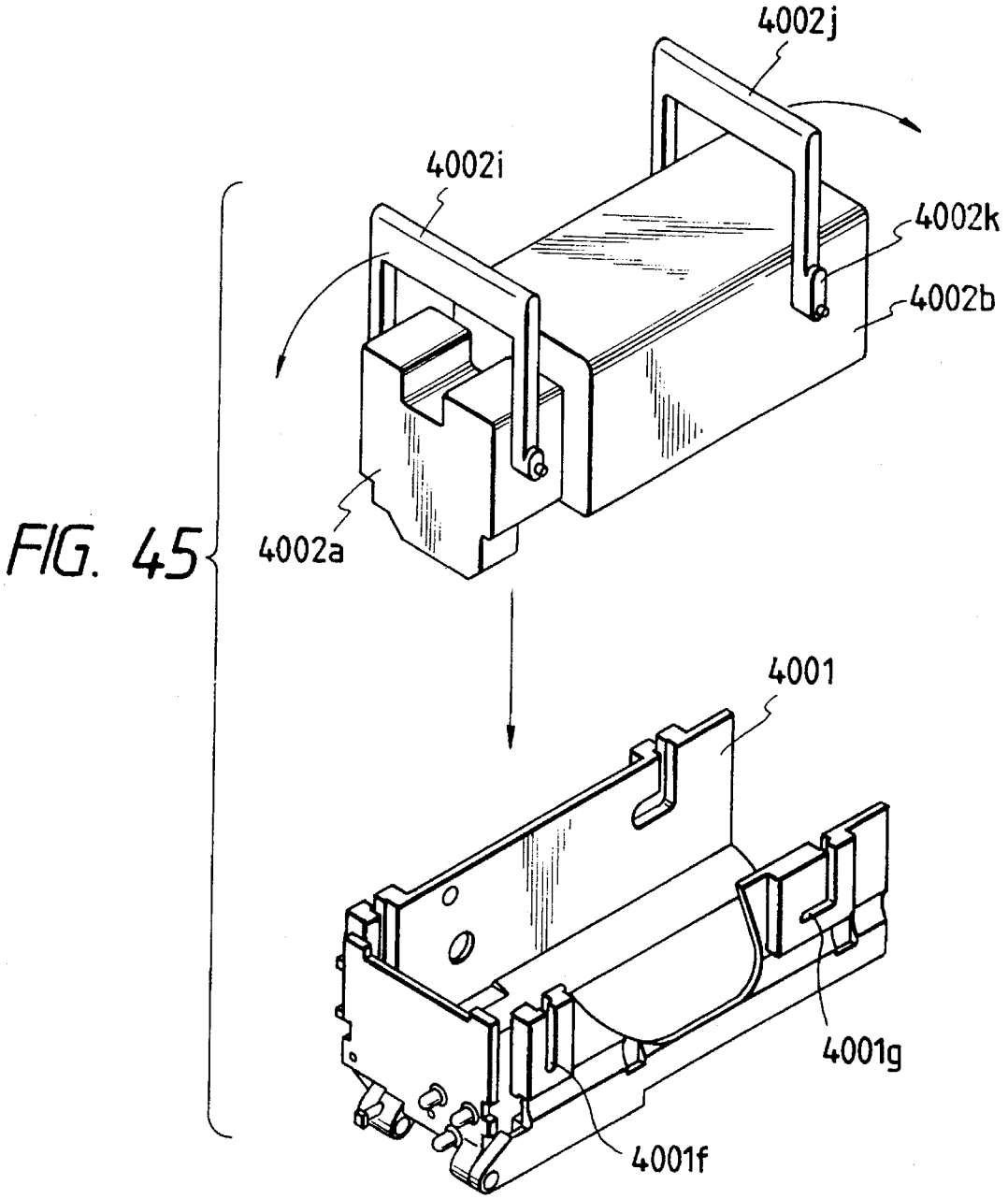
FIG. 45 is an exploded view illustrating a carriage and ink jet cartridge according to a further embodiment.
Figure 46:
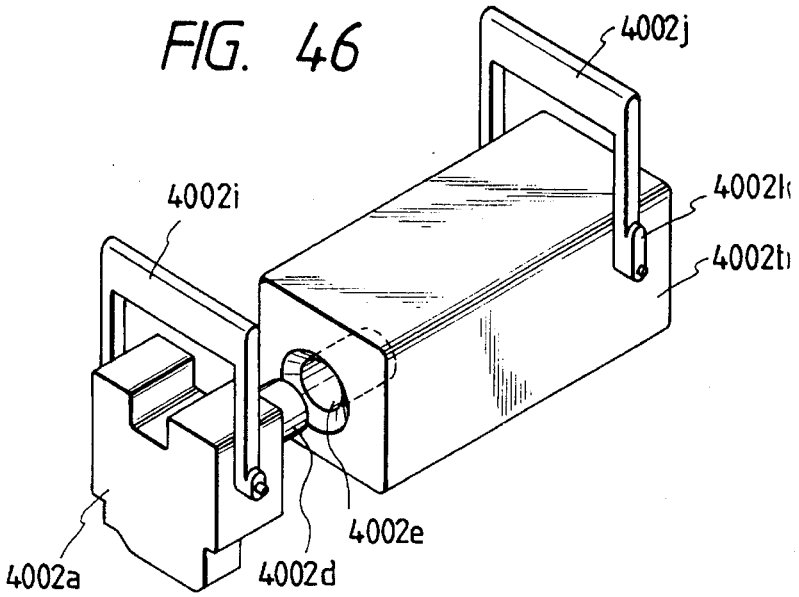
FIG. 46 is an exploded view illustrating the ink jet cartridge shown in FIG. 45.

Subsequently, still another embodiment will be described. As shown in FIG. 45, the present embodiment is applicable to the structure wherein the recording head 4002*a* and ink tank 4002*b* are separable. In the present embodiment, the elongated cylindrical portions 4002*k* of the ink tank lever 4002*j* are made larger. Accordingly, the shiftable amount $\epsilon$ is also made larger by that much. As shown in FIG. 46, this is needed to insert the connecting rod 4002*d* of the recording head 4002*a* into the connecting hole 4002*e* of the ink tank 4002*b*.

Figure 47:
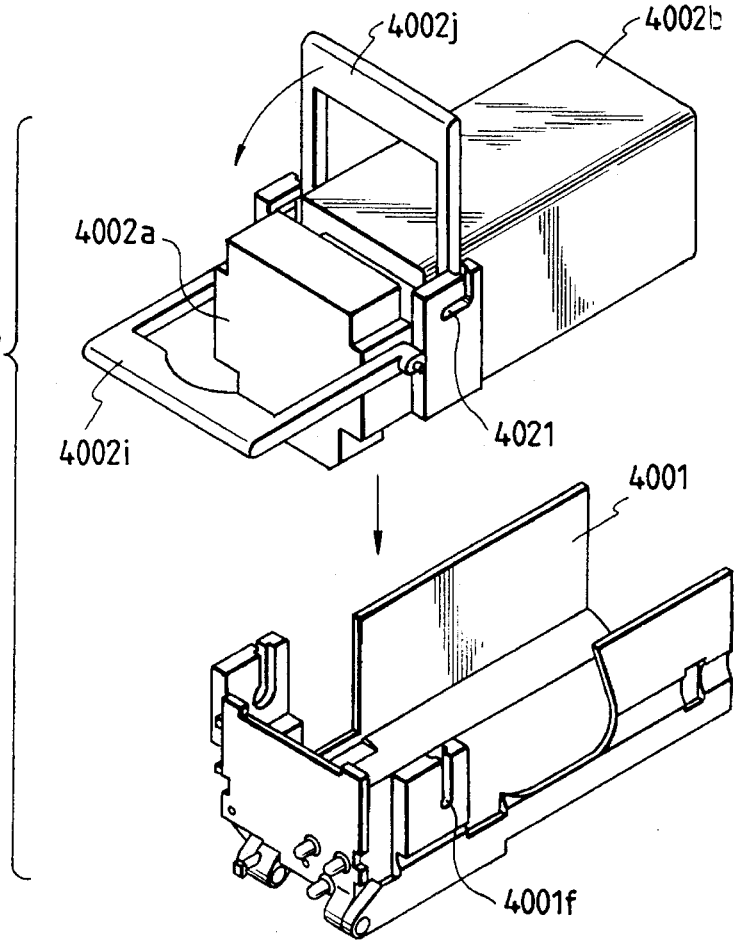
FIG. 47 is an exploded view illustrating a carrier and ink jet cartridge according still a further embodiment.

Now, still another embodiment will be described. As shown in FIG. 47, the present embodiment is a variation of the embodiment described in conjunction with FIG. 45. Its structure is arranged to hold the ink tank 4002*b* by the recording head 4002*a*. The guide grooves for the ink tank 4002*b* are provided on the recording head 4002*a* (4021) while the guide grooves for the recording head 4002*a* are provided on the carrier (4001*f*). In the present embodiment, the ink tank 4002*b* can be replaced independently by the ink tank lever 4002*j*, but the recording head 4002*a* cannot be replaced independently. It must be replaced in the mode of the ink jet cartridge while holding the ink tank 4002*b*.

With a structure such as this, the replacement can be made with only one operation whereas in the prior art the operation should be carried out twice when the recording head 4002*a* is replaced, that is, at first, the ink tank 4002*b* must be removed before the removal of the recording head 4002*a*.

Figure 48:
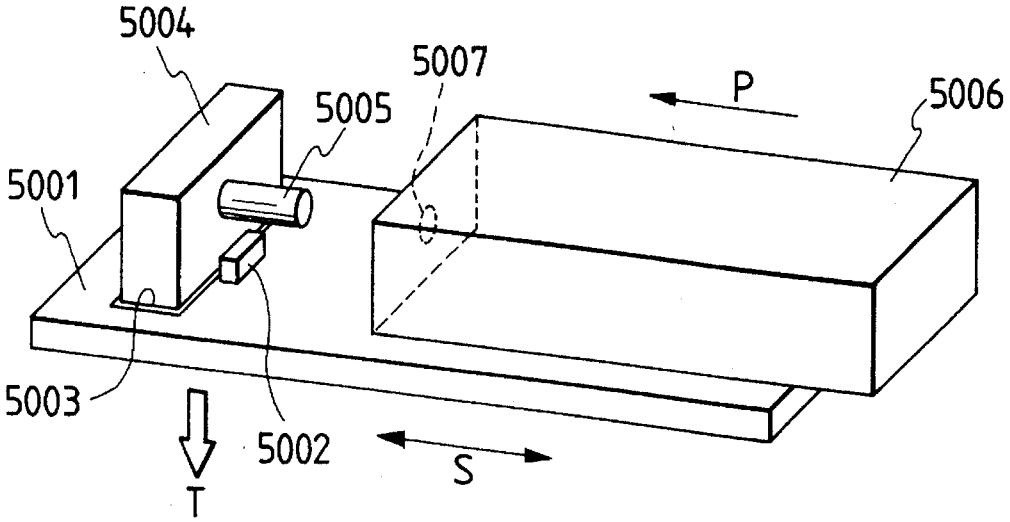
FIG. 48 is a schematically perspective view illustrating a carriage before an ink tank is mounted.
Figure 49:
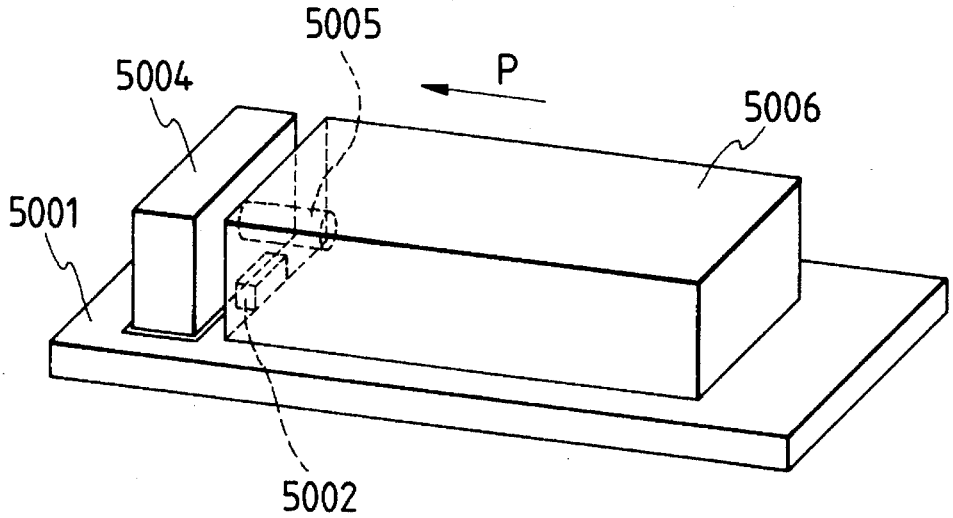
FIG. 49 is a schematically perspective view illustrating the carriage after the ink tank is mounted.

Now, FIGS. 48 and 49 illustrate another embodiment. FIG. 48 is a schematically perspective view showing a state before an ink tank is attached to a recording head. FIG. 49 is a schematically perspective view showing a state after the ink tank is attached to the recording head.

In FIGS. 48 and 49, a reference numeral 5006 designates an ink tank containing ink to supply ink to a recording head 5004 from the nozzle 5005 of the recording head 5004 through a hole 5007 provided for the ink tank 5006. Also, the recording head 5004 is coupled detachably to a hole 5003 of a carriage 5001 by a means which is not shown. Here, the scanning directions of the carriage 5001 are such as indicated by an arrow S in FIG. 48. The direction in which ink is ejected from the recording head 5004 to a recording medium is such as indicated by an arrow T in FIG. 48.

An operator of a recording apparatus removes an empty ink tank 5006 when it is known that ink in the ink tank 5006 is being exhausted and installs an ink tank 5006 containing ink on the recording head 5004.

In such a case, the ink tank 5006 is shifted from the position in FIG. 48 in the direction indicated by an arrow P in FIG. 48 to allow the nozzles 5005 of the recording head 5004 to be coupled to the hole 5007 of the ink tank 5006. At this juncture, the ink tank 5006 engages with a stopper 5002 of the carriage 5001 before it is butted against the recording head 5004 (FIG. 49).

With the provision of the stopper 5002 on the carriage 5001 in this way, the ink tank 5006 is allowed to engage with the stopper 5002 of the carriage 5001 before butting the recording head 5004 even if an excessive force is given to the ink tank 5006 when the ink tank 5006 is installed. Therefore, there is no possibility that the recording head 5004 is damaged.

Figure 50:
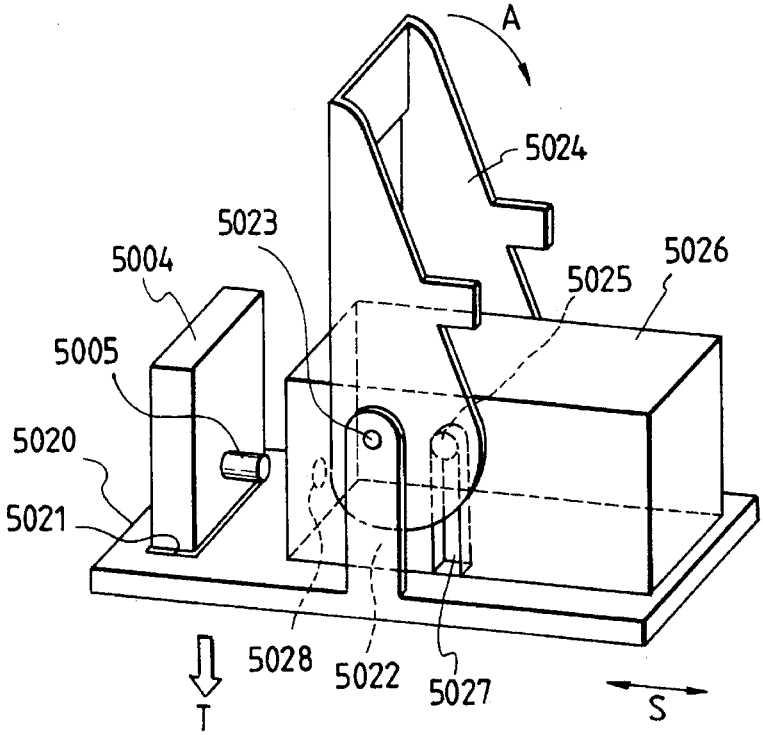
FIG. 50 is a schematically perspective view illustrating a carriage before an ink tank is mounted.
Figure 51:
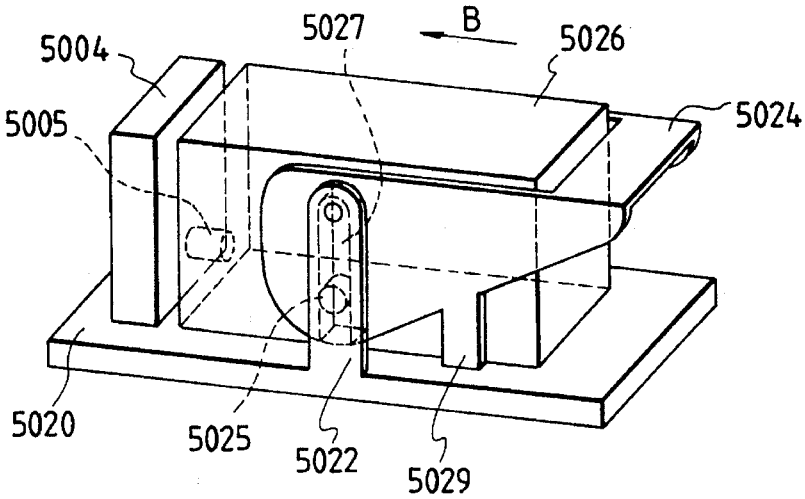
FIG. 51 is a schematically perspective view illustrating the carriage after the ink tank is mounted.

FIGS. 50 and 51 illustrate another embodiment. FIG. 50 a schematically perspective view showing a state before an ink tank is installed on a recording head. FIG. 51 is a schematically perspective view showing a state after the ink tank is installed on the recording head.

In FIGS. 50 and 51, a reference numeral 5026 designates an ink tank containing ink to supply it from the ink supply nozzle 5005 of a recording head 5004 to the recording head 5004 through a hole 5028 provided for the ink tank 5026. Also, the recording head 5004 is detachably coupled to the hole 5021 of a carriage 5020 by a means which is not shown. Here, the scanning directions of the carriage 5020 are such as indicated by an arrow S while the ink ejection direction from the recording head 5004 to a recording medium is such as indicated by an arrow T. A reference numeral 5027 designates ink tank installation grooves provided on the ink tank 5026, which engage with the bosses 5025 arranged on a carriage lever 5024 installed to the upper holes 5023 of arms 5022 provided on both sides of the carriage 5020.

Figure 52:
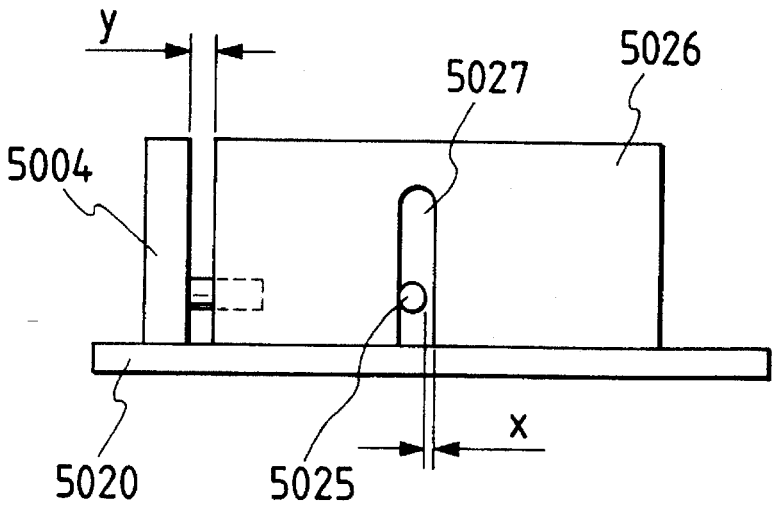
FIG. 52 is a schematic view illustrating the positional relations between an recording head, ink tank groove, and the boss of a carriage lever.

An operator raises the carriage lever 5024 to install the ink tank 5026 so that the grooves 5027 of the ink tank 5026 engage with the bosses 5025 when installing it on the recording head 5004 (FIG. 50). Then, the carriage lever 5024 is swung down in the direction indicated by an arrow A. Thus, the ink tank 5026 is caused to be shifted in the direction (indicated by an arrow B) approaching the recording head 5004. The ink supply nozzle 5005 of the recording head 5004 and the hole 5028 of the ink tank 5026 are coupled (FIG. 51). In this case, even if an operator gives an excessive force to the carriage lever 5024, a stopper 5029 arranged on the carriage lever 5024 is caused to butt the carriage 5020 and the ink tank 5026 can no longer approach the recording head 5004. Here, FIG. 52 illustrates the recording head 5004 in the embodiment described in FIG. 50 and the positional relationship between the grooves 5027 of the ink tank 5026 and the bosses 5025 of the carriage lever 5024. Now, even if an operator erroneously presses the ink tank 5026 in the direction approaching the recording head 5004, the ink tank 5026 will not push the recording head 5004 because as shown in FIG. 52 a space y between the recording head 5004 and ink tank 5026 is greater than a space x between the bosses 5025 and grooves 5027 to maintain a relationship (y>x).

With the structure as described above, even when an excessive force is added to the ink tank 5026, there is no possibility that the recording head 5004 is damaged.

Also, in the present embodiment, the bosses 5025 are arranged on the carriage lever 5024, but it is not necessarily to configure them to be boss type only if some protrusions can be provided instead.

Figure 53:
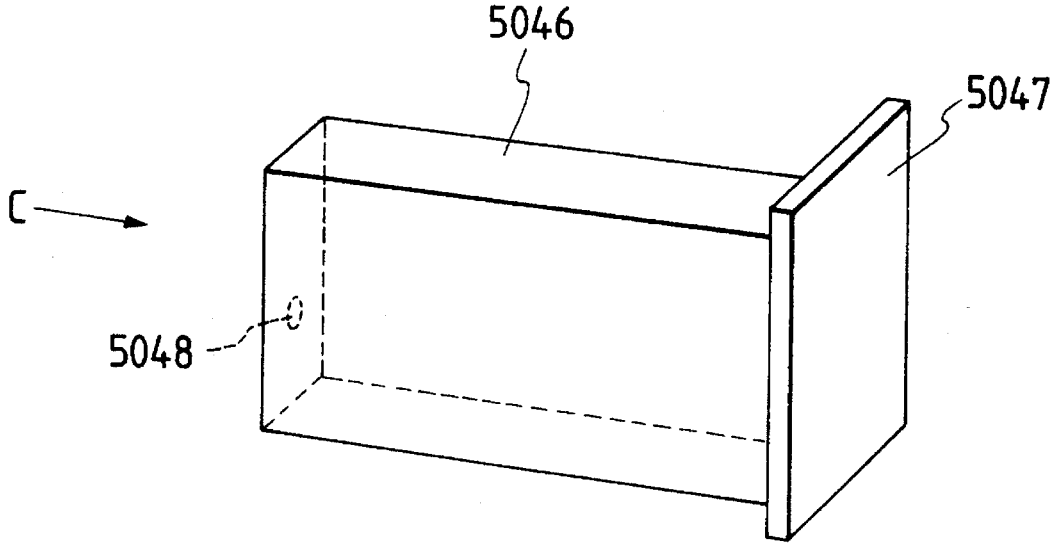
FIG. 53 is a schematically perspective view illustrating an ink tank.
Figure 54:
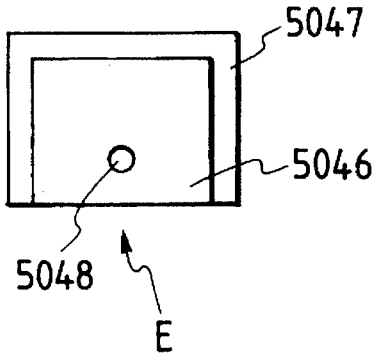
FIG. 54 is a side view schematically illustrating an ink tank.
Figure 55:
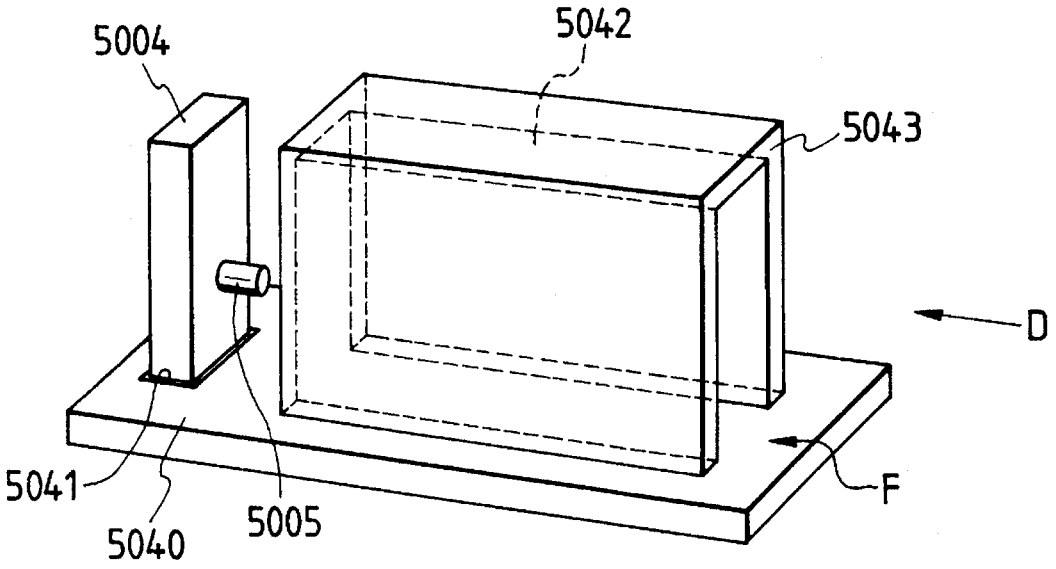
FIG. 55 is a schematically perspective view illustrating a carriage before an ink tank is mounted.
Figure 56:
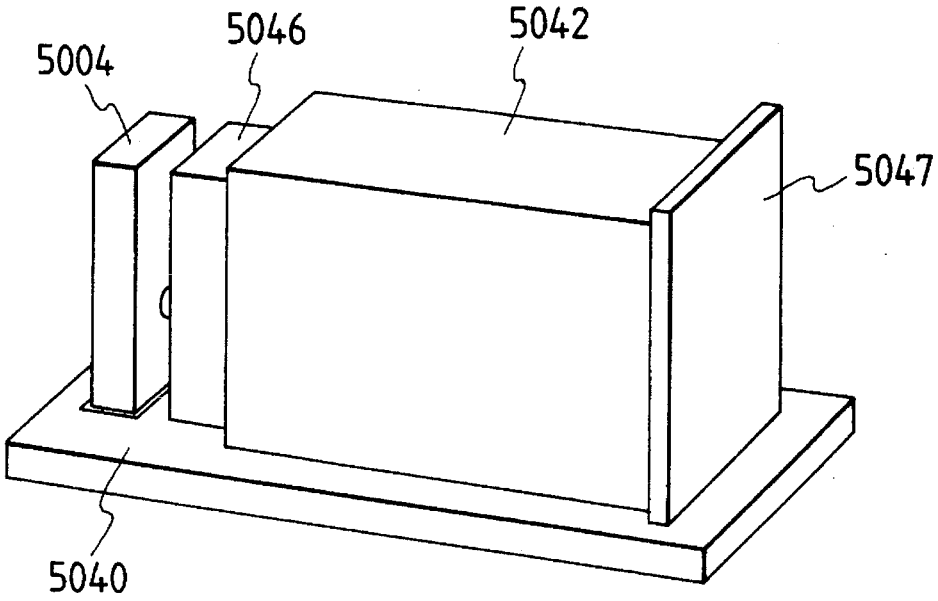
FIG. 56 is a schematically perspective view illustrating the carriage after the ink tank is mounted.

FIGS. 53 to 56 illustrate still another embodiment. FIG. 53 shows schematically an ink tank itself. FIG. 54 is a side view of the ink tank viewed in the direction indicated by an arrow C in FIG. 53. FIG. 55 is a schematically perspective view illustrating the state where the recording head is installed on a carriage before the ink tank is mounted on the carriage. FIG. 56 is a schematically perspective view illustrating the state where the ink tank is attached to the recording head installed on the carriage.

In FIGS. 53, 54, and 55, a reference numeral 5046 designates an ink tank containing ink in it. Ink is supplied to the recording head 5004 from the ink supply nozzle 5005 of the recording head 5004 through the hole 5048 of the ink tank 5046. Also, the recording head 5004 is detachable coupled to the hole 5041 of the carriage 5040 by a means which is not shown. A reference numeral 5042 designates a guide provided to guide the carriage 5040 for the ink tank installation, and also 5047, a stopper rib provided for the ink tank 5046.

An operator inserts the ink tank 5046 into the guide 5042 of the carriage 5040 from the hole 5048 in the direction indicated by an arrow D in FIG. 55 so as to allow the direction (E) of the ink tank 5046 where no rib 5047 is provided to be matched with the F portion of the carriage 5040 when the ink tank 5046 is attached to the recording head 5004. The ink tank is inserted until the rib 5047 of the ink tank 5046 butts the edge 5043 of the guide 5042. Thus, the ink supply nozzle 5005 of the recording head 5004 and the hole 5048 of the ink tank 5046 are coupled to complete the installation of the ink tank 5046 (FIG. 56).

By providing the stopper rib 5047 for the ink tank 5046 as described above, there is no possibility that the recording head 5004 is damaged even when the recording head 5004 is pushed due to an excessive force given to the ink tank 5046.

Figure 57:
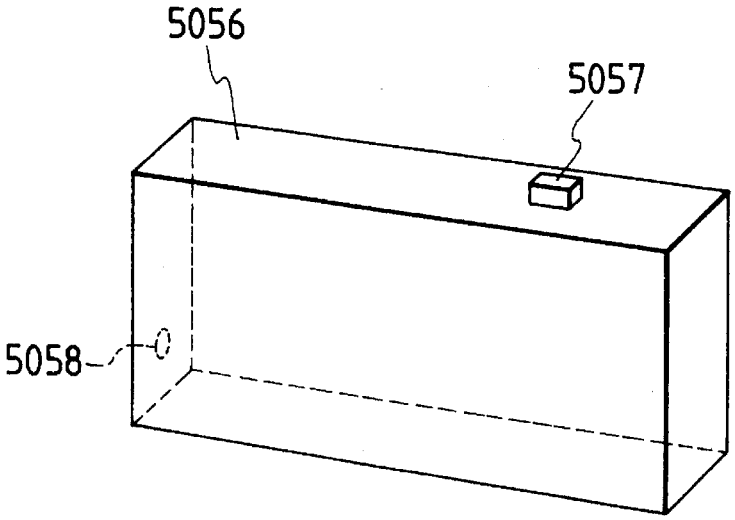
FIG. 57 is a schematically perspective view illustrating an ink tank.
Figure 58:
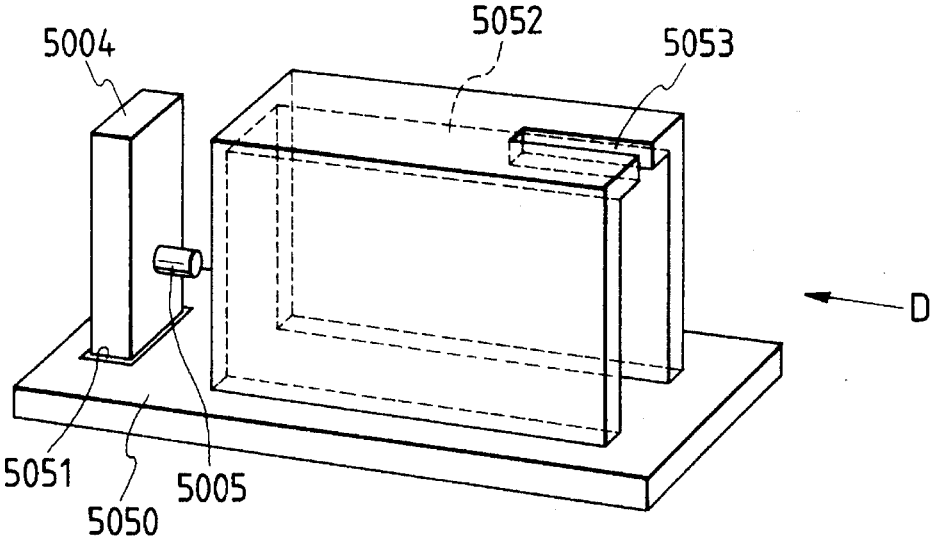
FIG. 58 is a schematically perspective view illustrating a carriage before an ink tank is mounted.
Figure 59:
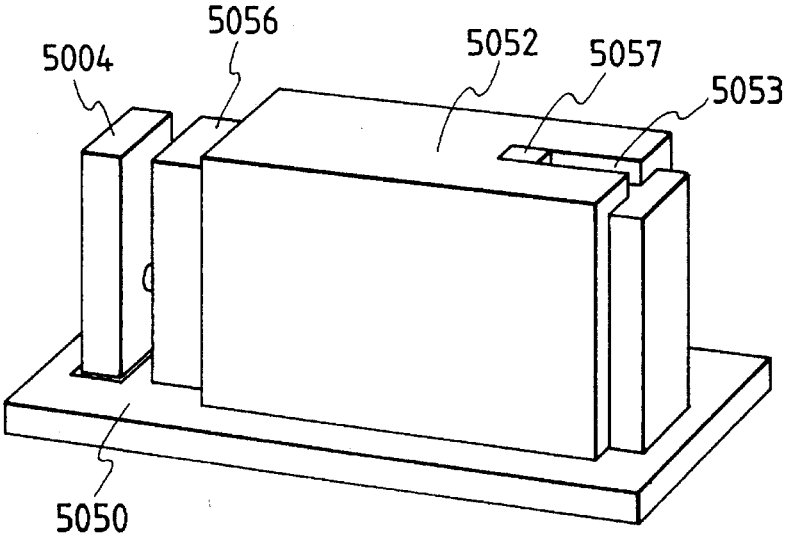
FIG. 59 is a schematically perspective view illustrating the carriage after the ink tank is mounted.

FIGS. 57 to 59 illustrate still a further embodiment. FIG. 57 is a schematically perspective view showing an ink tank itself. FIG. 58 is a schematically perspective view showing the state where a recording head is mounted on a carriage before the ink tank is installed on the carriage. FIG. 59 is a schematic perspective view showing the state where the ink tank is attached to the recording head installed on the carriage.

In FIGS. 57 and 58, a reference numeral 5056 designates an ink tank containing ink in it. Ink is supplied to the recording head 5004 form the ink supply nozzle 5005 of the recording head 5004 through the hole 5058 of the ink tank 5056. Also, the recording head 5004 is detachably coupled to the hole 5051 of the carriage 5050 by means which is not shown. A reference numeral 5052 designates a guide provided for the carriage for the installation of the ink tank, and also, 5057, a stopper provided for the ink tank 5056, which engages with the groove 5053 of the guide 5052.

An operator inserts the ink tank 5026 into the guide 5052 of the carriage 5050 from the hole 5058 in the direction indicated by an arrow D in FIG. 58 so as to allow the protrusion 5057 of the ink tank 5056 and the groove 5053 of the carriage 5050 to be matched when the ink tank 5056 is attached to the recording head 5004. The ink tank is inserted until the protrusion 5057 butts the deepest portion of the groove 5053. Thus, the ink supply nozzle 5005 of the recording head 5004 and the hole 5058 of the ink tank 5056 are coupled to complete the installation of the ink tank 5056 (FIG. 59).

By providing the stopper protrusion 5057 of the ink tank 5056 as well as the groove 5053 on the guide 5052 of the carriage 5050 as described above, there is no possibility that the recording head 5004 is damaged even if the recording head 5004 is pushed by an excessive force added to the ink tank 5056.

Figure 60A:
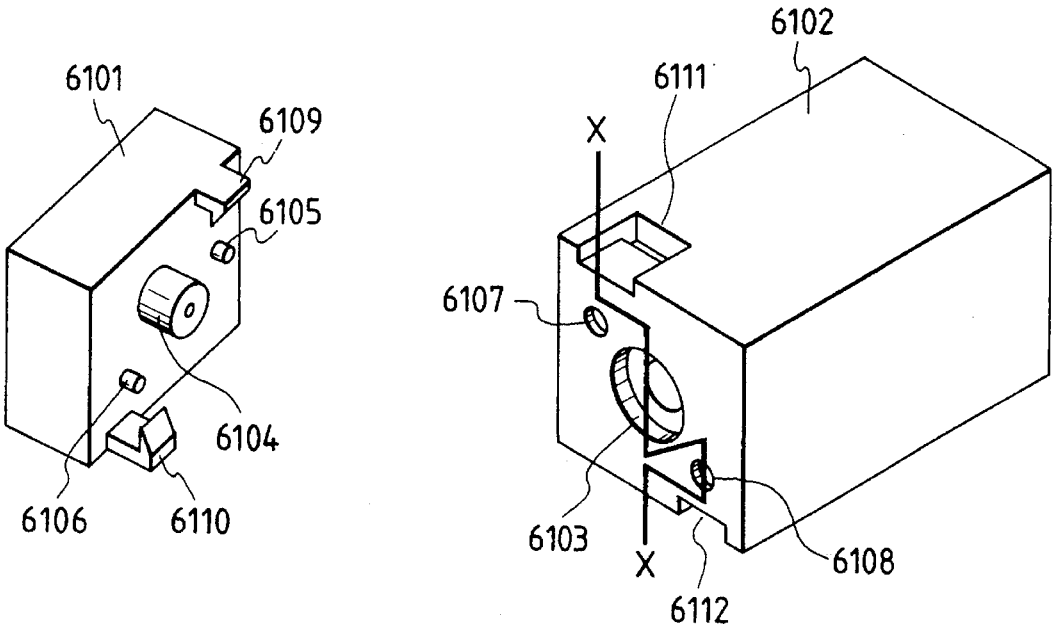
FIGS. 60A and 60B are schematic views illustrating another embodiment.
Figure 60B:
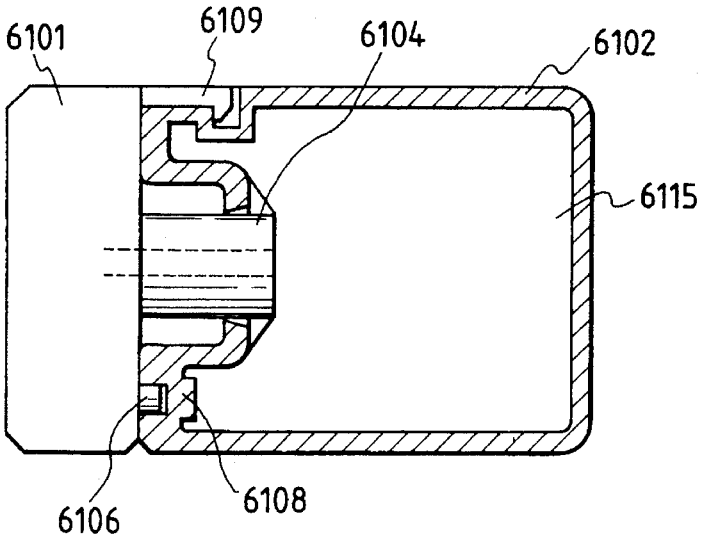

FIGS. 60A and 60B illustrate another embodiment. In an ink jet head 6101, an ink supply barrel 6104 serves as ink supply means. This shows a cylindrical outer appearance, which can be fitted into an ink supply outlet 6103, a recess provided for the ink tank 6102, with a desirable tightness. However, the interrelated positional relationship in coupling the ink jet head 6101 and ink tank 6102 is not determined only by ink supply means 6104 and the ink supply outlet 6103. The positioning is perfectly made three dimensionally further by fitting positioning pins 6105 and 6106 provided for the ink jet head 6101 into the positioning holes 6107 and 6108 provided for the ink tank 6102 as well as by allowing the members 6109 and 6110 which block detachment provided for the ink jet head 6101 to engage with the recesses 6111 and 6112 provided for the ink tank 6102. As shown in FIGS. 60A and 60B, it is clear that the positioning means for coupling the ink Jet head and ink tank is not dependent of ink supply means.

In the ink jet head 6101, the positions where the positioning pins 6105 and 6106 are arranged are not particularly conditioned. However, it is preferable to set them as far away as possible from the ink supply means in order to hinder its effects and to enhance the positioning accuracy. It is good enough to select convenient positions on the surface opposite to where ink jet head 6101 and ink tank 6102 are coupled. The selection of the position where the detachment blocking members are arranged requires a consideration for an easier releasing of the coupling in addition to the same views as described above. The positioning pins and detachment blocking members shown in FIGS. 60A and 60B are merely one embodiment, respectively, and are not intended to be confined thereto.

The configurations of the ink supply barrel 6104 and ink supply outlet 6103 are not necessarily the constituents of the present invention, and can be selected arbitrarily. It is preferable, however, to form a cylindrical protrusion and an opposing recess from the viewpoint of preventing ink leakage.

FIG. 60B is a cross-sectional view taken along line X—X (shown in the ink tank 6102) after the ink cartridge 6101 and ink tank 6102 are coupled and illustrates the coupling states of positioning means 6106 and 6108 arranged on both members, respectively, and of the detachment blocking members 6109 and 6111. In this respect, a reference numeral 6115 designates an ink chamber.

Figure 61:
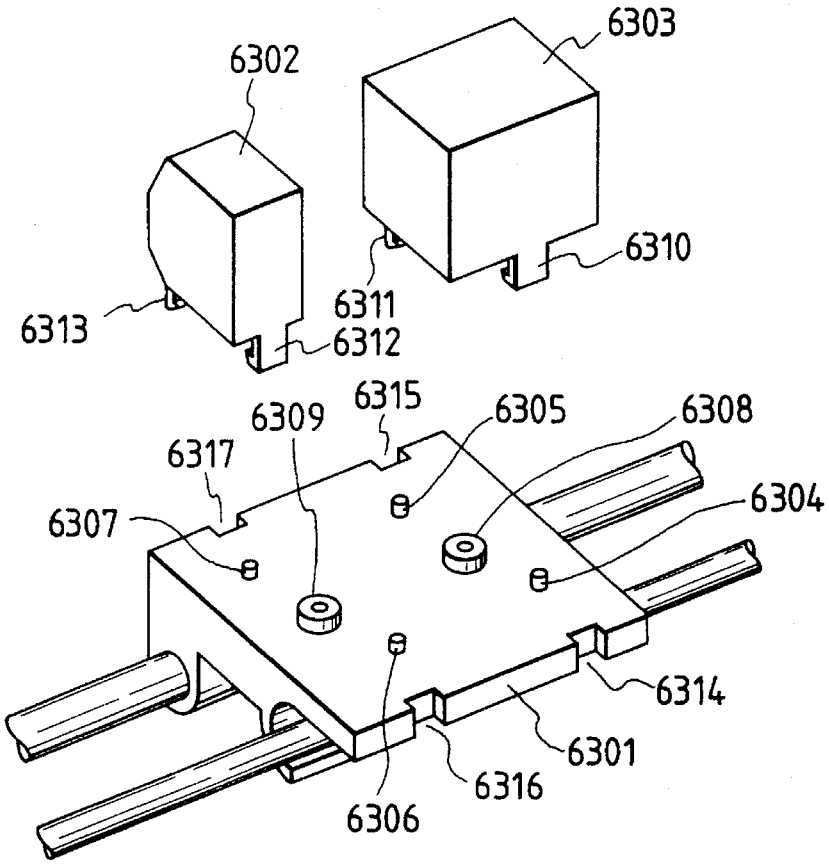
FIG. 61 is a schematic view illustrating still another embodiment.

FIG. 61 illustrates still another embodiment.

As far as an appropriate ink supply passage can be formed in a carriage 6301, it may be possible to use the carriage 6301 for positioning the ink jet head 6302 and ink tank 6303 by arranging a coupling between the ink jet head 6302 and carriage 6301 and a coupling between the ink tank 6303 and carriage 6301 in place of using the head cartridge of a type where an ink jet head and ink tank are coupled as in the embodiment described in FIGS. 60A and 60B.

In this case, too, the ink supply barrels 6308 and 6309 which are interrelatedly conductive to each other are not used for positioning. For the carriage 6301, members 6304, 6405, 6306, and 6307 are provided dedicatedly for positioning only. Meanwhile, a structure is arranged to provide opposing recesses on the ink jet head 6302 and ink tank 6303. Hence, it becomes possible to position the ink jet head and ink tank accurately, although the ink supply barrels are formed cylindrical with a desirable tightness.

The ink jet head 6302 and ink tank 6303 are formed by resilient materials, respectively, and the detachment blocking members 6310, 6311, 6312, and 6313 are detachably coupled to the recesses 6314, 6315, 6316, and 6317 of the carriage 6301.

Figure 62:
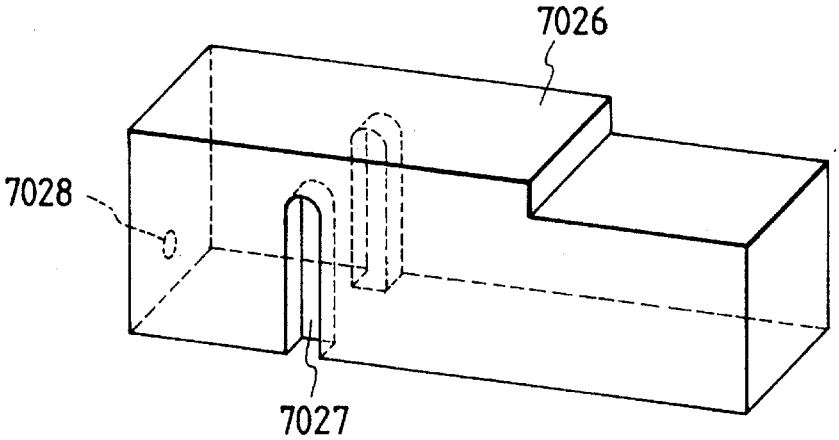
FIG. 62 is a schematic view illustrating a further embodiment.
Figure 63:
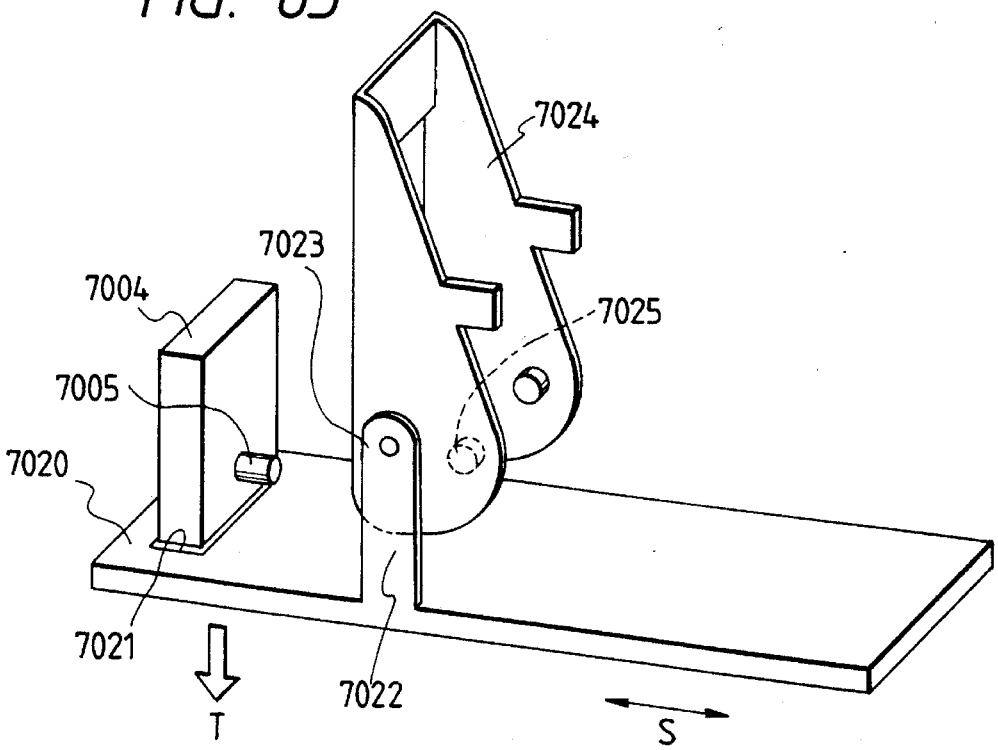
FIG. 63 is a schematically perspective view illustrating a carriage before an ink tank is mounted.
Figure 64:
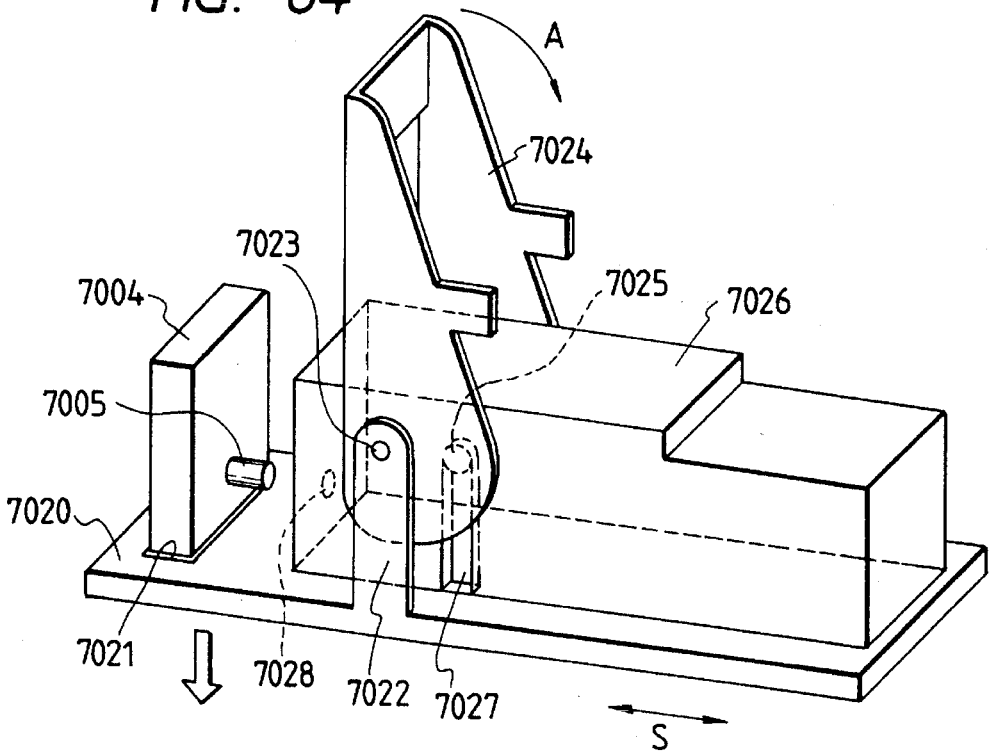
FIG. 64 is a schematically perspective view illustrating the carriage while the ink tank is being mounted.
Figure 65:
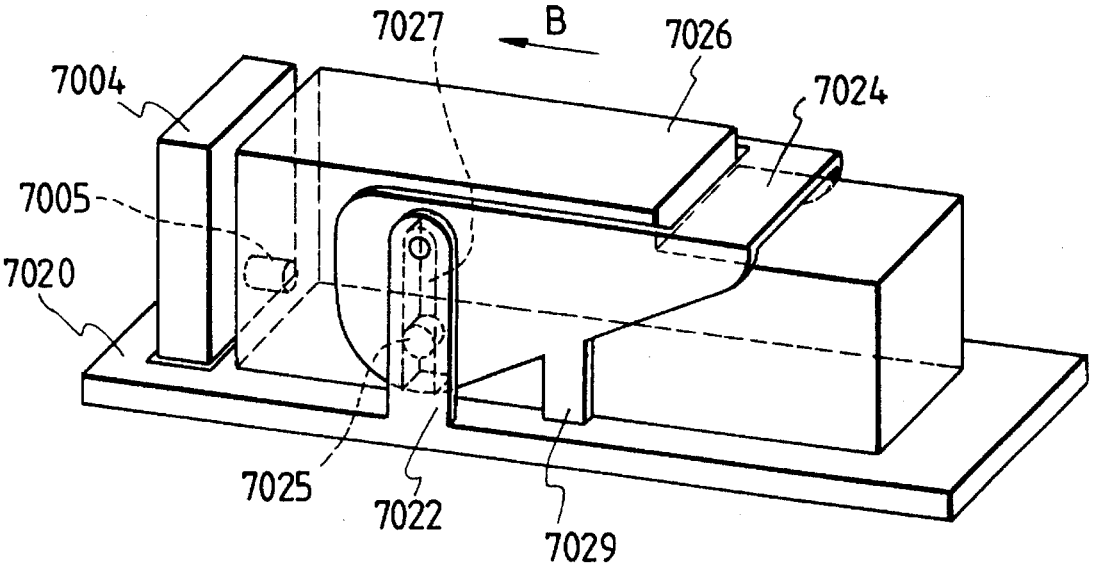
FIG. 65 is a schematically perspective view illustrating the carriage after the ink tank is mounted.

FIGS. 62 to 65 illustrate still another embodiment. FIG. 62 is a schematically perspective view showing an ink tank itself. FIG. 63 is a schematically perspective view showing the state where a recording head is installed on a carriage before the ink tank is mounted on the carriage. FIG. 64 is a schematically perspective view showing the recording head, ink tank, and carriage before the ink tank is attached to the recording head. FIG. 65 is a schematically perspective view showing the state where the ink tank is attached to the recording head installed on the carriage.

In FIGS. 62 and 63, a reference numeral 7026 designates an ink tank containing ink in it. Ink is supplied to the recording head 7004 from the ink supply nozzle 7005 of the recording head 7004 through the hole 7028 of the ink tank 7026. Also, the recording head 7004 is detachably coupled to the hole 7021 of the carriage 7020 by a means which is not shown. Here, the scanning direction of the carriage 7020 is such as indicated by an arrow S in FIG. 62 while the ink ejection direction of the recording head 7004 to a recording medium is such as indicated by an arrow T in FIG. 62. A reference numeral 7027 designates grooves provided for the ink tank 7026 to prevent any erroneous tank installation, which engage with the bosses 7025 arranged on the carriage lever 7024 rotatively mounted in the upper holes 7023 of the arms 7022 which are provided on both sides of the carriage 7020.

An operator installs the ink tank 7026 so that the grooves 7027 of the ink tank 7026 engage with the bosses 7025 while the carriage lever 7024 is held up when the ink tank 7026 is attached to the recording head 7004 (FIG. 64).

In this case, if the ink tank 7026 happens to be upside down or inside out, that is, directions other than the normal direction, when it is installed on the carriage 7020, the bosses and grooves 7027 are not matched and even the installation on the carriage 7020 is impossible.

Subsequently, the carriage lever 7024 is held down in the direction indicated by an arrow A. In this way, the ink tank 7026 is allowed to shift in the direction approaching the recording head 7004 (indicated by an arrow B). The ink supply nozzle 7005 of the recording head 7004 is coupled to the hole 7028 of the ink tank 7026 to complete the installation of the ink tank 7026. At this juncture, a stopper 7029 provided for the carriage lever 7024 is allowed to butt the carriage 7024 (FIG. 65).

As described above, the grooves 7027 are provided as shown in FIG. 62 in the position apart from the center of the ink tank 7026 while the bosses 7025 which engage with the grooves 7027 are provided on the carriage 7020. Hence, it becomes possible to prevent any erroneous installation of the ink tank 7026 on the carriage 7020.

Also, in the present embodiment, the bosses 7025 are provided for the carriage lever 7024, but the bosses 7025 are not necessarily limited to that shape, if only these are in a protruded shape.

Figure 66:
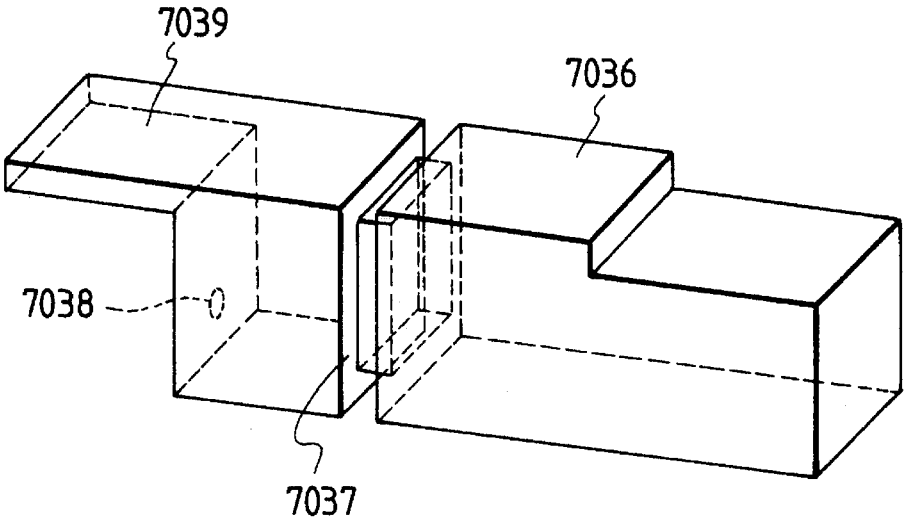
FIG. 66 is a schematically perspective view illustrating an ink tank.
Figure 67:
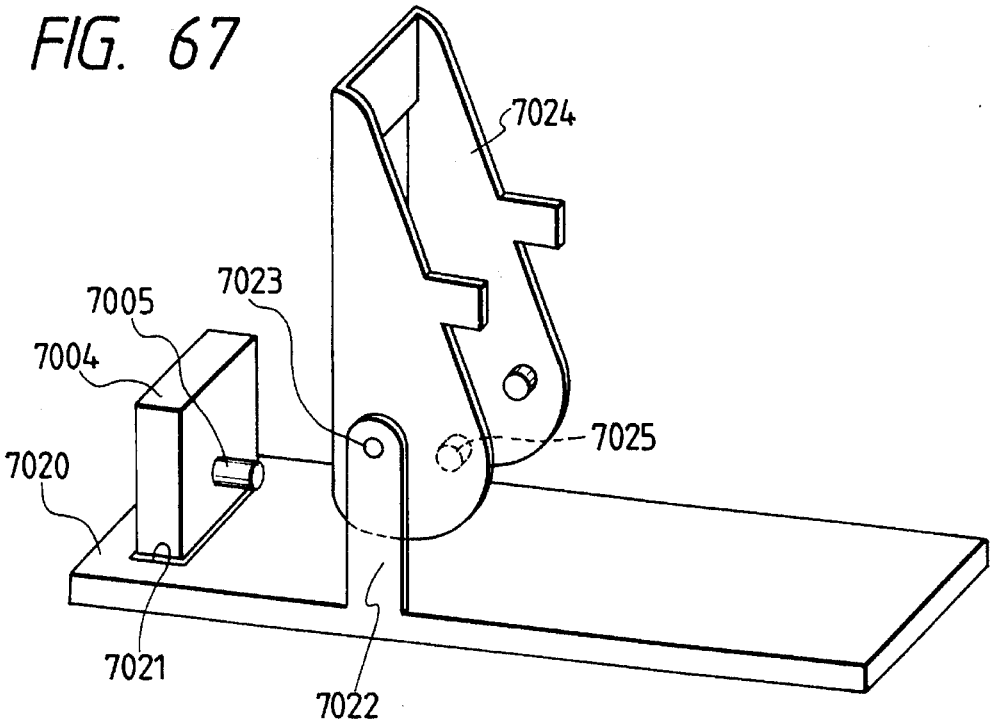
FIG. 67 is a schematically perspective view illustrating a carriage before an ink tank is mounted.
Figure 68:
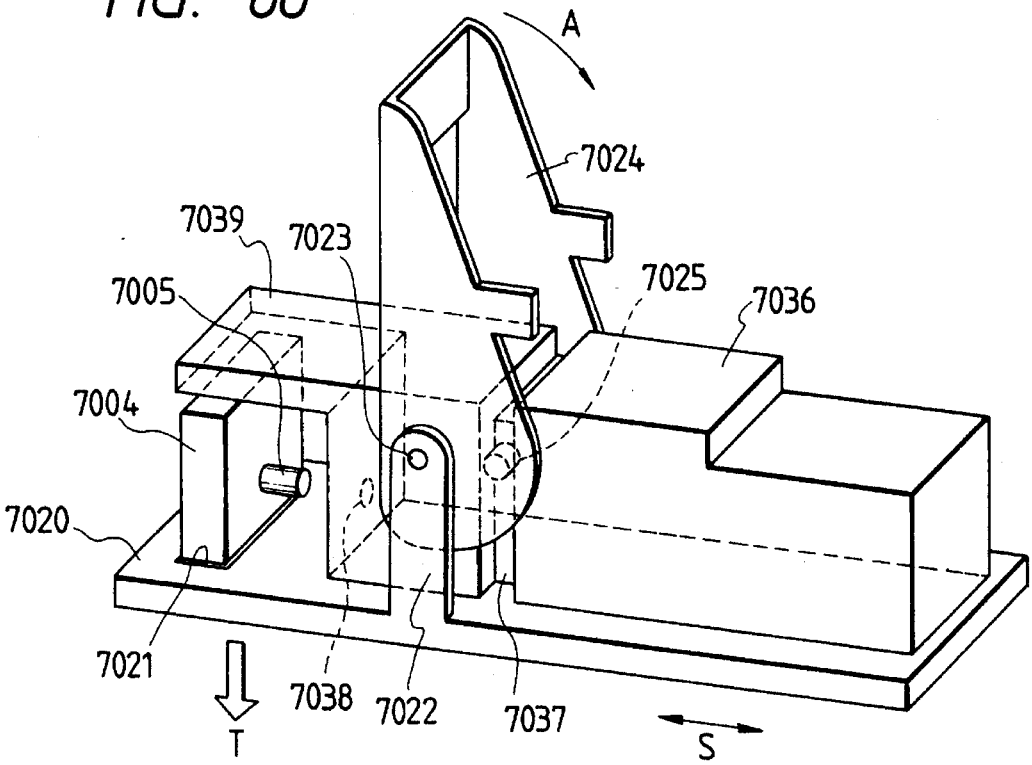
FIG. 68 is a schematically perspective view illustrating the carriage while the ink tank is being mounted.
Figure 69:
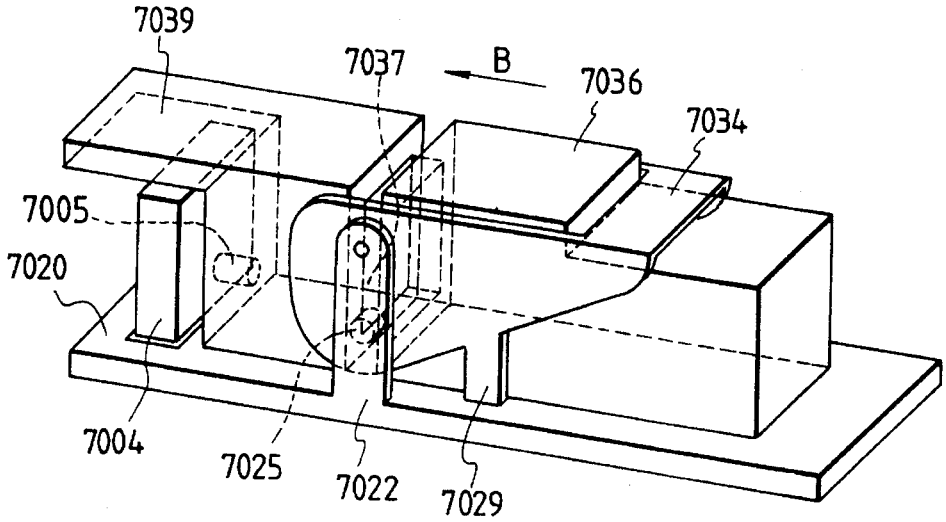
FIG. 69 is a schematically perspective view illustrating the carriage after the ink tank is mounted.

FIGS. 66 to 69 illustrate still another embodiment. FIG. 66 is a schematically perspective view showing an ink tank itself. FIG. 67 is a schematically perspective view showing the state where a recording head is installed on a carriage before the ink tank is mounted on the carriage. FIG. 68 is a schematically perspective view showing the recording head, ink tank, and carriage before the ink tank is attached to the recording head. FIG. 69 is a schematically perspective view showing the state where the ink tank is attached to the recording head installed on the carriage.

In FIGS. 66 and 67, a reference numeral 7036 designates an ink tank containing ink in it. Ink is supplied to the recording head 7004 from the ink supply nozzle 7005 of the recording head 7004 through the hole 7038 of the ink tank 7036. Also, the recording head 7004 is detachably coupled to the hole 7021 of the carriage 7020 by a means which is not shown. A reference numeral 7037 designates grooves provided for the ink tank 7036 which engage with the bosses 7025 arranged on the carriage lever 7024 rotatively mounted in the upper holes 7023 of the arms 7022 which are provided on both sides of the carriage 7020.

An operator installs the ink tank 7036 so that the wall 7039 of the ink tank 7036 can be placed on the recording head 7004 side, and also the grooves 7037 engage with bosses 7025 while the carriage lever 7024 is held up when the ink tank 7036 is attached to the recording head 7004 (FIG. 68). In this case, if the ink tank 7036 happens to be upside down or inside out, that is, directions other than the normal direction, when it is installed on the carriage 7020, the wall 7039 is blocked by the recording head 7004 or the bosses 7025 are not matched with the position of the grooves 7037, and even the installation on the carriage 7020 is impossible.

Subsequently, the carriage lever 7024 is held down in the direction indicated by arrow A. Thus, the ink tank 7036 is shifted in the direction approaching the recording head 7004 (direction indicated by an arrow B), and the ink supply nozzle 7005 of the recording head 7004 is coupled to the hole 7038 of the ink tank 7036 to complete the installation of the ink tank 7036 (FIG. 69).

As described above, the wall 7039 is provided at the end portion of the ink tank 7036 and further, the grooves 7037 are provide away from the center of the ink tank 7036 while the bosses 7025 which engage with the grooves 7037 are provided on the carriage 7020. Hence, it becomes possible to prevent any erroneous installation of the ink tank 7036 on the carriage 7020.

Also, in the present embodiment, the bosses 7025 are provided for the carriage lever 7024, but the bosses 7025 are not necessarily limited to that shape, if only these are in a protruded shape.

Figure 70:
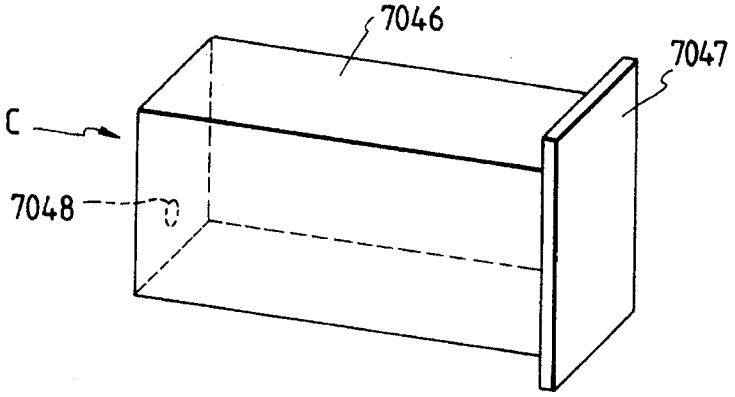
FIG. 70 is a schematically perspective view illustrating an ink tank.
Figure 71:
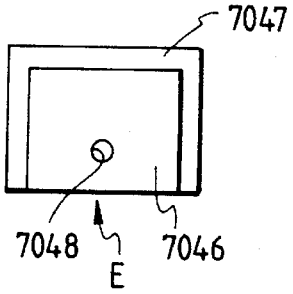
FIG. 71 is a side view schematically illustrating the ink tank.
Figure 72:
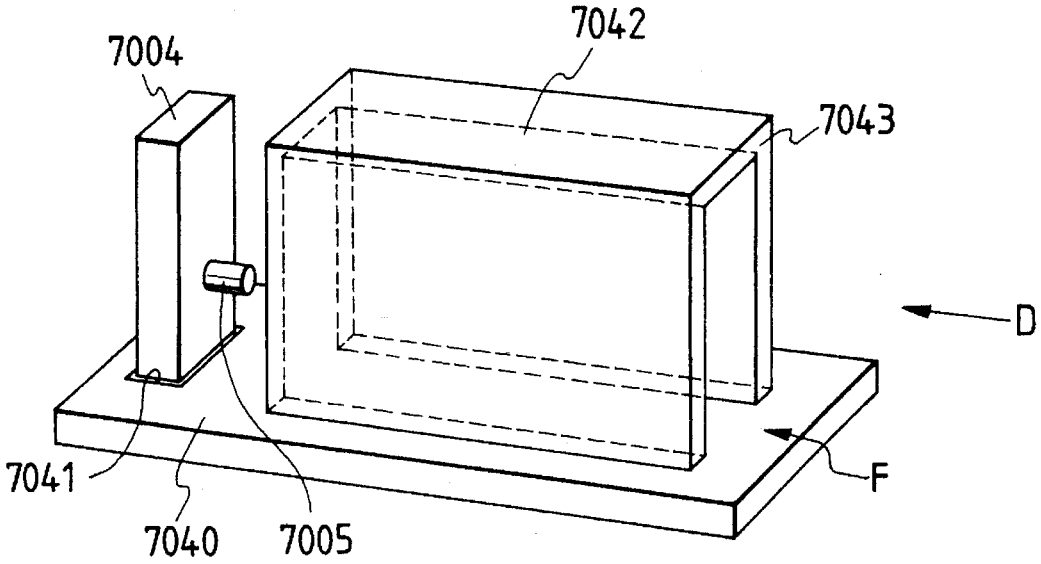
FIG. 72 is a schematically perspective view illustrating a carriage before an ink tank is mounted.
Figure 73:
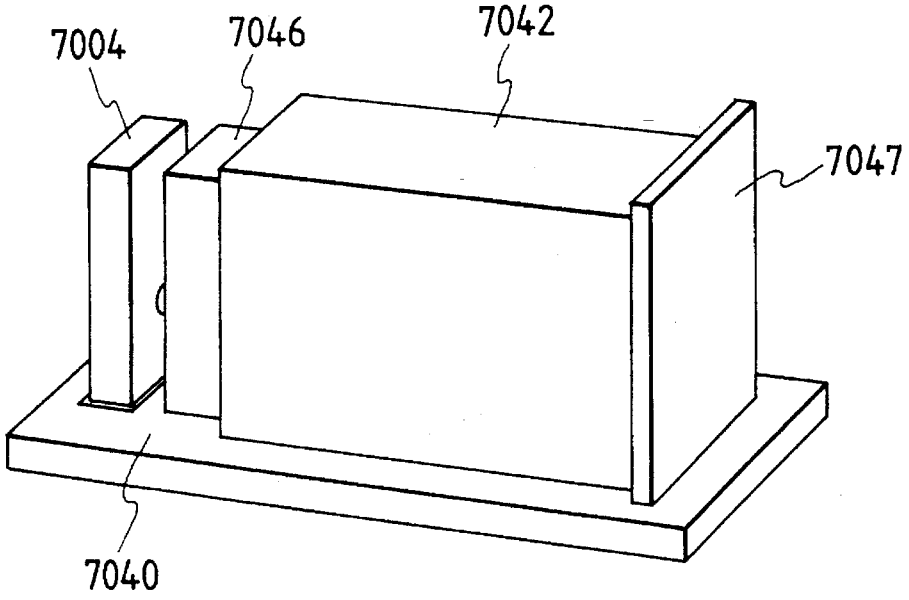
FIG. 73 is a schematically perspective view illustrating the carriage after the ink tank is mounted.

FIGS. 70 to 73 illustrate still another embodiment. FIG. 70 is a schematically perspective view showing an ink tank itself. FIG. 71 is a side view schematically showing the ink tank viewed in the direction indicated by an arrow C in FIG. 70. FIG. 72 is a schematically perspective view showing the state where a recording head is installed on a carrier before the ink tank is mounted on the carriage. FIG. 73 is a schematically perspective view showing the state where the ink tank is attached to the recording head installed on the carriage.

In FIGS. 70, 71, and 72, a reference numeral 7046 designates an ink tank containing ink in it. Ink is supplied to the recording head 7004 from the ink supply nozzle 7005 of the recording head 7004 through the hole 7048 of the ink tank 7046. Also, the recording head 7004 is detachably coupled to the hole 7041 of the carriage 7040 by a means which is not shown. A reference numeral 7042 designates an ink tank installation guide provided for the carriage 7042, and also 7047, a rib to prevent the erroneous installation of the ink tank 7047.

An operator inserts the ink tank 7046 into the guide 7042 of the carriage 7040 in the direction indicated by an arrow D in FIG. 72 from the hole 7048 so as to match the direction (E) in which no rib 7047 is present for the ink tank 7046 with the portion F of the carriage 7040 when the ink tank 7046 is attached to the recording head 7004. The ink tank is inserted until the rib 7047 of the ink tank 7046 is allowed to butt the edge 7043 of the guide 7042 of the carriage 7040. Thus, the ink supply nozzle 7005 of the recording head 7004 is coupled to the hole 7048 of the ink tank 7046 to complete the ink tank installation (FIG. 73).

In this case, if the ink tank 7046 happens to be upside down or inside out, that is, in the directions other than the one regulated, when it is mounted on the carriage 7040, the rib 7047 stands in the way so that the carriage 7040 cannot be inserted into the guide 7042; thus disabling the installation.

As described above, the rib 7047 is arranged at the end of the ink tank 7046 for the provision of the guide 7042 on the carriage 7040 thereby to prevent the ink tank 7046 from being incorrectly mounted on the carriage 7040.

Figure 74:
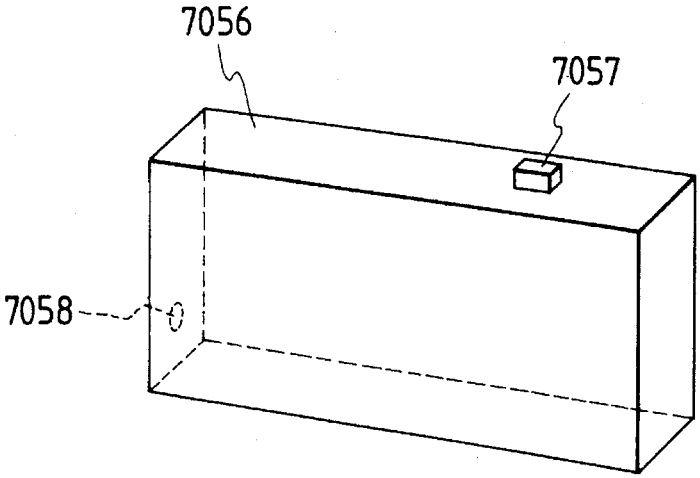
FIG. 74 is a schematically perspective view illustrating an ink tank.
Figure 75:
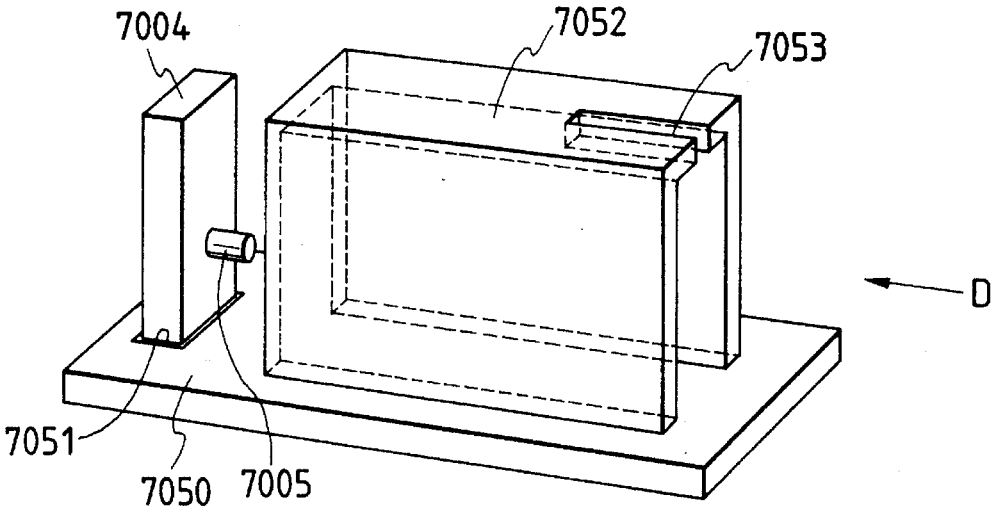
FIG. 75 is a schematically perspective view illustrating a carriage before an ink tank is mounted.
Figure 76:
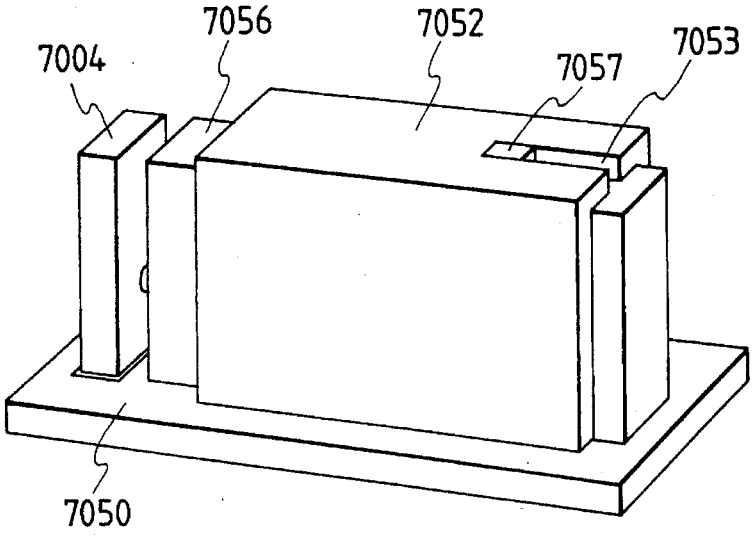
FIG. 76 is a schematically perspective view illustrating the carriage after the ink tank is mounted.

FIGS. 74 to 76 illustrate still another embodiment. FIG. 74 is a schematically perspective view showing an ink tank itself. FIG. 75 is a schematically perspective view showing the state where a recording head is installed on a carriage before the ink tank is mounted on the carriage. FIG. 76 is a schematically perspective view showing the state where the ink tank is attached to the recording head installed on the carriage.

In FIGS. 74 and 75, a reference numeral 7056 designates an ink tank containing ink in it. Ink is supplied to the recording head 7004 from the ink supply nozzle 7005 of the recording head 7004 through the hole 7058 of the ink tank 7056. Also, the recording head 7004 is detachably coupled to the hole 7051 of the carriage 7050 by means which is not shown. A reference numeral 7052 designates an ink tank installation guide provided for the carriage 7050; 7057, a protrusion to prevent the ink tank from being erroneously mounted; and 7053, a groove provided for the carriage to prevent the ink tank from being erroneously mounted.

When an operator mounts the ink tank 7056 on the recording head 7004, the ink tank 7056 is inserted into the guide 7052 of the carriage from the hole 7058 in the direction indicated by an arrow D in FIG. 75 so the protrusion 7057 of the ink tank 7056 and the groove 7053 of the carriage 7050 are matched. The ink tank is inserted until the protrusion 7057 butts the end of the groove 7053. Thus, the ink supply nozzle 7005 of the recording head 7004 and the hole 7058 of the ink tank 7056 are coupled to compete the installation of the ink tank 7056 (FIG. 76).

In this case, if the ink tank 7056 happens to be upside down or inside out or any other directions than normally regulated, the ink tank cannot be inserted into the guide 7052 of the carriage 7050 because it is blocked by the protrusion 7057; disabling its installation.

As described above, it is thus possible to prevent the ink tank 7056 from being installed incorrectly into the carriage 7050 by providing the protrusion for the ink tank 7056 as well as the groove 7053 for the guide 7052 of the carriage 7050.

Figure 77:
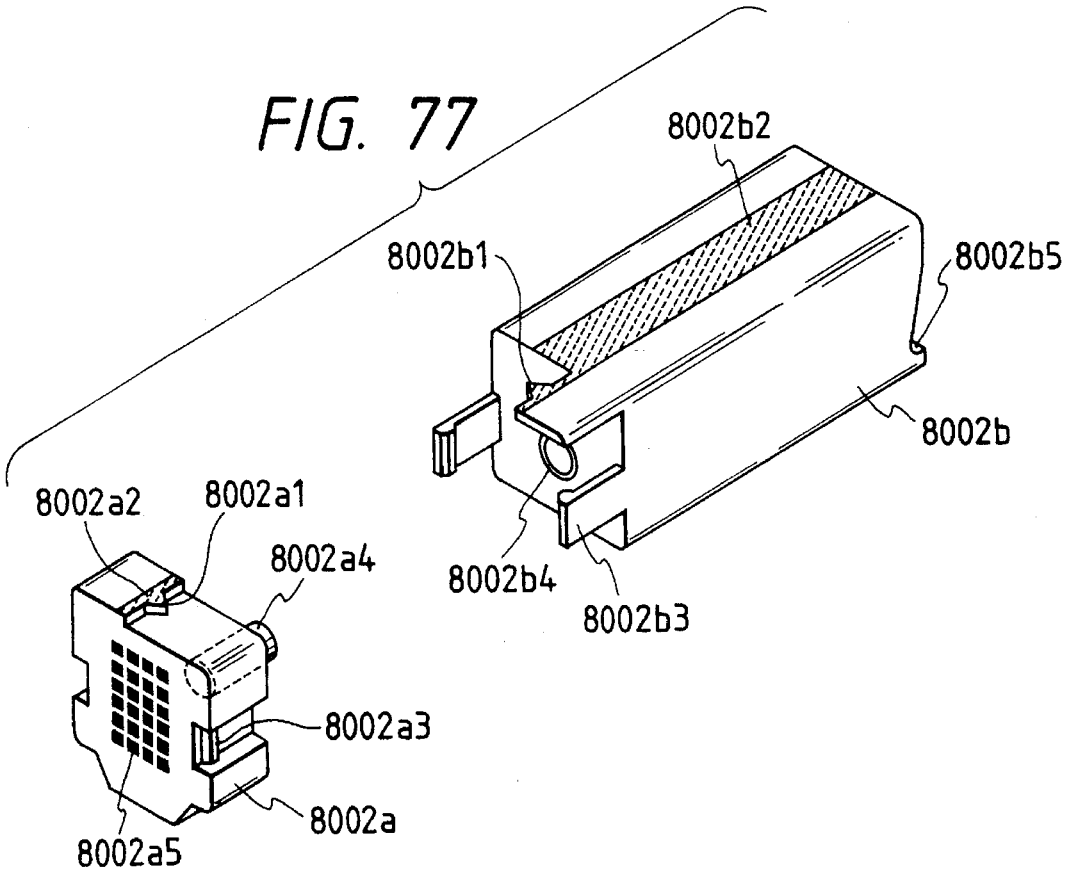
FIG. 77 is a schematically perspective view illustrating the state where an ink jet recording head and ink tank according to another embodiment are parted.

FIG. 77 illustrates, as another embodiment, the state where a head cartridge 8002 is separated from a recording head 8002*a* and ink tank 8002*b*.

In the present embodiment, the recording head 8002*a* and ink tank 8002*b* are coupled in such a manner that an ink supply tube 8002*a*4 formed in the recording head 8002*a* to supply ink to the recording head 8002*a* from the ink tank 8002*b* is coupled to a seal ring 8002*b*4 provided for the ink tank 8002*b* to prevent ink leakage by being fitted into the foregoing ink supply tube 8002*a*4, and then locking nails 8002*b*3 formed on the ink tank 8002*b* are coupled to the receptacles 8002*a*3 provided for the recording head 8002*a* to receive the foregoing locking nails 8002*b*3. Reference numerals 8002*a*1 and 8002*b*1 designate the matching marks provided for the ink tank 8002*b* to indicate a correct position of the inserting amount when being coupled; 8002*a*2 and 8002*b*2, marks provided for the recording head 8002*a* and ink tank 8002*b*, respectively, to indicate the direction in which these are coupled and are arranged in stripes of different colors from the recording head 8002*a* and ink tank 8002*b*, lines engraved, or the like to facilitate discriminating the coupling direction of the recording head 8002*a* and ink tank 8002*b* when separated; 8002*a*5, a contact to make electrical connection between the carrier 8001 and recording head 8002*a* when the head cartridge 8002 is mounted on the carrier 8001; and 8002*b*5, a receptacle for a lock lever (to be described later) to fix the head cartridge 8002 to the tarrier when the head carriage 8002 is mounted on the carrier 8001.

Figure 78:
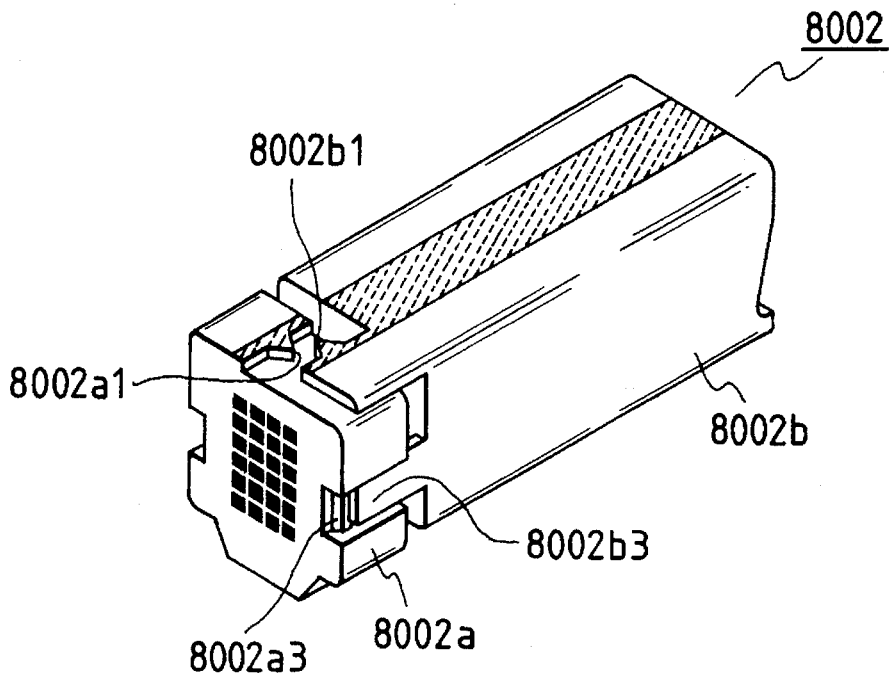
FIG. 78 is a schematically perspective view illustrating the state where the ink jet recording head and ink tank are being coupled.

FIG. 78 illustrates the state where the recording head 8002*a* and ink tank 8002*b* are on the way to be coupled.

When the ink tank 8002*b* is being inserted into the recording head 8002*a*, a load is more increased in pressing it where the locking nails 8002*b*3 butt the locking nail receptacles 8002*a*3. However, in this state, the matching marks 8002*a*1 and 8002*b*1 are still displaced. Thus, an operator can recognize that the coupling is still incomplete.

Figure 79:
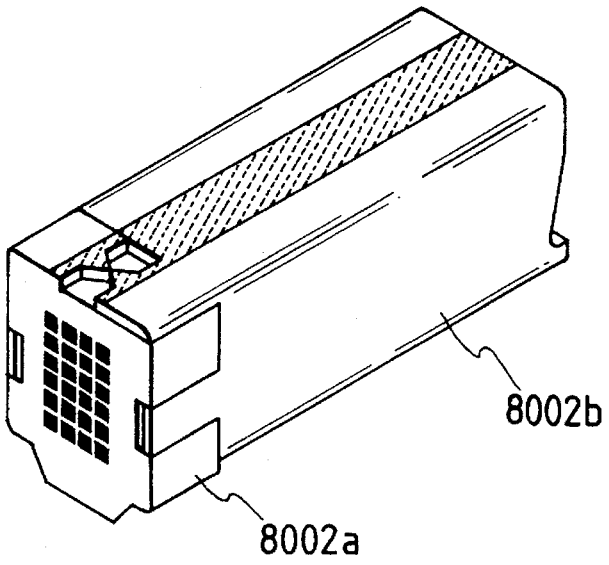
FIG. 79 is a schematically perspective view illustrating the state where the ink jet recording head and ink tank are coupled.

When the ink tank 8002*b* is further pressed, the arms of the locking nails 8002*b*3 are bent to climb over the receptacles 8002*a*3 to allow them to be joined correctly. Then, the matching marks 8002*a*1 and 8002*b*1 are matched. FIG. 79 illustrates this state.

Figure 80:
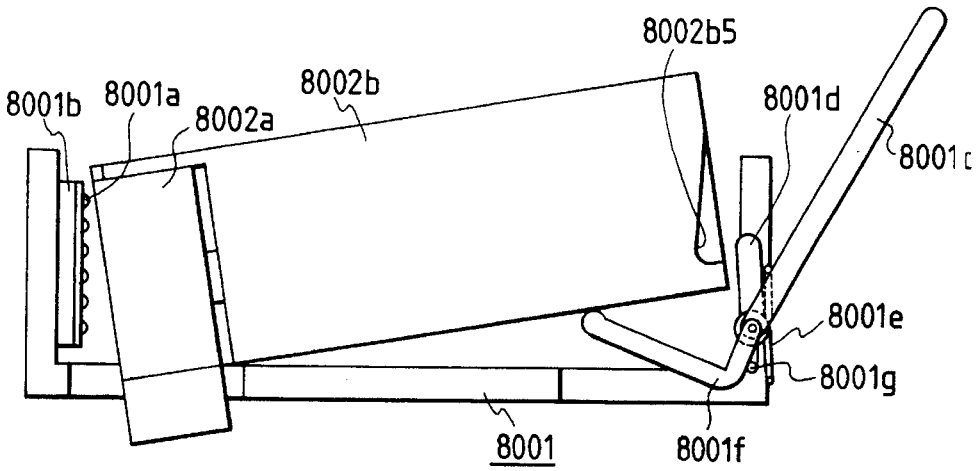
FIG. 80 is a schematic view illustrating the state where a head cartridge is being mounted on a carrier.

FIG. 80 illustrates the state where the head cartridge 8002 is mounted on the carrier. Here, the recording head 8002*a* and ink tank 8002*b* are not particularly coupled securely. There is still a space between them in such a coupling state of the head cartridge 8002 shown in FIG. 80. In the present embodiment, a correct installation is possible even in such a state as this.

In FIG. 80, there are provided for the carrier 8001 an electrical contact 8001*a* to make electrical connection with the recording head 8002*a*; a resilient member 8001*b* made of rubber or the like to give pressure needed for the electrical contact; an operation lever 8001*c* to mount or demount the head cartridge 8002; a cartridge locking lever 8001*d* to fix the head cartridge to the carrier 8001; a lever spring 8001*e* to bias the operation lever 8001*c*; a push lever 8001*f* to support the head cartridge 8002 from the beneath; and an interlocking lever 8001*g* to move the foregoing push lever 8001*f*. The four components, the operation lever 8001*c*, cartridge locking lever 8001*d*, push lever 8001*f*, and interlocking lever 8001*g*, are axially supported at a same point. The three components, the operation lever 8001*c*, cartridge locking lever 8001*d*, and interlocking lever 8001*g*, are interlockingly fixed and operated in synchronism while the movement of the operation lever 8001*c* is transferred to the push lever 8001*f* through the interlocking lever 8001*g*.

Figure 81:
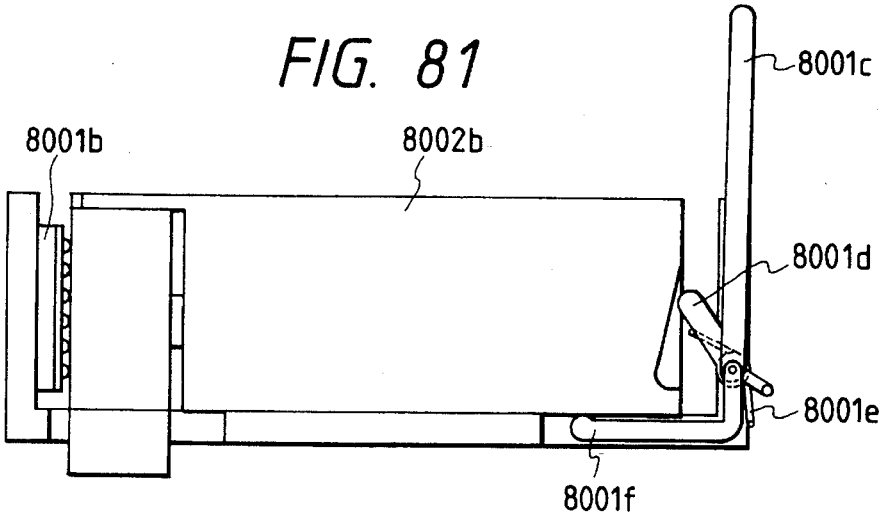
FIG. 81 is a schematic view illustrating the state where a head cartridge is being mounted on a carrier.

When there is no cartridge 8002 on the carrier 8001, the above-mentioned levers are biased by the lever spring 8001*e* in clockwise in FIG. 80. The state shown in FIG. 80 is such that the head cartridge is mounted under this condition. From this state, the operation lever 8001*c* is rotated in the direction indicated by an arrow c. Then, the leading end of the push lever 8001*f* is lowered to cause the head cartridge 8002 to be lowered likewise. As the operation lever 8001*c* is further rotated, the interlocking lever 8001*g* is parted from the push lever 8001*f* and is no longer rotated; thus the state becoming as represented in FIG. 81. When the operation lever 8001*c* is further rotated, the cartridge locking lever 8001*d* begins to push the ink tank 8002*b*. Here, even if there is a space due to incomplete coupling of the recording head 8002*a* and ink tank 8002*b*, the ink tank is pressed by the cartridge locking lever 8001*d* in the mounting direction. Hence, ultimately, the recording head 8002*a* and ink tank 8002*b* are completely coupled as far as the head cartridge 8002 is mounted on the carrier 8001.

Figure 82:
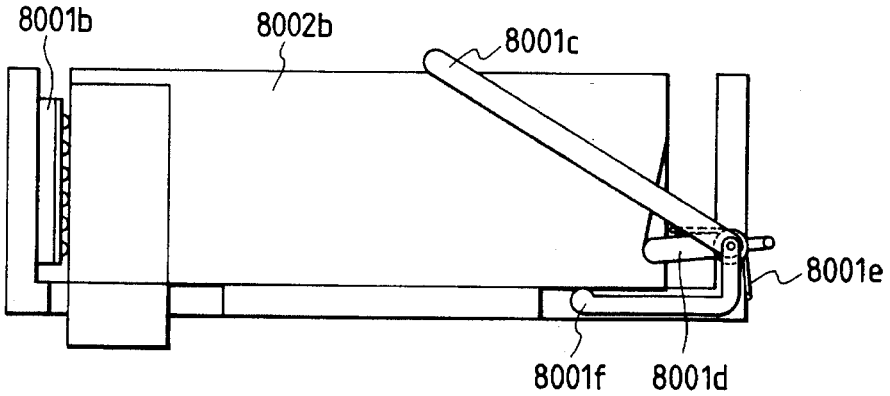
FIG. 82 is a schematic view illustrating the state where the head cartridge is mounted on the carrier.

FIG. 81 illustrates the state where the head cartridge 8002 is fixed to the carrier. From this state, when the operation lever 8001*c* is rotated in counterclockwise, the leading end of the cartridge locking lever 8001*d* reaches the lower side of the rotational center of the lever (FIG. 82). Thus, by the force exerted by the resilient member 8001*b*, the cartridge locking lever 8001*d* is further pressed in counterclockwise against the force exerted by the lever spring 8001*e*. Thus, the cartridge locking lever 8001*d* becomes locked.

Figure 83:
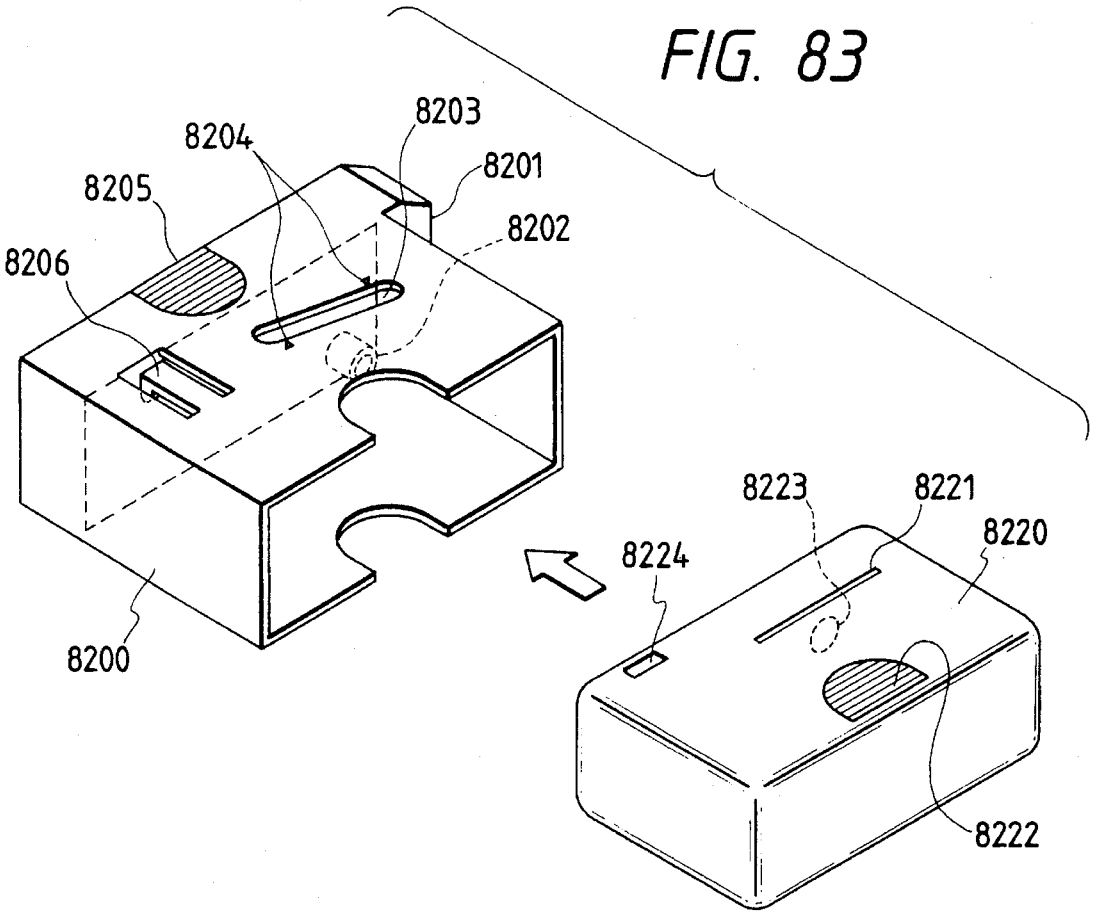
FIG. 83 is a schematically perspective view illustrating the state where a recording head and ink tank according to still another embodiment are parted.
Figure 84:
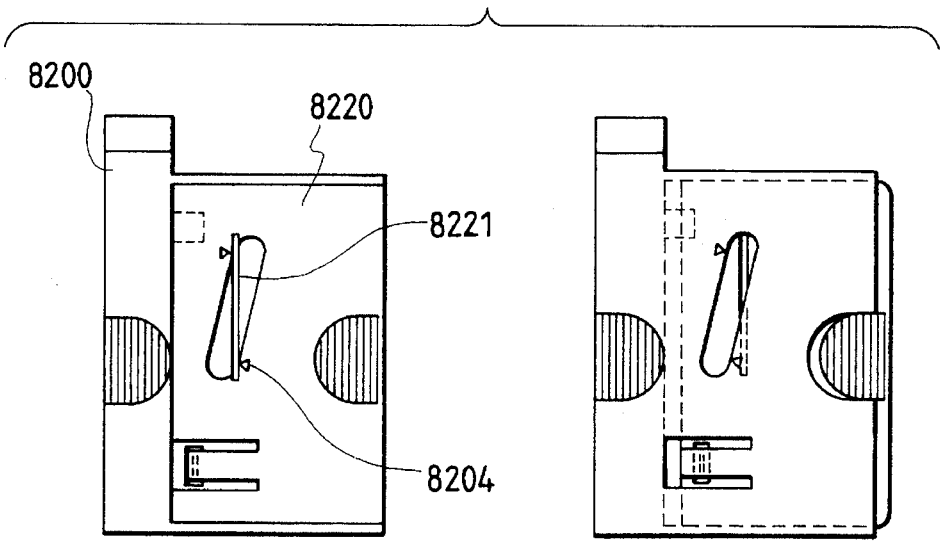
FIG. 84 is a schematic view illustrating the state where the recording head and ink tank are coupled.

Now, as still another embodiment, the description will be made of a case where the coupling indication marks are provided for a type which stores an ink tank in a recording head housing. FIG. 83 is a schematically perspective view illustrating a recording head and ink tank according to the present embodiment. FIG. 84 is a plan view. In FIG. 83, a reference numeral 8200 designates a recording head and 8220, an ink tank. For the foregoing recording head 8200 there are provided a nozzle unit 8201 to eject ink droplets; a supply tube 8202 to receive the ink supply from an ink tank 8220; a window 8203 to examine matching lines; marching marks 8204; finger stays 8205 for the removal of ink tank 8220; and locking nails 8206 to fix the ink tank 8220. For the foregoing ink tank 8220 there are provided matching lines 8221; finger stays 8222 for installation use; an ink supply outlet to supply ink to the foregoing recording head 8200; and receptacles 8224 to receive the foregoing locking nails 8206.

The coupling of the ink tank 8220 is conducted by inserting the ink tank in the direction indicated by an arrow.

As shown in the left-hand side in FIG. 84, when the ink tank 8220 is inserted into the correct position, the matching marks 8204 of the recording head 8200 and the matching line 8221 of the ink tank 8220 are matched. Hence, it is easy to discriminate whether the installation is correctly conducted or not. If the installation is incorrect, the matching marks 8204 and matching line 8221 are displaced as shown in the right-hand side in FIG. 83. Since the examination window 8203 is diagonally provided with respect to the installation direction, even a slight displacement in the installation direction is emphatically indicated so as to make discrimination easier.

Figure 85:
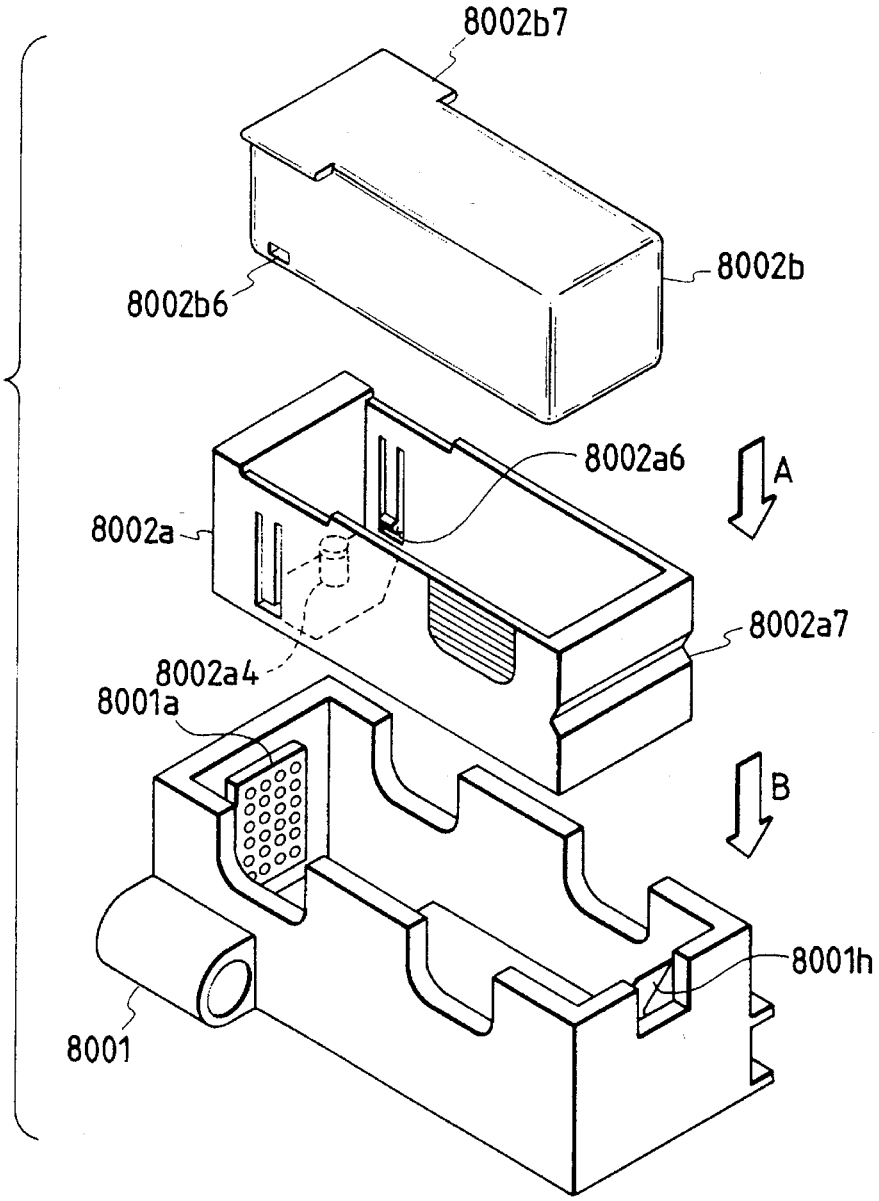
FIG. 85 is a schematically perspective view illustrating the state where a recording head and ink tank according to still another embodiment are coupled.

As still another embodiment, FIG. 85 illustrates a case where a click is provided for the coupling of a head cartridge and carrier in a mode that an ink tank is stored in the recording head housing. FIG. 85 is a schematically perspective view showing a recording head and ink tank according to the present embodiment. For each element which has the same function as above, the same reference mark is provided in the corresponding location, and the description thereof will be omitted.

In FIG. 85, the ink tank 8002*b* is installed in the direction indicated by an arrow A with respect to the recording head 8002*a*, and these are coupled by clicking of the nails 8002*a*6 arranged in two locations on the recurrent head side and the receptacles 8002*a*6 on the ink tank side. The recording head 8002*a* is installed in the direction indicated by an arrow B which is the same as the direction indicated by the arrow A with respect to the carrier 8001 and is coupled thereto by clicking of a spring 8001*h* and a receiving portion 8002*a*7. The ink tank 8002*b* can be replaced alone even in a state where the recording head 8002*a* is coupled to the carrier 8001, but since the ink tank 8002*b* and recording head 8002*a* are mounted or demounted in the same direction, the strength of the click for coupling for the ink tank 8002*b* should be set weaker than that of the click for coupling the recording head 8002*a*. In this way, when only the ink tank 8002*b* is replaced, it is possible to prevent the recording head 8002*a* from being removed together with the ink tank by mistake.

Figure 86:
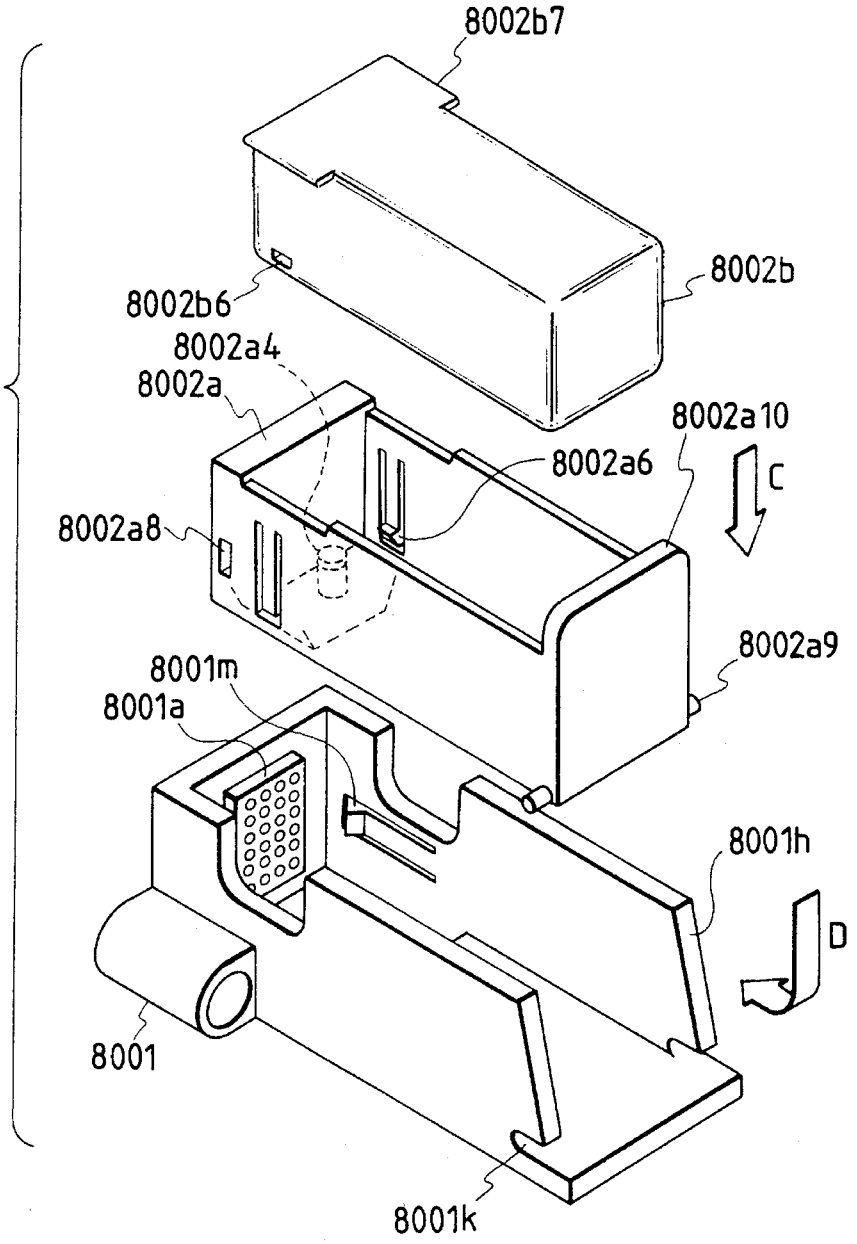
FIG. 86 is a schematically perspective view illustrating another way in which the recording head, ink tank, and carrier are coupled.

Also, as shown in FIG. 86, the installation direction of the recording head 8002*a* and that of the ink tank 8002*b* are made different. As a result, it becomes possible to reliably conduct the installations of the ink tank and recording head separately.

In FIG. 86, although the way to couple the ink tank 8002*b* and recording head 8002*a* are the same as the case described in conjunction with FIG. 85, the directions in which the recording head 8002*a* and carrier 8001 are coupled are different. In order to couple the recording head 8002*a* to the carrier 8001, the recording head 8002a must be slightly displaced at first before being mounted on the carrier 8001. If the amount of such a displacement is not enough, a pin 8002*a*9, is caused to butt a stop provided for the carrier to displace the recording head 8002*a* in the horizontal direction, at the same time preventing the intervention of the nails 8001*m* and receptacles 8002*a*8. When the recording head 8002*a* is mounted on the carrier as indicated by an arrow D, it is shifted in the horizontal direction to complete the installation by clicking of the nails 8001*m* on the carrier side and the receptacles 8002*a*8 on the recording head side.

Figure 87:
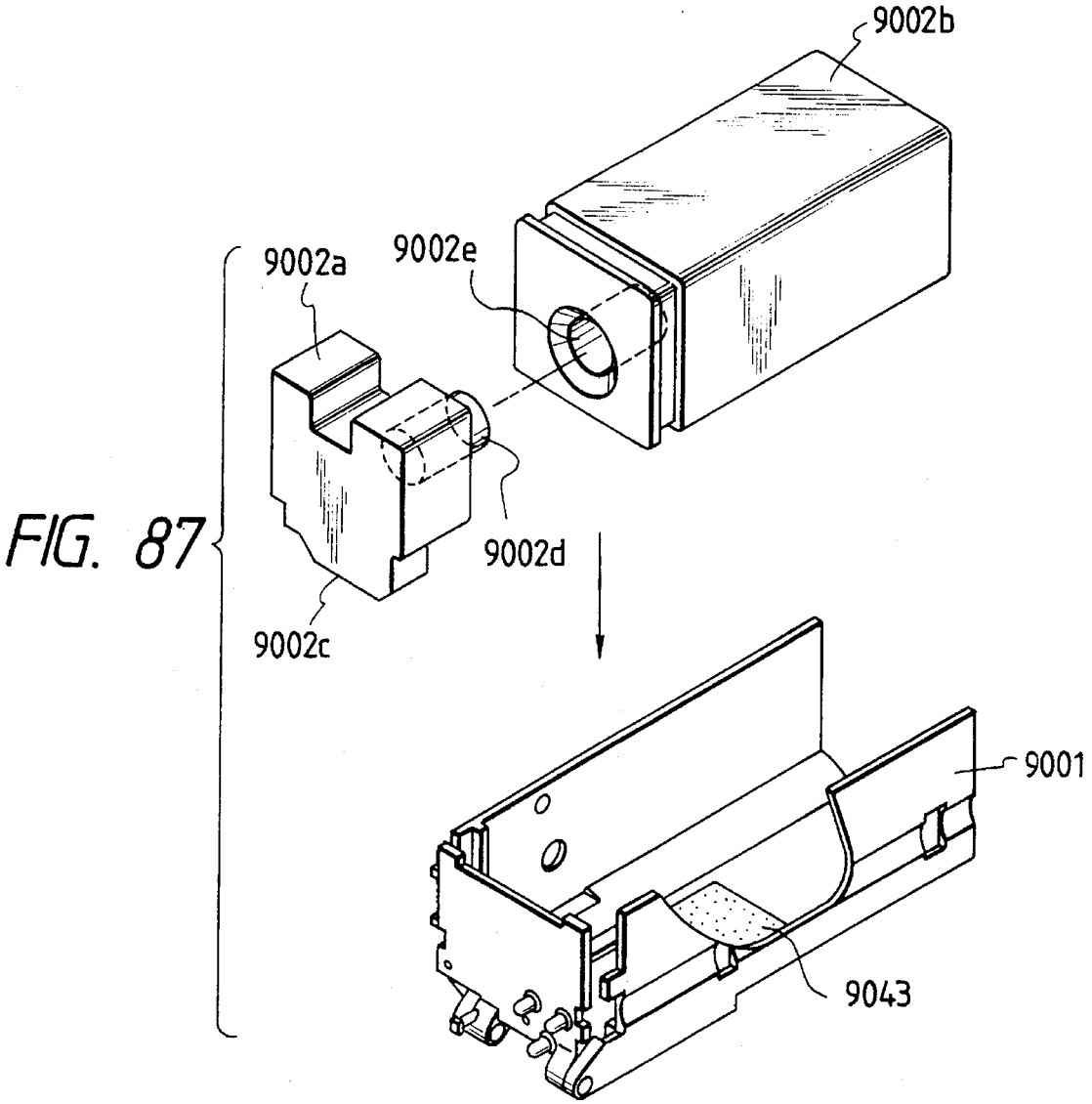
FIG. 87 is a partially perspective view schematically illustrating the structure of a carrier and ink jet cartridge according to another embodiment.

As shown in FIG. 87, the recording head 9002*a* and ink tank 9002*b* are coupled by inserting a connecting rod 9002*d* into a connecting hole 9002*e*. The connection and separation operations are executed on the carrier 9001*a* by lever and the like provided for the carrier. Here, the description and representation of such operations by a drawing will be omitted.

Usually, the ink jet cartridge 9002 with the recording head 9002*a* and ink tank 9002*b* being coupled is mounted on a carrier to operate printing. A reference numeral 9043 designates an absorbent according to the present invention and is made of a high molecular polymer or the like. It is adhesively arranged on the carrier by a double coated adhesive tape or the like so that the absorbent is placed beneath the coupling portion of the connecting rod 9002*d* and connection hole 9002*e*, that is, it is provided in the vicinity of the coupling portion of the recording head and ink tank. Therefore, when the recording head 9002*a* and ink tank 9002*b* are separated, the absorbent 9043 receives ink dropping from the outer periphery of the connecting rod 9002*d* and the end of the connecting hole 9002*e* and holds such ink droplets to prevent them from flowing outside. Here, the vicinity of the coupling portion means in the present invention that the area including the coupling portion and its vicinity where ink leakage or ink scattering takes place when the recording head and ink tank are separated.

Now, still another embodiment will be described.

Figure 88:
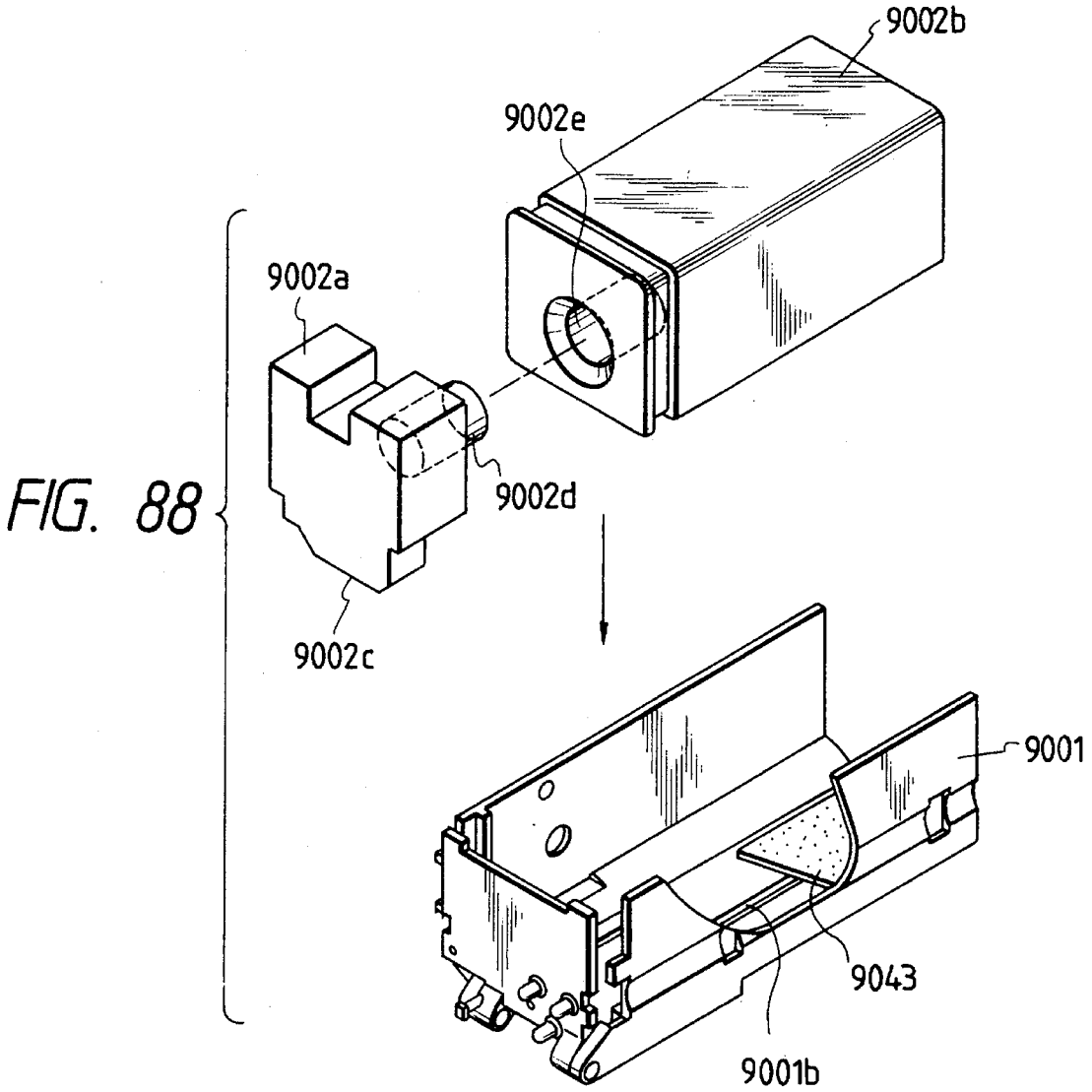
FIG. 88 is a partially perspective view schematically illustrating the structure of a carrier and ink jet cartridge according to still another embodiment.

As shown in FIG. 88, a groove 9001*b* is provided beneath the coupling portion of the connecting rod 9002*d* and connection hole 9002*e* for the carrier 9001. The present embodiment is effective when the absorbent 9043 shown in the embodiment described in conjunction with FIG. 87 cannot be placed at a desired location. With the present embodiment, it is possible to allow the absorbent 9043 to be adhesively arranged at an arbitrary position. At first, ink dropping from the coupling portion is received by the groove 9001*b*, and by capillary phenomenon, it flows along the groove 9001*b*. Ultimately, it reaches the absorbent 9043 adhering to the trailing end of the groove and then held there.

Subsequently, still another embodiment will be described.

Figure 89:
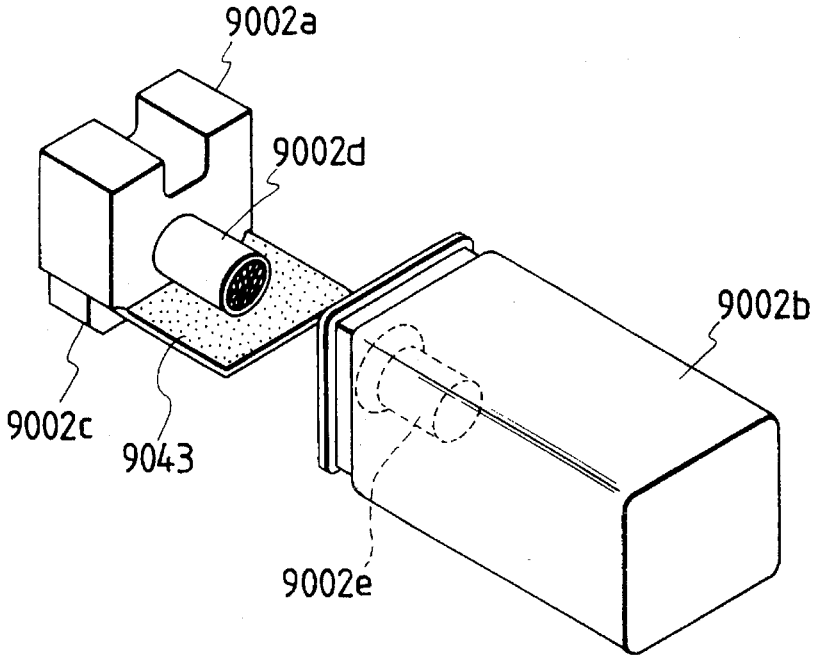
FIG. 89 is a partially perspective view schematically illustrating the structure of an ink jet cartridge according to a further embodiment.
Figure 90:
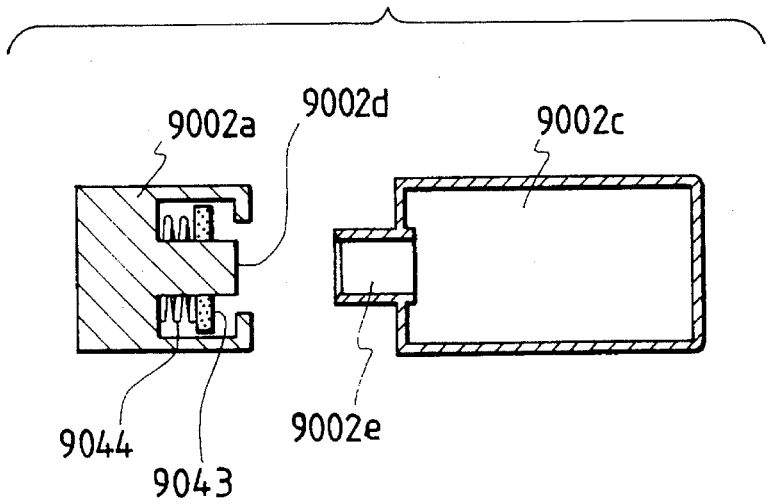
FIG. 90 is a partially perspective view schematically illustrating the structure of the ink jet cartridge.

As shown in FIG. 89, the absorbent 9043 is arranged to adhere to the recording head 9002*a*. Also, in FIG. 90, the absorbent 9043 is fitted around the outer periphery of the connecting rod 9002*d* and pressed onto the ink tank 9002*c* side by a compression spring 9044. Thus, when separated, it is removed from the connecting rod 9002*d* while absorbing ink existing on the outer periphery of the connecting rod 9002*d*. Further, a groove is provided for at least one of the recording head 9002*a* and ink tank 9002*c*; thus arranging a structure which can bring about the same effect as the embodiment described in conjunction with FIG. 88.

Subsequently, another embodiment will be described.

Figure 91:
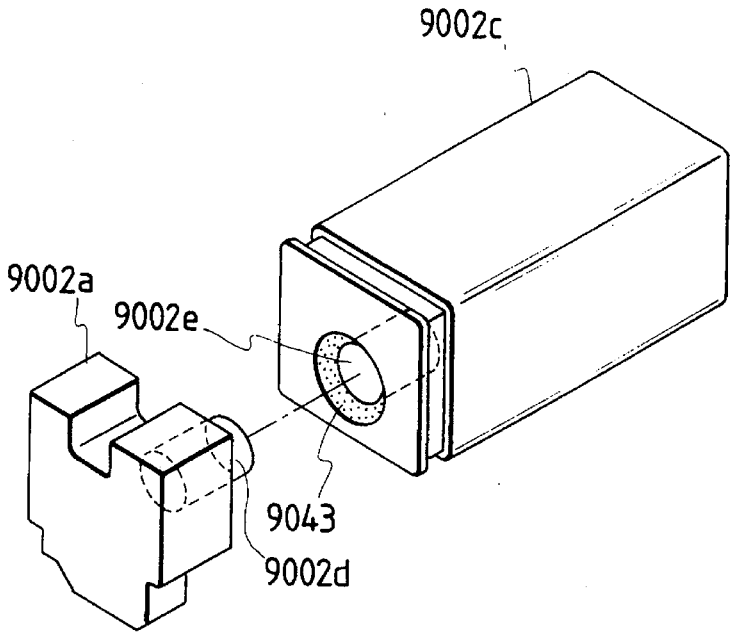
FIG. 91 is a partially perspective view schematically illustrating the structure of an ink cartridge according to another embodiment.

As shown in FIG. 91, the present embodiment is such that the absorbent in the embodiment described in conjunction with FIG. 87 is arranged on the ink tank side.

Now, still another embodiment will be described.

Figure 92:
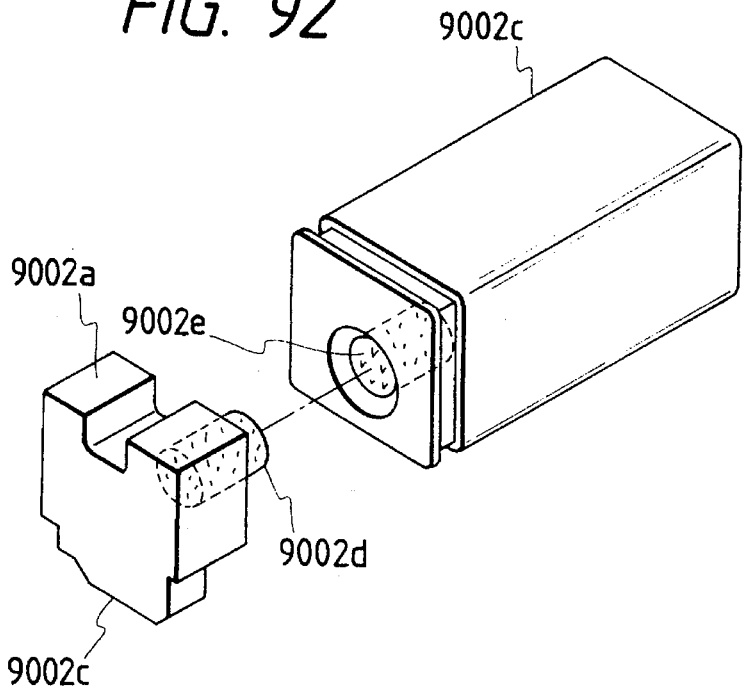
FIG. 92 is a partially perspective view schematically illustrating the structure of an ink cartridge according to still another embodiment.

As shown in FIG. 92, the present embodiment is such that a water repellent treatment is given to the connecting rod 9002*d* while a hydrophilic treatment is given to the connecting hole 9002*e*. In the case, ink does not adhere to the connecting rod 9002*d* to which the water repellent treatment is given. It always adheres to the ink hole 9002*e* where the hydrophilic treatment is conducted. As a result, there will be no ink leakage from inside the ink tank 9002*c* to the outside.

Figure 93:
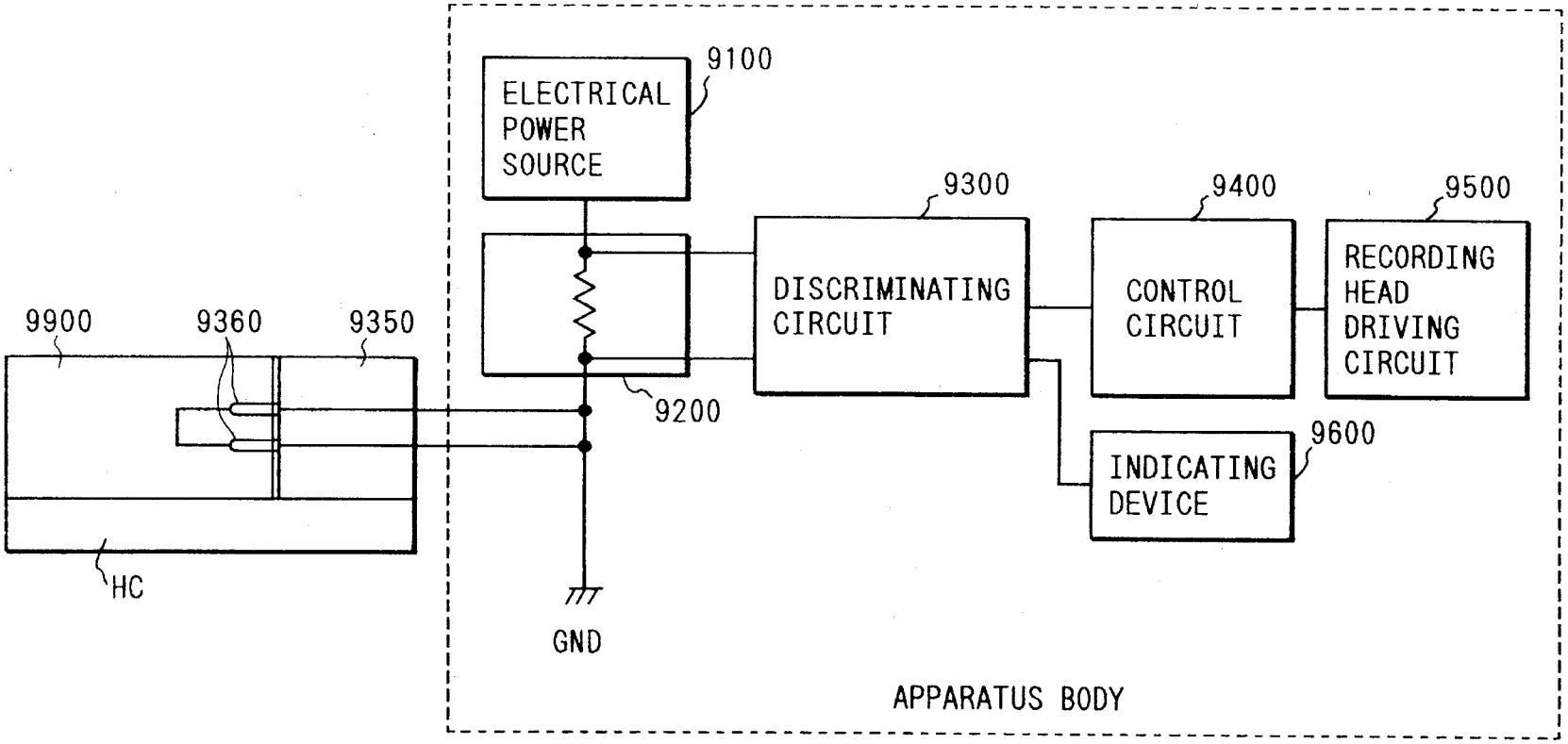
FIG. 93 is a block diagram showing the setup for an ink tank detection according to a further embodiment.

FIG. 93 illustrates another embodiment and is a block diagram showing a circuit to detect the ink tank and ink amount using a detection terminal 9360 and detection pin 9380. This circuit is provided in the ink jet recording apparatus body described earlier.

In FIG. 93, whether the ink tank is present and also a sufficient amount of ink exists or not is determined by the discriminating circuit 9300 on the basis of the detection results of the current detection circuit 9200 in accordance with the contact/non-contact between the detection terminal 9360 and detection pin 9380 as well as the existing amount of ink as described above. The signals carrying the detection results are transmitted to a control circuit 9400. The control circuit 9400 is installed in the ink tank 9900. If it is found that ink exists, the usual recording operation such as driving of the recording head will be conducted through the carriage driving (driving circuit for this is not shown) and recording head driving circuit 9500. On the other hand, if the discriminating circuit 9300 detects no ink. Then, the control circuit 9400 causes the recording operation to be disabled.

Also, the control circuit 9400 causes an indication device 9600 to indicate the results output from the discriminating circuit 9300.

In this respect, according to the present embodiment, the detection is conducted by two detection pins 9380 to detect the presence of ink, but it may be possible to detect the remaining amount of ink by detecting the material value of ink using the two detection pins 9380.

Also, in the present embodiment, the current detection circuit 9200 and discriminating circuit 9300 are provided on the recording apparatus side, but it may be possible to arrange them on the head cartridge side.

Figure 94:
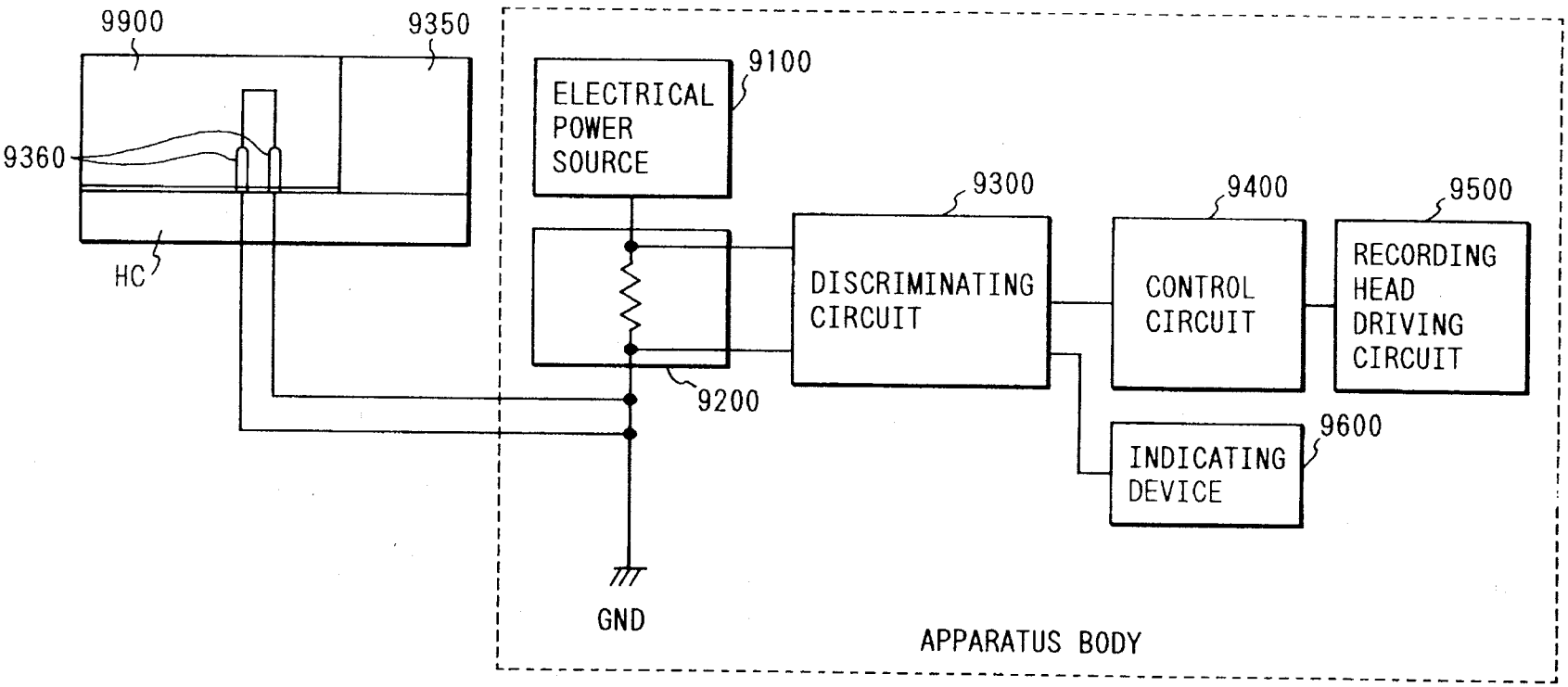
FIG. 94 is a block diagram showing the setup for an ink tank detection according to still a further embodiment.

In another embodiment the details of which are shown in FIG. 94, the detection terminal 9360 to detect the presence of the ink tank 9900 is arranged on the carriage HC side. Hence, it becomes possible to detect the presence of ink tank and ink as well in accordance with the installation of the head cartridge on the carriage HC.

As described above, each of the embodiments is effective by itself, but it may be possible to combine a plurality of these embodiments in order to provide an ink jet recording apparatus having a higher reliability.

In this respect, particularly among ink jet recording methods, the present invention produces excellent effects on a recording head and recording apparatus which creates change of state in ink with means provided to generate thermal energy to be utilized for ejecting ink (electrothermal transducers, laser beam, or the like, for example).

Regarding the typical structure and operational principle of such a method, it is preferable to adopt those which can be implemented using the fundamental principle disclosed in the specifications of U.S. Pat. Nos. 4,723,129 and 4,740,796. This method is applicable to so-called on-demand type recording system and a continuous type recording system. Particularly, however, it is suitable for the on-demand type because the principle is such that at least one driving signal, which provides a rapid temperature rise beyond a departure from nucleation boiling point in response to recording information, is applied to an electro-thermal transducer disposed on a liquid (ink) retaining sheet or liquid passage whereby to cause the electrothermal transducer to generate thermal energy to produce film boiling on the thermoactive portion of the recording head; thus effectively leading to the resultant formation of a bubble in the recording liquid (ink) one to one for each of the driving signals. By the development and contraction of the bubble, the liquid (ink) is ejected through a discharging port to produce at least one droplet. The driving signal is preferably in the form of pulses because the development and contraction of the bubble can be effectuated instantaneously, and, therefore, the liquid (ink) is ejected with quick response.

The driving signal in the form of pulses is preferably such as disclosed in the specifications of U.S. Pat. Nos. 4,463,359 and 4,345,262.

In addition, the temperature increasing rate of the heating surface is preferably such as disclosed in the specification of U.S. Pat. No. 4,313,124 for an excellent recording in a better condition.

The structure of the recording head may be as shown in each of the above-mentioned the specifications wherein the structure is arranged to combine the discharging ports, liquid passages, and the electrothermal transducers as disclosed in the above-mentioned patents (linear type liquid passage or right angle liquid passage). Besides, the structure such as disclosed in the specifications of U.S. Pat. Nos. 4,558,333 and 4,459,600 wherein the thermal activation portions are arranged in a curved area is also included in the present invention.

In addition, the present invention is applicable to the structure disclosed in Japanese Laid-Open Application No. 59-123670 wherein a common slit is used as the discharging ports for plural electro-thermal transducers, and to the structure disclosed in Japanese Patent Laid-Open Application No. 59-138461 wherein an opening for absorbing pressure waves of the thermal energy is formed corresponding to the discharging ports. In other words, according to the present invention, it becomes possible to operate the recording assuredly irrespective of the modes of the recording head.

Furthermore, as a full line type recording head having a length corresponding to the maximum recording width, it may be possible to arrange a structure either by combining plural recording heads disclosed in the above-mentioned specifications or by a single recording head integrally constructed to cover such a length.

In addition, the present invention is applicable to a serial type recording head wherein the recording head is fixed on the main assembly, to a replaceable chip type recording head which is connected electrically with the main apparatus and can be supplied with ink when it is mounted in the main assembly, or to a cartridge type recording head having an integral ink container.

Also, it is preferable to additionally provide recording head recovery means and preliminarily auxiliary means which are arranged as constituents of a recording apparatus according to the present invention. These elements will contribute to making the effectiveness of the present invention more stabilized. To name them specifically, such elements are capping means for the recording head, cleaning means, compression or suction means, preliminary heating means such as electrothermal transducers or heating elements other than such traducing type elements or the combination of those types of elements, and means for ejecting a preliminary ejection mode besides the regular ejection for recording.

As regards the kind and number of the recording heads mountable on the carriage, it may be a single color ink, or may be plural heads corresponding to a plurality of ink materials having different recording colors or densities. The present invention is effectively applicable to an apparatus having at least one of a monochromatic mode mainly with black, a multi-color mode with different color ink materials and/or a full-color mode using the mixture of the colors, which may be an integrally formed recording unit or a combination of plural recording heads.

Now, in the embodiments, according to the present invention set forth above, while the ink has been described as liquid, it may be an ink material which is solidified below the room temperature but liquefied at the room temperature. Since the ink is controlled within the temperature not lower than 30° C. and not higher than 70° C. to stabilize its viscosity for the provision of the stable ejection in general, the ink may be such that it can be liquefied when the applicable recording signals are given.

In addition, while preventing the temperature rise due to the thermal energy by the positive use of such energy as an energy consumed for changing states of the ink from solid to liquid, or using the ink which will be solidified when left intact for the purpose of preventing ink evaporation, it may be possible to apply to the present invention the use of an ink having a nature of being liquefied only by the application of thermal energy such as an ink capable of being ejected as ink liquid by enabling itself to be liquefied anyway when the thermal energy is given in accordance with recording signals, and an ink which will have already begun solidifying itself by the time it reaches a recording medium.

For an ink such as this, it may be possible to retain the ink as a liquid or solid material in through holes or recesses formed in a porous sheet as disclosed in Japanese Patent Laid-Open Application No. 54-56847 or Japanese Patent Laid-Open Application No. 60-71260 in order to execute a mode whereby to enable the ink to face the electrothermal transducers in such a state.

For the present invention, the most effective method for each of the above-mentioned ink materials is the one which can implement the film boiling method described above.

Furthermore, as modes of the foregoing ink jet recording apparatus, a copying apparatus combined with a reader and the like or a facsimile apparatus having transmission and reception functions or the like may be employed in addition to those used as an image output terminal of an information processing apparatus such as a computer.

What is claimed is:

1. An ink jet recording apparatus comprising:

a carriage for mounting an ink jet head for recording on a recording medium located at a recording area and an ink tank for containing ink to be supplied to said ink jet head, said carriage being movable along the recording medium and having a mounting surface on which said ink jet head and said ink tank are mounted; and a lever member provided on said carriage, said lever member for moving said ink tank which is connected to said ink jet head mounted on said mounting surface of said carriage and which is capable of supplying ink to said ink jet head and for separating said ink jet head from said ink tank.

2. An apparatus according to claim 1, wherein said ink jet head comprises an ink discharge port for discharging ink and an electrothermal converting element and ink is discharged from said ink discharge port by thermal energy generated by said electrothermal converting element.

3. An apparatus according to claim 1, wherein said ink jet head and said ink tank include a joint mechanism that comprises a joint pawl, provided on one of said ink jet head and said ink tank, having a gradually enlarging projection at a top end thereof that is elastically deformable and a guide groove, provided on the other of said ink jet head and said ink tank, for guiding said joint pawl in a direction to join and for receiving said projection of said joint pawl.

4. An ink jet recording apparatus comprising:

a retaining member for retaining an ink jet head for recording on a recording medium located at a recording area and an ink tank for containing ink to be supplied to said ink jet head, said retaining member having a retaining surface on which said ink jet head and said ink tank are retained; and a lever member provided on said retaining member, said lever member for moving said ink tank which is connected to said ink jet head retained on said retaining surface of said retaining member and which is capable of supplying ink to said ink jet head and for separating said ink jet head from said ink tank.

5. An apparatus according to claim 4, wherein said ink jet head comprises an ink discharge port for discharging ink and an electrothermal converting element and ink is discharged from said ink discharge port by thermal energy generated by said electrothermal converting element.

6. An apparatus according to claim 4, wherein said ink jet head and said ink tank include a joint mechanism that comprises a joint pawl, provided on one of said ink jet head and said ink tank, having a gradually enlarging projection at a top end thereof that is elastically deformable and a guide groove, provided on the other of said ink jet head and said ink tank, for guiding said joint pawl in a direction to join and for receiving said projection of said joint pawl.

7. An ink jet recording apparatus comprising:

a retaining member for retaining an ink jet head for recording on a recording medium located at a recording area, a first ink tank for containing ink to be supplied to said ink jet head and a second ink tank for containing ink to be supplied to said first ink tank, said retaining member having a retaining surface on which said ink jet head and said first and second ink tanks are retained; and a lever member provided on said retaining member, said lever member for moving said second ink tank which is connected to said first ink tank retained on said retaining surface of said retaining member and which is capable of supplying ink to said first ink tank and for separating said first ink tank from said second ink tank.

8. An apparatus according to claim 7, wherein said ink jet head comprises an ink discharge port for discharging ink and an electrothermal converting element and in is discharged from said ink discharge port by thermal energy generated by said electrothermal converting element.

9. An apparatus according to claim 7, wherein said ink jet head, said first ink tank and said second ink tank include a joint mechanism that comprises a joint pawl, provided on one of said ink jet head, said first ink tank and said second ink tank, having a gradually enlarging projection at a top end thereof that is elastically deformable and a guide groove, provided on another of said ink jet head, said first ink tank, and said second ink tank, for guiding said joint pawl in a direction to join and for receiving said projection of said joint pawl.

10. An ink tank for containing ink to be supplied to an ink jet head, said ink jet head and said ink tank being mountable on a carriage, said ink tank capable of supplying ink to said ink jet head when mounted on said carriage and being separable from said ink jet head mounted on said carriage through a lever portion, said ink tank comprising:

an ink containing portion for containing ink;

a communication path for communicating said ink containing portion with an exterior of said ink tank, said communication path comprising an ink supply path for supplying ink in said ink containing portion to said ink jet head; and an engaging portion provided on an outer surface of said ink tank, said engaging portion engaging with said lever portion to separate said ink tank from said ink jet head.

11. An apparatus according to claim 10, wherein said ink jet head comprises an ink discharge port for discharging ink and an electrothermal converting element and ink is discharged from said ink discharge port by thermal energy generated by said electrothermal converting element.

* * * * *

UNITED STATES PATENT AND TRADEMARK OFFICE

CERTIFICATE OF CORRECTION

PATENT NO. : 5,512,926

DATED : April 30, 1996

INVENTOR(S) : Yoshio UCHIKATA, et al.

It is certified that error appears in the above-indentified patent and that said Letters Patent is hereby corrected as shown below:

COLUMN 1:

Line 43, "tank" should read --tanks--.

COLUMN 3:

Line 56, "the" should read --in the--.

COLUMN 7:

Line 18, "according" should read --according to--;

Line 29, "an" should read --a--.

COLUMN 10:

Line 28, "nails 13" should read --nails 12--.

COLUMN 14:

Line 44, "a operation" should read --an operation--.

COLUMN 15:

Line 33, "key board" should read --keyboard--.

UNITED STATES PATENT AND TRADEMARK OFFICE

CERTIFICATE OF CORRECTION

PATENT NO. : 5,512,926

DATED : April 30, 1996

INVENTOR(S) : Yoshio UCHIKATA, et al.

It is certified that error appears in the above-indentified patent and that said Letters Patent is hereby corrected as shown below:

COLUMN 18:

Line 54, "hear" should read --head--.

COLUMN 20:

Line 6, "illustrate" should read --illustrates--.

COLUMN 21:

Line 42, "514" should read --514,--.

COLUMN 24:

Line 47, "are" should read --is--.

COLUMN 26:

Line 29, "which" should read --which is--.

COLUMN 28:

Line 31, "designate" should read --designates--.

UNITED STATES PATENT AND TRADEMARK OFFICE

CERTIFICATE OF CORRECTION

PATENT NO. : 5,512,926 Page 3 of 5

DATED : April 30, 1996

INVENTOR(S) : Yoshio UCHIKATA, et al.

It is certified that error appears in the above-indentified patent and that said Letters Patent is hereby corrected as shown below:

COLUMN 32:

Line 27, "apparatuses" should read --apparatuses,--;

Line 37, "cyanogen" should read --cyan--.

COLUMN 35:

Line 21, "detachable" should read --detachably--;

Line 53, "form" should read --from--.

COLUMN 36:

Line 27, "Jet" should read --jet--.

COLUMN 38:

Line 41, "provide" should read --provided--.

COLUMN 39:

Line 51, "compete" should read --complete--.

UNITED STATES PATENT AND TRADEMARK OFFICE

CERTIFICATE OF CORRECTION

PATENT NO. : 5,512,926 Page 4 of 5

DATED : April 30, 1996

INVENTOR(S) : Yoshio UCHIKATA, et al.

It is certified that error appears in the above-indentified patent and that said Letters Patent is hereby corrected as shown below:

COLUMN 40:

Line 22, "tarrier" should read --carrier--.

COLUMN 41:

Line 33, "marching" should read --matching--.

COLUMN 43:

Line 52, "ink. Then," should read --ink, then--.

COLUMN 44:

Line 46, "the specifications" should read --specifications--.

COLUMN 45:

Line 21, "traducing" should read --transducing--;

Line 22, "ejecting" should read --effecting--.

UNITED STATES PATENT AND TRADEMARK OFFICE

CERTIFICATE OF CORRECTION

PATENT NO. : 5,512,926 Page 5 of 5

DATED : April 30, 1996

INVENTOR(S) : Yoshio UCHIKATA, et al.

It is certified that error appears in the above-indentified patent and that said Letters Patent is hereby corrected as shown below:

COLUMN 46:

Line 17, "jet head" should read --tank--;

Line 18, "tank." should read --jet head.--;

Line 44, "jet head" should read --tank-- and "tank." should read --jet head.--.

COLUMN 47:

Line 6, "first ink tank" should read --second ink tank-- and "second ink tank." should read --first ink tank.--;

Line 9, "in" should read --ink--.

Signed and Sealed this

First Day of October, 1996

Bruce Lehman

*Attest:*

BRUCE LEHMAN

*Attesting Officer*

*Commissioner of Patents and Trademarks*